US008157341B2

(12) United States Patent
Usui

(10) Patent No.: US 8,157,341 B2
(45) Date of Patent: Apr. 17, 2012

(54) PRINTING METHOD, PRINTING SYSTEM AND STORAGE MEDIUM HAVING PROGRAM RECORDED THEREON

(75) Inventor: Toshiki Usui, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/702,102

(22) Filed: Feb. 8, 2010

(65) Prior Publication Data

US 2010/0207978 A1 Aug. 19, 2010

Related U.S. Application Data

(62) Division of application No. 11/241,107, filed on Sep. 29, 2005, now Pat. No. 7,686,407.

(30) Foreign Application Priority Data

| | | |
|---|---|---|
| Sep. 29, 2004 | (JP) | 2004-284787 |
| Sep. 29, 2004 | (JP) | 2004-284788 |
| Sep. 13, 2005 | (JP) | 2005-265852 |
| Sep. 27, 2005 | (JP) | 2005-279980 |
| Sep. 27, 2005 | (JP) | 2005-279981 |

(51) Int. Cl.
*B41J 29/38* (2006.01)

(52) U.S. Cl. ..... 347/9; 347/10; 347/11

(58) Field of Classification Search ..... 347/9–13
See application file for complete search history.

(56) References Cited

U.S. PATENT DOCUMENTS

| | | | | |
|---|---|---|---|---|
| 6,270,179 | B1 * | 8/2001 | Nou | 347/10 |
| 6,886,902 | B2 * | 5/2005 | Scardovi | 347/19 |
| 7,219,977 | B2 * | 5/2007 | Mitsuzawa | 347/43 |
| 7,413,272 | B2 * | 8/2008 | Shamoun et al. | 347/14 |
| 7,441,853 | B2 | 10/2008 | Takata | |
| 7,530,654 | B2 | 5/2009 | Tamura | |

FOREIGN PATENT DOCUMENTS

| | | | |
|---|---|---|---|
| JP | 2000-052570 | A | 2/2000 |
| JP | 2001-038927 | A | 2/2001 |
| JP | 2003246086 | A | 9/2003 |

* cited by examiner

*Primary Examiner* — Jason Uhlenhake
(74) *Attorney, Agent, or Firm* — Nutter McClennen & Fish LLP; John J. Penny, V; Christopher J. Stow

(57) ABSTRACT

The printing method includes the following steps of: preparing a printing apparatus that includes an element that is driven in order to form a dot, a first drive signal generation section that generates drive signals for driving the element, and a second drive signal generation section that generates drive signals for driving the element; at a certain timing, forming a dot of a predetermined size by generating a first drive signal with the first drive signal generation section and by generating a second drive signal that is different from the first drive signal with the second drive signal generation section; and at a separate timing, forming a dot of the predetermined size by generating the first drive signal with the second drive signal generation section. With this printing method, the first drive signal generation section and the second drive signal generation section can be made to generate an equal amount of heat.

15 Claims, 35 Drawing Sheets

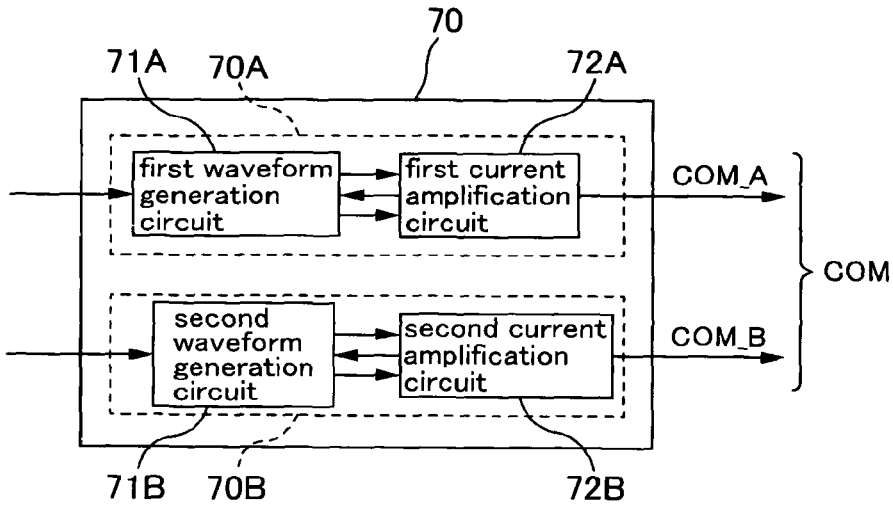
Fig.4
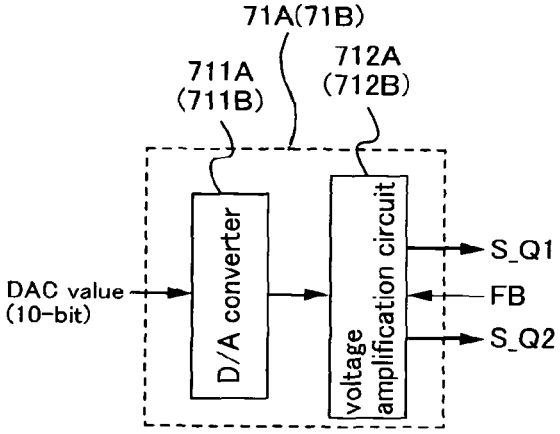
Fig.5A
| DAC value | output voltage |
|---|---|
| 3FFh | 42. 32V |
| ⋮ | ⋮ |
| 24Eh | 25. 00V |
| ⋮ | ⋮ |
| 0h | 1. 40V |
Fig.5B

| drive signal | power consumption (W) | | | |
|---|---|---|---|---|
| | no dot | small dot | medium dot | large dot |
| COM_A | 0.0 | 3.0 | 0.0 | 3.0 |
| COM_B | 0.0 | 0.0 | 2.0 | 1.5 |

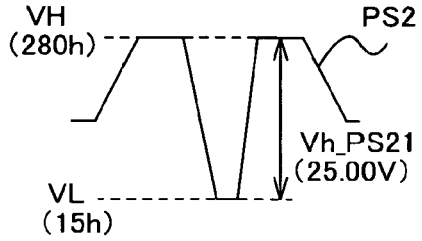
Fig.15A
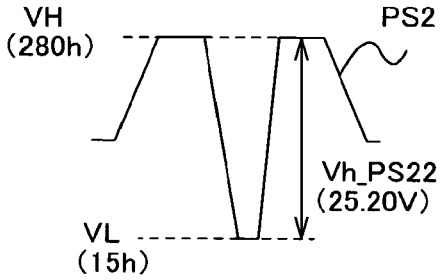
Fig.15C
| DAC value | output voltage |
|---|---|
| ⋮ | ⋮ |
| 280h | 27. 00V |
| ⋮ | ⋮ |
| 00Fh | 2. 00V |
| ⋮ | ⋮ |
| 000h | 1. 40V |
Fig.15B
| DAC value | output voltage |
|---|---|
| ⋮ | ⋮ |
| 280h | 27. 24V |
| ⋮ | ⋮ |
| 00Fh | 2. 04V |
| ⋮ | ⋮ |
| 000h | 1. 40V |
Fig.15D

TM

| | | | |
|---|---|---|---|
| 1 | 9 | 3 | 11 |
| 13 | 5 | 15 | 7 |
| 4 | 12 | 2 | 10 |
| 16 | 8 | 14 | 6 |

UM

| | | | |
|---|---|---|---|
| 16 | 8 | 14 | 6 |
| 4 | 12 | 2 | 10 |
| 13 | 5 | 15 | 7 |
| 1 | 9 | 3 | 11 |

| pixel data SI | first switch control signal SW_A | second switch control signal SW_B |
|---|---|---|
| 00 | q_LINE0 | q_LINE4 |
| 01 | q_LINE1 | q_LINE5 |
| 10 | q_LINE2 | q_LINE6 |
| 11 | q_LINE3 | q_LINE7 |

Fig.34

| signal line | odd pixel period | even pixel period |
|---|---|---|
| COM_LINE1 | COM_A | COM_B |
| COM_LINE2 | COM_B | COM_A |
| q_LINE0 | q0 | q4 |
| q_LINE1 | q1 | q5 |
| q_LINE2 | q2 | q6 |
| q_LINE3 | q3 | q7 |
| q_LINE4 | q4 | q0 |
| q_LINE5 | q5 | q1 |
| q_LINE6 | q6 | q2 |
| q_LINE7 | q7 | q3 |

Fig.35

PRINTING METHOD, PRINTING SYSTEM AND STORAGE MEDIUM HAVING PROGRAM RECORDED THEREON

RELATED U.S. APPLICATIONS

This application is a divisional application based on U.S. application Ser. No. 11/241,107 filed on Sep. 29, 2005, entitled "PRINTING METHOD, PRINTING SYSTEM, AND STORAGE MEDIUM HAVING PROGRAM RECORDED THEREON," from which priority is claimed under 35 U.S.C. §120. The teachings of the aforementioned application are incorporated herein by reference.

CROSS-REFERENCE TO RELATED APPLICATIONS

The present application claims priority upon Japanese Patent Application No. 2004-284787 filed on Sep. 29, 2004, Japanese Patent Application No. 2004-284788 filed on Sep. 29, 2004, Japanese Patent Application No. 2005-265852 filed on Sep. 13, 2005, Japanese Patent Application No. 2005-279980 filed on Sep. 27, 2005, and Japanese Patent Application No. 2005-279981 filed on Sep. 27, 2005, which are herein incorporated by reference.

BACKGROUND OF THE INVENTION

1. Field of the Invention

The present invention relates to printing methods, printing systems, and storage media having programs recorded thereon.

2. Description of the Related Art

Printing apparatuses in which a plurality of drive signals are selectively applied to a single piezo element have been proposed as printing apparatuses for printing an image on a medium. For example, a printing apparatus in which a plurality of types of drive pulses that cause ink to be ejected at different amounts are divided between two drive signals and these drive pulses are selectively applied to the piezo elements, has been proposed (for example, see JP 2000-52570A). Also having been proposed is a printing apparatus in which the drive pulses that are used when forming the largest size dot are included in one of the drive signals to increase the ejection frequency of the ink when forming the largest size dot (for example, see JP 2003-246086A). Both of these printing apparatuses are provided with a plurality of drive signal generation sections for generating the drive signals.

When a printing apparatus is provided with a plurality of drive signal generation sections and each drive signal generation section generates a different drive signal, there is a possibility that heat will be generated predominantly in one of the drive signal generation sections.

Further, in a printing apparatus provided with a plurality of drive signal generation sections, there is a possibility that discrepancies among the properties of the drive signal generation sections will lead to variation in the amount of ink that is ejected, even though the drive signal generation sections are generating the same drive signal. As a result, the print image will appear coarse.

SUMMARY OF THE INVENTION

Accordingly, it is an object of the present invention to make the drive signal generation sections generate heat equally.

A first main aspect of the invention for achieving the above object is a printing method including the following steps of:

preparing a printing apparatus that includes an element that is driven in order to form a dot, a first drive signal generation section that generates drive signals for driving the element, and a second drive signal generation section that generates drive signals for driving the element;

at a certain timing, forming a dot of a predetermined size by generating a first drive signal with the first drive signal generation section and by generating a second drive signal that is different from the first drive signal with the second drive signal generation section; and at a separate timing, forming a dot of the predetermined size by generating the first drive signal with the second drive signal generation section.

A further object of the invention is to obtain a high-quality print image by adjusting the amount of ink that is ejected in correspondence with discrepancies among the properties of the various drive signal generation sections.

A second main aspect of the invention for achieving the above object is a printing method including the following steps of:

preparing a printing apparatus that includes an element that is driven in order to eject ink, a first drive signal generation section that generates drive signals for driving the element, and a second drive signal generation section that generates drive signals for driving the element;

when the first drive signal generation section is caused to generate a drive signal for forming a dot of a predetermined size and the second drive signal generation section is caused to generate a drive signal for forming a dot of a size that is different from a dot of the predetermined size, correcting an amount of the ink that is ejected according to the drive signal that is generated by the first drive signal generation section, based on a first correction value that is associated with the first drive signal generation section; and when the second drive signal generation section is caused to generate the drive signal for forming a dot of the predetermined size, correcting an amount of the ink that is ejected according to the drive signal that is generated by the second drive signal generation section, based on a second correction value that is associated with the second drive signal generation section.

A yet further object of the invention is to inhibit a drop in image quality of the print image, even when there are discrepancies among the properties of the various drive signal generation sections.

A third main aspect of the invention for achieving the above object is a printing method including the following steps of:

preparing a printing apparatus that includes an element that is driven in order to form a dot, a first drive signal generation section that generates drive signals for driving the element, and a second drive signal generation section that generates drive signals for driving the element, the printing apparatus alternately repeating a dot formation operation of forming dots on a medium while changing a relative position between the element and the medium, and a carrying operation of carrying the medium;

generating a first drive signal with the first drive signal generation section when forming a dot of a predetermined size at a certain timing; and during the dot formation operation, changing the drive signal generation section that generates the first drive signal from the first drive signal generation section to the second drive signal generation section, and then when forming a dot of the predetermined size at a separate timing, generating the first drive signal with the second drive signal generation section.

Other features of the present invention will become clear through the following description and the appended drawings.

BRIEF DESCRIPTION OF THE DRAWINGS

FIG. 4 is a block diagram for describing the configuration of the drive signal generation circuit.

FIG. 5A is a block diagram for describing the configuration of the first waveform generation circuit and the second waveform generation circuit, and FIG. 5B is a diagram for describing the relationship between the DAC value that is input to the D/A converter and the voltage that is output from the voltage amplification circuit.

FIG. 15A is a diagram that shows the drive pulse PS2 that is generated by the first drive signal generation section 70A, FIG. 15B shows the relationship between the DAC value that is input to the first drive signal generation section 70A and the output voltage, FIG. 15C is a diagram that shows the drive pulse PS2 that is generated by the second drive signal generation section 70B, and FIG. 15D is a diagram that shows the relationship between the DAC voltage that is input to the second drive signal generation section 70B and the output voltage.

FIG. 34 is an explanatory diagram of the relationship between the 2-bit pixel data, and the first switch control signal SW1 and the second switch control signal SW2.

FIG. 35 is an explanatory diagram of the signals that flow through the signal lines.

DESCRIPTION OF PREFERRED EMBODIMENTS

Overview of the Disclosure

Figure 1:
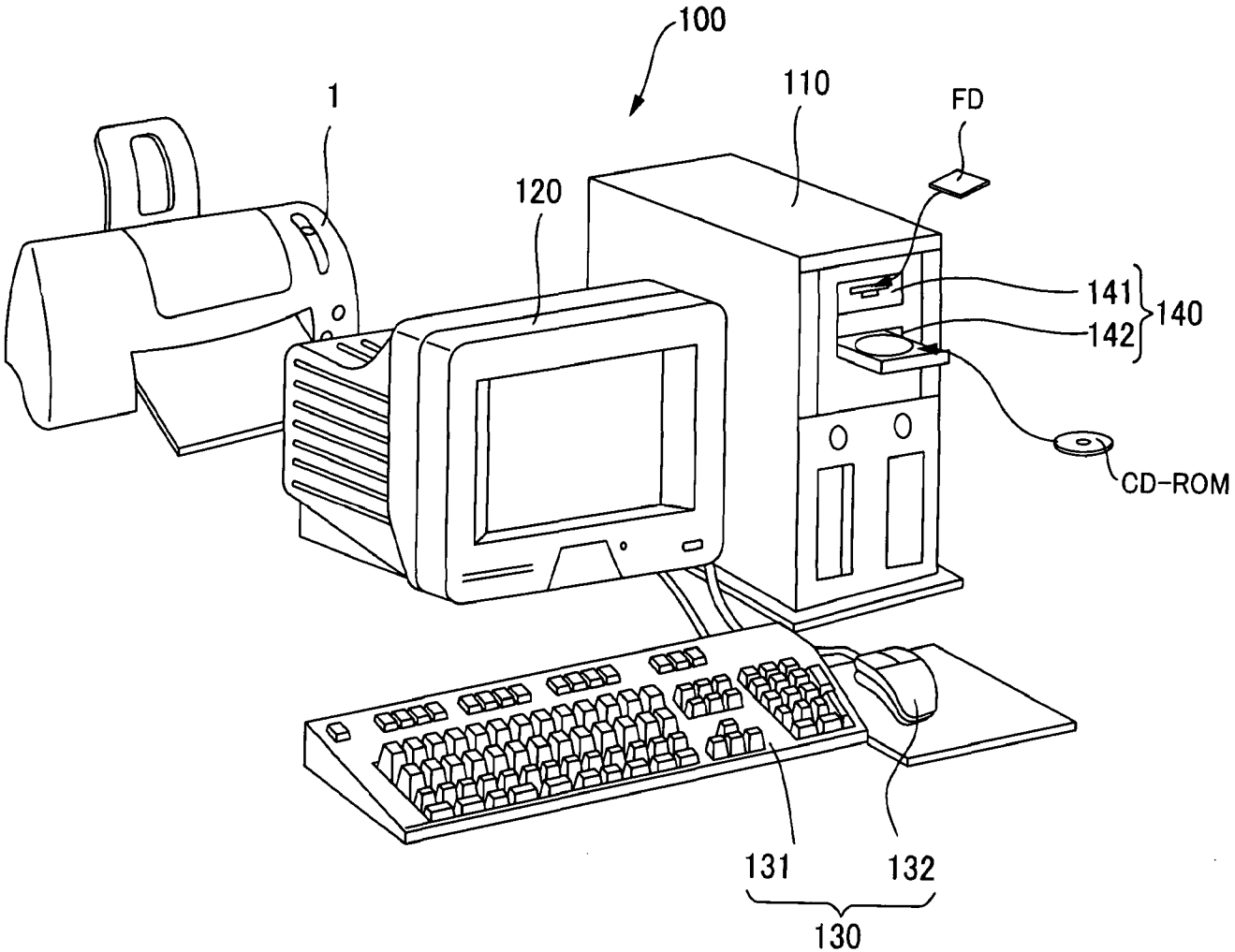
FIG. 1 is a diagram that describes the configuration of the printing system.

At least the following matters will become clear through the description of the present specification and the accompanying drawings.

A printing method includes the following steps of:

preparing a printing apparatus that includes an element that is driven in order to form a dot, a first drive signal generation section that generates drive signals for driving the element, and a second drive signal generation section that generates drive signals for driving the element;

at a certain timing, forming a dot of a predetermined size by generating a first drive signal with the first drive signal generation section and by generating a second drive signal that is different from the first drive signal with the second drive signal generation section; and at a separate timing, forming a dot of the predetermined size by generating the first drive signal with the second drive signal generation section.

With this printing method, the first drive signal generation section and the second drive signal generation section evolve an equal amount of heat.

In this printing method, it is preferable that when forming a dot of the predetermined size at the certain timing, the first drive signal is generated by the first drive signal generation section and the second drive signal is generated by the second drive signal generation section, and when forming a dot of the predetermined size at the separate timing, the second drive signal is generated by the first drive signal generation section and the first drive signal is generated by the second drive signal generation section. Thus, the first drive signal generation section and the second drive signal generation section evolve an equal amount of heat.

In this printing method, it is preferable that the printing apparatus further includes a separate drive signal generation section that is different from the first drive signal generation section and the second drive signal generation section, and that when forming a dot of the predetermined size at the certain timing, the first drive signal is generated by the first drive signal generation section and the second drive signal is generated by the second drive signal generation section, and when forming a dot of the predetermined size at the separate timing, the first drive signal is generated by the second drive signal generation section and the second drive signal is generated by the separate drive signal generation section. Thus, without switching the drive signals, the first drive signal generation section and the second drive signal generation section evolve an equal amount of heat.

In this printing method, it is preferable that the printing apparatus alternately repeats a dot formation operation of forming dots on a medium and a carrying operation of carrying the medium, and that the drive signal that is generated by the first drive signal generation section is changed per each dot formation operation. Thus, regardless of the image that is printed, the first drive signal generation section and the second drive signal generation section evolve an equal amount of heat.

It is also possible that the printing apparatus repeats a dot formation operation of forming dots on a medium a plurality of times to print an image on the medium, and that the drive signal that is generated by the first drive signal generation section is changed while printing the image on the medium. It is further possible that the printing apparatus prints on a plurality of pieces of media in a continuous manner, and that the drive signal that is generated by the first drive signal generation section is changed per each medium. In this case as well, the first drive signal generation section and the second drive signal generation section evolve an equal amount of heat.

It is also possible that the printing apparatus further includes a temperature sensor for detecting a temperature of at least one of the first drive signal generation section and the second drive signal generation section, and that the drive signal that is generated by the first drive signal generation section is changed according to the result of the detection by the temperature sensor. Further, it is also possible that the number of the dots that are formed is counted, and that the drive signal that is generated by the first drive signal generation section is changed according to the result of the count. In this case as well, the first drive signal generation section and the second drive signal generation section evolve an equal amount of heat.

In this printing method, it is preferable that the printing apparatus further includes a cooling device for cooling the first drive signal generation section and the second drive signal generation section. Thus, the cooling device can be kept from becoming large.

In this printing method, it is preferable that the printing apparatus can form dots in a plurality of sizes, and that a drive pulse that is included in the first drive signal or the second drive signal is selectively applied to the element in accordance with the size of the dot to be formed. Moreover, if two or more drive pulses are applied to the element when forming a dot of the predetermined size, then it is preferable that when one of the first drive signal generation section and the second drive signal generation section is generating the drive pulses for forming the dot of the predetermined size, the other generates at least one of the drive pulses for forming a dot of another size. As a result, both the print resolution and the print speed are increased. It is also preferable that when forming a dot of a largest size, the drive pulse included in the first drive signal is applied to the element and the drive pulse included in the second drive signal is applied to the element. This allows the amount of heat that is generated disproportionately to be reduced.

A printing system includes:

a computer; and a printing apparatus, the printing apparatus including (A) an element that is driven in order to form a dot, (B) a first drive signal generation section that generates drive signals for driving the element, (C) a second drive signal generation section that generates drive signals for driving the element, and (D) a controller that, when forming a dot of a predetermined size at a certain timing, causes the first drive signal generation section to generate a first drive signal and causes the second drive signal generation section to generate a second drive signal that is different from the first drive signal; and when forming a dot of the predetermined size at a separate timing, causes the second drive signal generation section to generate the first drive signal.

With this printing system, the first drive signal generation section and the second drive signal generation section evolve heat equally.

A storage medium has a program stored thereon, wherein the program includes the following codes:

a code that causes a printing apparatus that includes an element that is driven in order to form a dot, a first drive signal generation section that generates drive signals for driving the element, and a second drive signal generation section that generates drive signals for driving the element, to form, at a certain timing, a dot of a predetermined size by causing a first drive signal to be generated with the first drive signal generation section and by causing a second drive signal that is different from the first drive signal to be generated with the second drive signal generation section; and a code that causes the printing apparatus to form, at a separate timing, a dot of the predetermined size by causing the first drive signal to be generated with the second drive signal generation section.

With this storage medium having a program recorded thereon, the printing apparatus can be controlled such that the first drive signal generation section and the second drive signal generation section evolve heat equally.

A printing method includes the following steps of:

preparing a printing apparatus that includes an element that is driven in order to eject ink, a first drive signal generation section that generates drive signals for driving the element, and a second drive signal generation section that generates drive signals for driving the element;

when the first drive signal generation section is caused to generate a drive signal for forming a dot of a predetermined size and the second drive signal generation section is caused to generate a drive signal for forming a dot of a size that is different from a dot of the predetermined size, correcting an amount of the ink that is ejected according to the drive signal that is generated by the first drive signal generation section, based on a first correction value that is associated with the first drive signal generation section; and when the second drive signal generation section is caused to generate the drive signal for forming a dot of the predetermined size, correcting an amount of the ink that is ejected according to the drive signal that is generated by the second drive signal generation section, based on a second correction value that is associated with the second drive signal generation section.

With this printing method, the amount of ink that is ejected is adjusted according to the discrepancies among the properties of the drive signal generation sections, and thus a high-quality print image can be obtained.

In this printing method, it is preferable that the first drive signal generation section generates the drive signal for forming a dot of the different size when the second drive signal generation section is caused to generate the drive signal for forming a dot of the predetermined size. Consequently, the amount of ink that is ejected is adjusted according to the discrepancies among the properties of the drive signal generation sections, and thus a high-quality print image can be obtained.

In this printing method, it is preferable that the printing apparatus further includes a separate drive signal generation section that is different from the first drive signal generation section and the second drive signal generation section, and that the separate drive signal generation section generates the drive signal for forming a dot of the different size when the second drive signal generation section is caused to generate the drive signal for forming a dot of the predetermined size. Consequently, the amount of ink that is ejected is adjusted according to the discrepancies among the properties of the drive signal generation sections, and thus a high-quality print image can be obtained.

In this printing method, it is preferable that the printing apparatus forms a pattern for obtaining the first correction value on a medium by causing the first drive signal generation section to generate the drive signal for forming dots of the predetermined size, and forms a pattern for obtaining the second correction value on a medium by causing the second drive signal generation section to generate the drive signal for forming dots of the predetermined size. Thus, unique correction values can be obtained for each printing apparatus.

In this printing method, it is preferable that the amount of the ink that is ejected in order to form a dot of the predetermined size is corrected based on the first correction value or the second correction value. Thus, the size of the dot that is formed by the first drive signal generation section and the size of the dot that is formed by the second drive signal generation section are corrected, and this allows a high-quality print image to be obtained.

In this printing method, it is preferable that when the first drive signal generation section is caused to generate the drive signal for forming a dot of the predetermined size, a voltage of the drive signal that is generated by the first drive signal generation section is corrected based on the first correction value, and that when the second drive signal generation section is caused to generate the drive signal for forming a dot of the predetermined size, a voltage of the drive signal that is generated by the second drive signal generation section is corrected based on the second correction value. Correcting the voltage of the drive signals in turn corrects the amount by which the elements are driven, and thereby the amount of ink that is ejected is corrected.

In this printing method, it is preferable that each of the drive signals includes a plurality of drive waveforms, and that correction is performed such that an intermediate voltage of each of the drive waveforms in the drive signal generated by the first drive signal generation section or the second drive signal generation section is the same. Thus, it is possible to inhibit sudden changes in the voltage of the drive signals.

In this printing method, it is preferable that correction is performed such that an intermediate voltage of each of the drive signals generated by the first drive signal generation section and the second drive signal generation section is the same. Thus, it is possible to inhibit sudden changes in the voltage of the drive signals.

In this printing method, it is preferable that each of the drive signals includes a plurality of drive waveforms, and that a dot of a largest size is formed by at least one of the drive waveforms generated by the first drive signal generation section and at least one of the drive waveforms generated by the second drive signal generation section. Thus, the heat that is evolved by the drive signal generation sections can be distributed.

In this printing method, it is preferable that the number of the dots of the predetermined size that are formed within a predetermined region is corrected. Thus, the amount of ink that is ejected to that region is corrected, allowing a high-quality print image to be obtained.

In this printing method, it is preferable that the dot creation ratio is corrected based on the first correction value or the second correction value. Thus, the amount of ink that is ejected to that region is corrected, allowing a high-quality print image to be obtained.

In this printing method, it is preferable that a memory of the printing apparatus stores a third correction value that is associated with the first drive signal generation section and a fourth correction value that is associated with the second drive signal generation section, and that, when the second drive signal generation section is caused to generate the drive signal for forming a dot of the different size, the printing apparatus corrects an amount of the ink that is ejected according to the drive signal that is generated by the second drive signal generation section based on the fourth correction value, and when the first drive signal generation section is caused to generate the drive signal for forming a dot of the different size, the printing apparatus corrects an amount of the ink that is ejected according to the drive signal that is generated by the first drive signal generation section based on the third correction value.

A printing system includes:

a computer; and a printing apparatus, the printing apparatus including (A) an element that is driven in order to eject ink, (B) a first drive signal generation section that generates drive signals for driving the element, (C) a second drive signal generation section that generates drive signals for driving the element, (D) a memory that stores a first correction value that is associated with the first drive signal generation section and a second correction value that is associated with the second drive signal generation section, and (E) a controller that, when the first drive signal generation section is caused to generate a drive signal for forming a dot of a predetermined size and the second drive signal generation section is caused to generate a drive signal for forming a dot of a size that is different from a dot of the predetermined size, corrects an amount of the ink that is ejected according to the drive signal that is generated by the first drive signal generation section, based on the first correction value, and when the second drive signal generation section is caused to generate the drive signal for forming a dot of the predetermined size, corrects an amount of the ink that is ejected according to the drive signal that is generated by the second drive signal generation section, based on the second correction value.

With this printing system, the amount of ink that is ejected is adjusted according to the discrepancies among the properties of the drive signal generation sections, and thus a high-quality print image can be obtained.

A storage medium has a program stored thereon, wherein the program includes the following codes:

a code that causes a printing system that includes an element that is driven in order to eject ink, a first drive signal generation section that generates drive signals for driving the element, and a second drive signal generation section that generates drive signals for driving the element, to correct, when the first drive signal generation section is caused to generate a drive signal for forming a dot of a predetermined size and the second drive signal generation section is caused to generate a drive signal for forming a dot of a size that is different from a dot of the predetermined size, an amount of the ink that is ejected according to the drive signal that is generated by the first drive signal generation section, based on a first correction value that is associated with the first drive signal generation section; and a code that causes the printing system to correct, when the second drive signal generation section is caused to generate the drive signal for forming a dot of the predetermined size, an amount of the ink that is ejected according to the drive signal that is generated by the second drive signal generation section, based on a second correction value that is associated with the second drive signal generation section.

With this storage medium having a program recorded thereon, the amount of ink that is ejected is adjusted according to the discrepancies among the properties of the drive signal generation sections, and thus a high-quality print image can be obtained.

A printing method includes the following steps of:

preparing a printing apparatus that includes an element that is driven in order to form a dot, a first drive signal generation section that generates drive signals for driving the element, and a second drive signal generation section that generates drive signals for driving the element, the printing apparatus alternately repeating a dot formation operation of forming dots on a medium while changing a relative position between the element and the medium, and a carrying operation of carrying the medium;

generating a first drive signal with the first drive signal generation section when forming a dot of a predetermined size at a certain timing; and during the dot formation operation, changing the drive signal generation section that generates the first drive signal from the first drive signal generation section to the second drive signal generation section, and then when forming a dot of the predetermined size at a separate timing, generating the first drive signal with the second drive signal generation section.

With this printing method, it is possible to inhibit a drop in the image quality of the print image, even if there are discrepancies among the properties of the drive signal generation sections.

In this printing method, it is preferable that when forming a dot of the predetermined size at the certain timing, the first drive signal generation section generates the first drive signal and the second drive signal generation section generates the second drive signal, and when forming a dot of the predetermined size at the separate timing, the second drive signal generation section generates the first drive signal and the first drive signal generation section generates the second drive signal. Thus, since the drive signal that is generated by the first drive signal generation section and the drive signal that is generated by the second drive signal generation section can be switched, it is possible to inhibit a drop in the quality of the print image, even if there are discrepancies among the properties of the drive signal generation sections.

In this printing method, it is preferable that the printing apparatus further includes a separate drive signal generation section that is different from the first drive signal generation section and the second drive signal generation section, that when forming a dot of the predetermined size at the certain timing, the first drive signal generation section generates the first drive signal and the second drive signal generation section generates the second drive signal, and that when forming a dot of the predetermined size at the separate timing, the second drive signal generation section generates the first drive signal and the separate drive signal generation section generates the second drive signal. Thus, it is possible to inhibit a drop in the quality of the print image, even if the drive signal that is generated by the first drive signal generation section and the drive signal that is generated by the second drive signal generation section are not switched.

In this printing method, it is preferable that the drive signal generation section that generates the first drive signal is changed per each period in which a dot of one pixel is formed. Thus, deterioration of the image quality can be inhibited even further.

In this printing method, it is preferable that the printing apparatus further includes a moving member that moves the element in a movement direction in order to change a relative position between the element and the medium, and a sensor for detecting the position of the moving member, and that the drive signal generation section that generates the first drive signal is changed according to the result of the detection by the sensor. Thus, the controller can obtain the timing at which the drive signals should be switched.

In this printing method, it is preferable that the order of the drive signals that are generated by the first drive signal generation section and the second drive signal generation section is changed per each dot formation operation. By doing this, the image quality of the print image becomes uniform, and this increases the image quality.

In this printing method, it is preferable that the printing apparatus can form dots in a plurality of sizes, and that a drive pulse that is included in the first drive signal or the second drive signal is selectively applied to the element in accordance with the size of the dot to be formed. Further, in a case where two or more drive pulses are applied to the element when forming a dot of the predetermined size, it is also preferable that, when one of the first drive signal generation section and the second drive signal generation section is generating the drive pulses for forming the dot of the predetermined size, the other generates the drive pulse for forming a dot of another size. As a result, both the print resolution and the print speed are increased. Further, it is also preferable that when forming a dot of a largest size, the drive pulse included in the drive signal that is generated by the first drive signal generation section is applied to the element and the drive pulse included in the drive signal that is generated by the second drive signal generation section is applied to the element. This allows the amount of heat that is generated disproportionately to be reduced.

A printing system includes:

a computer; and a printing apparatus, the printing apparatus including (A) an element that is driven in order to form a dot, (B) a first drive signal generation section that generates drive signals for driving the element, (C) a second drive signal generation section that generates drive signals for driving the element, and (D) a controller that, when forming a dot of a predetermined size at a certain timing, causes the first drive signal generation section to generate a first drive signal, and when forming a dot of the predetermined size at a separate timing, causes the second drive signal generation section to generate the first drive signal;

wherein the printing apparatus alternately repeats a dot formation operation of forming dots on a medium while changing a relative position between the element and the medium, and a carrying operation of carrying the medium; and wherein, during the dot formation operation, the controller changes the drive signal generation section that generates the first drive signal from the first drive signal generation section to the second drive signal generation section.

With this printing system, it is possible to inhibit a drop in the quality of the print image, even if there are discrepancies among the properties of the drive signal generation sections.

A storage medium has a program stored thereon, wherein the program includes the following codes:

a code that causes a printing apparatus that includes an element that is driven in order to form a dot, a first drive signal generation section that generates drive signals for driving the element, and a second drive signal generation section that generates drive signals for driving the element, to alternately repeat a dot formation operation of forming dots on a medium while changing a relative position between the element and the medium, and a carrying operation of carrying the medium;

a code that causes a first drive signal to be generated by the first drive signal generation section when forming a dot of a predetermined size at a certain timing;

a code that, during the dot formation operation, changes the drive signal generation section that generates the first drive signal from the first drive signal generation section to the second drive signal generation section; and a code that causes the first drive signal to be generated by the second drive signal generation section when forming a dot of the predetermined size at a separate timing.

With this storage medium, it is possible to cause the printing apparatus to execute printing so that a drop in the quality of the print image is inhibited, even if there are discrepancies among the properties of the drive signal generation sections.

Printing System

First, a printing apparatus will be described along with a printing system. It should be noted that the printing system is a system that includes at least a printing apparatus and a print control apparatus for controlling the operation of the printing apparatus.

FIG. 1 is a diagram that illustrates the configuration of the printing system 100. The illustrative printing system 100 shown here includes a printer 1 as a printing apparatus and a computer 110 as a print control apparatus. Specifically, the printing system 100 includes the printer 1, the computer 110, a display device 120, an input device 130, and a record/play device 140.

The printer 1 prints images on media such as paper, cloth, and film. It should be noted that in the following description, a paper S (see FIG. 3A), which is a representative medium, is described as an illustrative example of this medium. The computer 110 is communicably connected to the printer 1. To cause the printer 1 to print an image, the computer 110 outputs print data corresponding to that image to the printer 1. Computer programs such as an application program and a printer driver are installed on the computer 110. The display device 120 has a display. The display device 120 is for example a device for displaying the user interface of the computer programs. The input device 130 is for example a keyboard 131 and a mouse 132. The record/play device 140 is for example a flexible disk drive device 141 and a CD-ROM drive device 142.

<Configuration of the Computer 110>

Figure 2A:
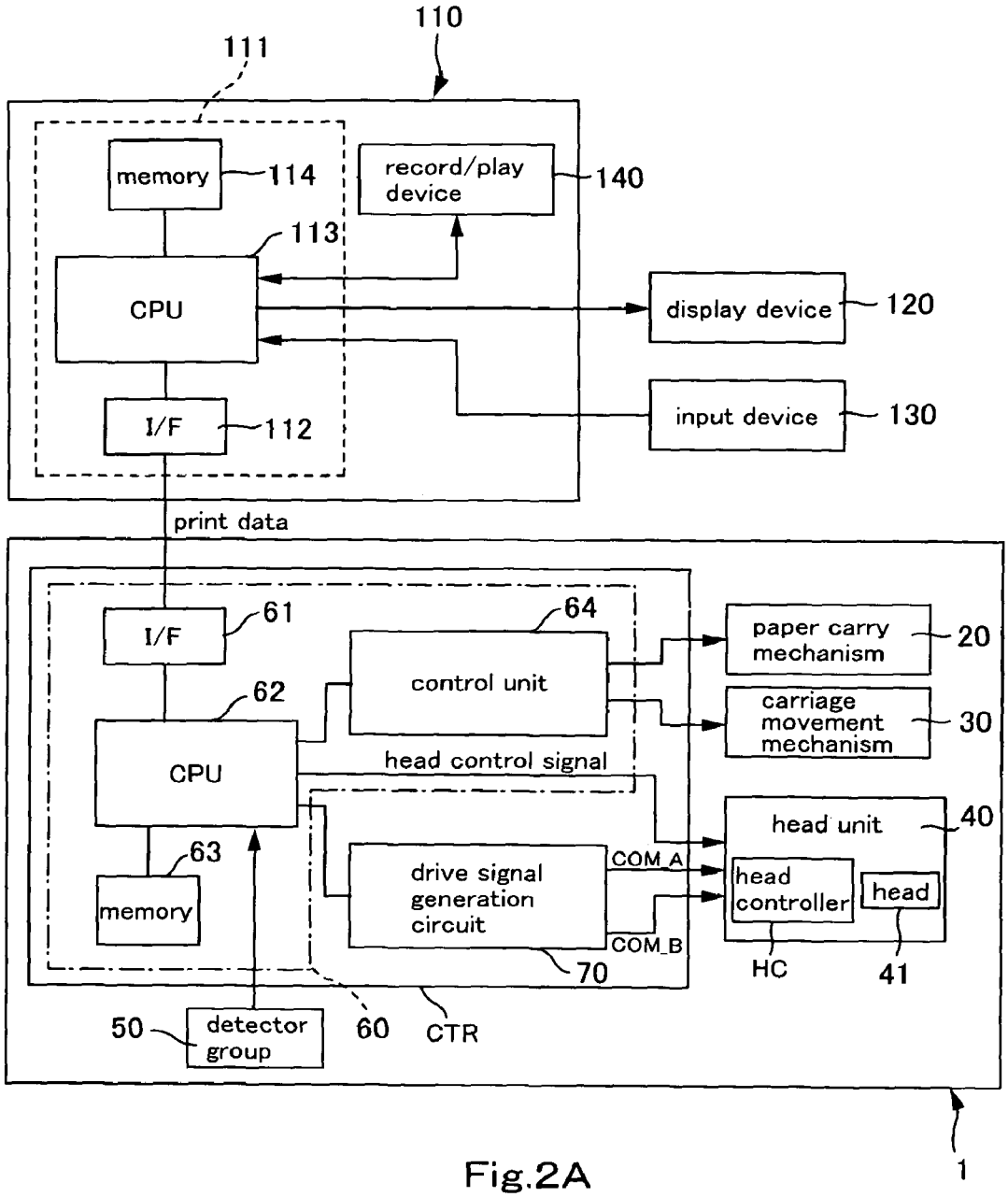
FIG. 2A is a block diagram for describing the configuration of the computer and the printer.
Figure 2B:
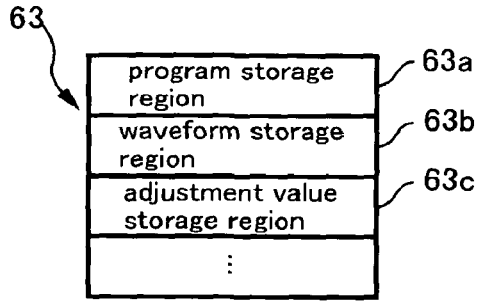
FIG. 2B is a diagram for schematically describing a section of the memory in the printer.

FIG. 2A is a block diagram that describes the configuration of the computer 110 and the printer 1. FIG. 2B is a diagram for schematically describing a section of a memory 63 of the printer 1.

First, the configuration of the computer 110 is briefly described. The computer 110 has the record/play device 140 described above and a host-side controller 111. The record/play device 140 is communicably connected to the host-side controller 111, and for example is attached to the housing of the computer 110. The host-side controller 111 performs various controls in the computer 110, and is also communicably connected to the display device 120 and the input device 130 mentioned above. The host-side controller 111 has an interface section 112, a CPU 113, and a memory 114. The interface section 112 is interposed between the computer 110 and the printer 1, and sends and receives data between the two. The CPU 113 is a computation processing device for performing overall control of the computer 110. The memory 114 is for securing a working region and a region for storing computer programs used by the CPU 113, and is constituted by a RAM, EEPROM, ROM, or magnetic disk device, for example. Examples of computer programs that are stored on the memory 114 include the application program and the printer driver mentioned above. The CPU 113 performs various controls in accordance with the computer programs stored on the memory 114.

The printer driver causes the computer 110 to achieve the function of converting the image data that are output from the application program into print data. The printer 1, by receiving the print data from the computer 110, executes a printing operation. In other words, the computer 110 can be said to control the operation of the printer 1 through the print data. The computer 110, through the printer driver, thus functions as a print control apparatus. The printer driver has codes for achieving the function of converting image data into print data.

The print data are data in a form that can be understood by the printer 1, and include various command data and pixel data. Command data are data for ordering the printer 1 to execute a specific operation. Among the command data are command data that order the supply of paper, command data that indicate a carry amount, and command data that order the discharge of paper. The pixel data are data relating to the pixels of the image to be printed. Here, the pixels are squares in a virtual grid on the paper, and indicate a region in which a dot is to be formed. The pixel data in the print data are converted into data relating to the dots to be formed on the paper (for example, data on the size of the dots). In this embodiment, the pixel data are each made of two bits of data. That is, the pixel data are pixel data [00] corresponding to no dot, pixel data [01] corresponding to a small dot, pixel data [10] corresponding to the formation of a medium dot, and pixel data [11] corresponding to a large dot. The printer 1 can thus form dots at four gradation levels with one pixel.

The printer driver performs resolution conversion, color conversion, halftone processing, and rasterization in order to convert the image data that are output from the application program into print data. Further, the printer driver is provided stored on a storage medium (computer-readable storage medium) such as a flexible disk FD or a CD-ROM. The printer driver also can be downloaded onto the computer 110 via the Internet.

<Configuration of the Printer 1>

Figure 3A:
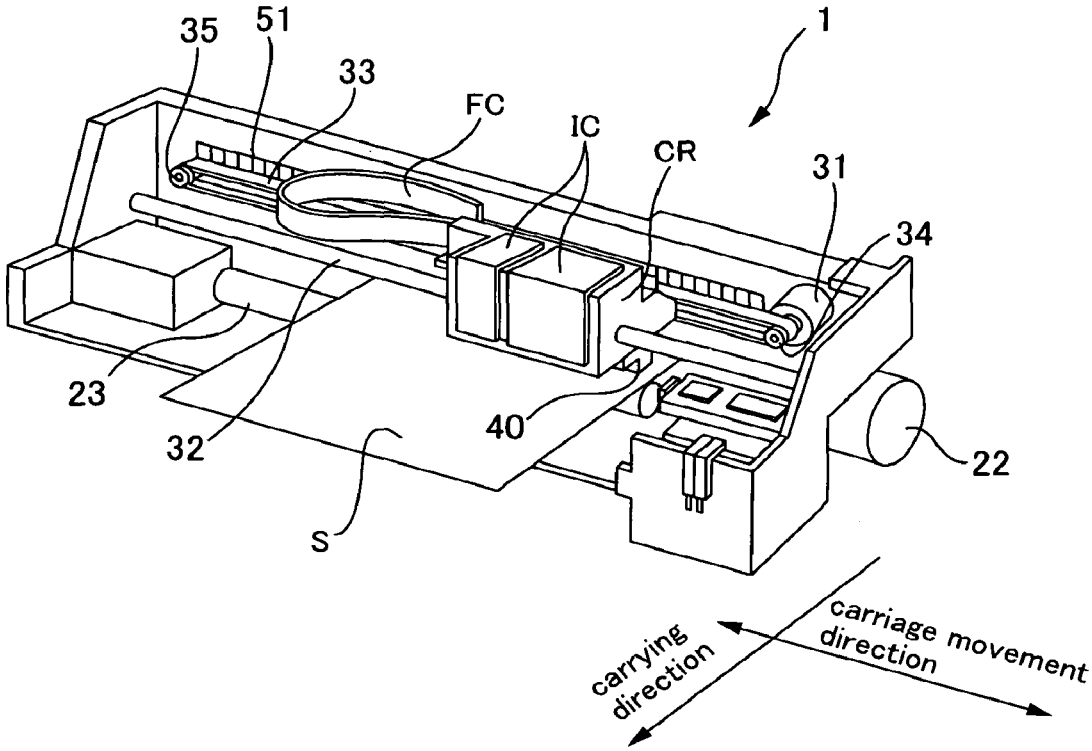
FIG. 3A is a diagram showing the configuration of the printer of the embodiment.
Figure 3B:
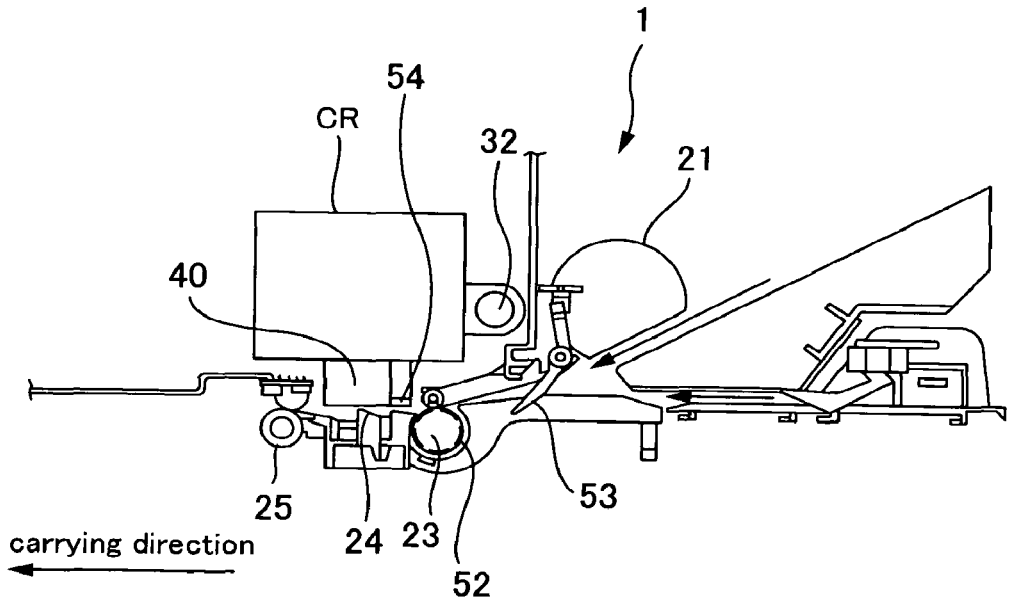
FIG. 3B is a lateral view illustrating the configuration of the printer of the embodiment.

The configuration of the printer 1 is described next. Here, FIG. 3A is a diagram that shows the configuration of the printer 1 of the embodiment. FIG. 3B is a lateral view illustrating the configuration of the printer 1 of the embodiment. It should be noted that FIG. 2A also is referred to in the following description.

As shown in FIG. 2A, the printer 1 has a paper carry mechanism 20, a carriage movement mechanism 30, a head unit 40, a detector group 50, a printer-side controller 60, and a drive signal generation circuit 70. It should be noted that in this embodiment the printer-side controller 60 and the drive signal generation circuit 70 are provided in a common controller substrate CTR.

In the printer 1, the printer-side controller 60 controls the control targets, that is, the paper carry mechanism 20, the carriage movement mechanism 30, the head unit 40, and the drive signal generation circuit 70. Thus, the printer-side controller 60 causes an image to be printed on a paper S based on the print data that are received from the computer 110. The detectors of the detector group 50 monitor conditions within the printer 1. The detectors output the result of this detection to the printer-side controller 60. The printer-side controller 60 receives the detection results from the detectors and controls the various control targets based on those detection results.

<Paper Carry Mechanism 20>

The paper carry mechanism 20 corresponds to the medium carry section for carrying media. The paper carry mechanism 20 sends the paper S to a printable position, as well as carries the paper S in the carrying direction by a predetermined carry amount. The carrying direction is a direction that intersects the carriage movement direction described next. As shown in FIG. 3A and FIG. 3B, the paper carry mechanism 20 has a paper feed roller 21, a carry motor 22, a carry roller 23, a platen 24, and a discharge roller 25. The paper feed roller 21 is a roller for automatically delivering a paper S that has been inserted into a paper insertion opening into the printer 1, and in this example has a cross-sectional shape that resembles the letter D. The carry motor 22 is a motor for carrying the paper S in the carrying direction. The carry roller 23 is a roller for carrying the paper S that has been delivered by the paper feed roller 21 up to a printable region. The operation of the carry roller 23 also is controlled by the carry motor 22. The platen 24 is a member that supports the paper S from below during printing. The discharge roller 25 is a roller for carrying the paper S for which printing has ended.

<Carriage Movement Mechanism 30>

The carriage movement mechanism 30 is for moving a carriage CR, to which the head unit 40 is attached, in a carriage movement direction. The carriage movement direction includes the direction of movement from one side to the other side and the direction of movement from that other side to the one side. It should be noted that because the head unit 40 includes the head 41, the carriage movement direction corresponds to the movement direction of the head 41, and the carriage movement mechanism 30 corresponds to a head movement section that moves the head 41 in the movement direction. The carriage movement mechanism 30 has a carriage motor 31, a guide shaft 32, a timing belt 33, a drive pulley 34, and a driven pulley 35. The carriage motor 31 corresponds to the drive source for moving the carriage CR. The drive pulley 34 is attached to the rotation shaft of the carriage motor 31. The drive pulley 34 is disposed at one end side in the carriage movement direction. The driven pulley 35 is disposed at the other end side in the carriage movement direction on the side opposite the drive pulley 34. The timing belt 33 is connected to the carriage CR and is engaged between the drive pulley 34 and the driven pulley 35. The guide shaft 32 supports the carriage CR in a manner that permits movement thereof. The guide shaft 32 is attached in the carriage movement direction. Thus, when the carriage motor 31 is operated, the carriage CR is moved in the carriage movement direction along the guide shaft 32.

<Head Unit 40>

The head unit 40 is for ejecting ink toward the paper S. The head unit 40 has a head controller HC and the head 41. The configuration of the head controller HC will be described in detail later. The head 41 is provided with a plurality of ink rows, each of which corresponds to a particular color ink. Each ink row is provided with a plurality of nozzles, and each nozzle is provided with a piezo element. When the piezo elements are driven, a pressure chamber (not shown) changes shape and the pressure that results from this causes an ink droplet to be ejected from the nozzle, which forms a dot and when it lands on the paper.

It should be noted that with the printer 1, as mentioned above, it is possible to perform control to achieve four gradation types, these being no dot corresponding to the pixel data [00], a small dot corresponding to the pixel data [01], a medium dot corresponding to the pixel data [10], and a large dot corresponding to the pixel data [11]. Thus, it is possible to eject a plurality of types of ink in differing amounts from the nozzles. For example, it is possible to eject three types of ink droplets from the nozzles, these being a large ink droplet whose size allows the formation of a large dot, a medium ink droplet whose size allows the formation of a medium dot, and a small ink droplet whose size allows the formation of a small dot.

<Detector Group 50>

The detector group 50 is for monitoring the conditions within the printer 1. As shown in FIG. 3A and FIG. 3B, the detector group 50 includes a linear encoder 51, a rotary encoder 52, a paper detector 53, and a paper width detector 54. The linear encoder 51 is for detecting the position of the carriage CR in the carriage movement direction. The rotary encoder 52 is for detecting the amount of rotation of the carry roller 23. The paper detector 53 is for detecting the position of the front end of the paper S being printed. The paper width detector 54 is for detecting the width of the paper S being printed. It should be noted that, although not shown, a temperature detector for detecting the temperature around the head 41 also is provided.

<Printer-Side Controller 60>

The printer-side controller 60 performs control of the printer 1. For example, the printer-side controller 60 controls the carry amount of the paper carry mechanism 20 by controlling the amount of rotation of the carry motor 22. The printer-side controller 60 also controls the position of the carriage CR by controlling the amount of rotation of the carriage motor 31.

The printer-side controller 60 also controls the drive signal generation circuit 70 to generate drive pulses PS. Here, a drive pulse is a signal for defining the period from the start to the finish of driving when a piezo element 417 is driven in order to eject ink. The shape of the drive signal is determined by the amount of ink to be ejected. Thus, when a drive pulse is applied to the piezo element 417, an amount of ink that corresponds to the shape of that drive pulse is ejected.

Figure 8:
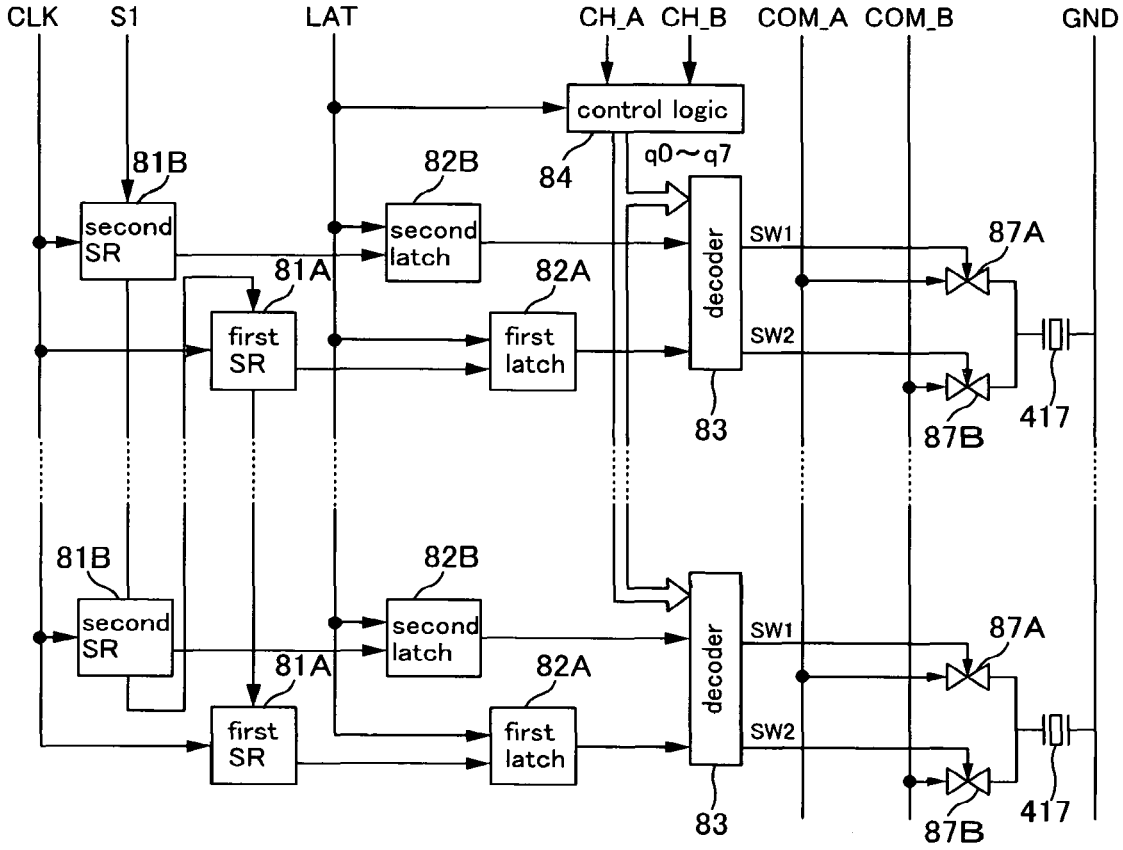
FIG. 8 is a block diagram for describing the configuration of the head controller HC.

The printer-side controller 60 outputs head control signals (clock signal CLK, pixel data SI, latch signal LAT, first change signal CH_A, second change signal CH_B; see FIG. 8) to the head controller HC. In accordance with the head control signals, the head controller HC applies the drive pulses that are included in the drive signal that has been output from the drive signal generation circuit 70 to the piezo element 417. The printer-side controller 60 and the head controller HC therefore correspond to a controller that causes the drive signal generation circuit 70 to generate an action signal that includes drive pulses, and causes the drive pulses that are created to be applied to the piezo elements 417.

As shown in FIG. 2A, the printer-side controller 60 has an interface section 61, a CPU 62, a memory 63, and a control unit 64. The interface section 61 sends and receives data to and from the computer 110, which is an external device. The CPU 62 is a computation processing device for performing overall control of the printer 1. The memory 63 is for securing a working region and a region for storing the programs of the CPU 62, and is constituted by a memory element such as a RAM, EEPROM, or ROM. As shown in FIG. 2B, in this embodiment some of the memory 63 is used as a program storage region 63*a*, a waveform storage region 63*b*, and an adjustment value storage region 63*c*. The program storage region 63*a* is a region in which computer programs are stored. The waveform storage region 63*b* is a region in which waveform data for generating drive signals are stored. The adjustment value storage region 63*c* is a region in which adjustment values for adjusting discrepancies between a first waveform generation circuit 71A and a second waveform generation circuit 71B (see FIG. 4) of the drive signal generation circuit 70 are stored.

The CPU 62 controls the various control targets in accordance with computer programs stored on the program storage region 63*a* of the memory 63. For example, the CPU 62 controls the paper carry mechanism 20 and the carriage movement mechanism 30 via the control unit 64. Further, the CPU 62 outputs head control signals for controlling the operation of the head 41 to the head controller HC and outputs control signals for causing the drive signal generation circuit 70 to create drive signals COM.

Drive Signal Generation Circuit of the Embodiment

<Drive Signal Generation Circuit 70>

The drive signal generation circuit 70 generates drive signals COM that include drive pulses. The drive signals COM are used in common for all of the piezo elements 417 corresponding to a single nozzle row.

FIG. 4 is a block diagram illustrating the configuration of the drive signal generation circuit 70. The drive signal generation circuit 70 of this embodiment has a first drive signal generation section 70A and a second drive signal generation section 70B. The first drive signal generation section 70A and the second drive signal generation section 70B have the same configuration, and thus here the first drive signal generation section 70A is described. The first drive signal generation section 70A has a first waveform generation circuit 71A and a first current amplification circuit 72A.

FIG. 5A is a block diagram for describing the configuration of the first waveform generation circuit 71A. It should be noted that in this diagram the structural elements of a second waveform generation circuit 71B are denoted in brackets. FIG. 5B is a diagram for describing the relationship between the DAC value that is input to a D/A converter 711A and the output voltage that is output from the voltage amplification circuit 712A.

The first waveform generation circuit 71A has a D/A converter 711A and a voltage amplification circuit 712A. The D/A converter 711A is an electric circuit that outputs a voltage signal that corresponds to the DAC value. The DAC value is information for indicating the voltage to be output from the voltage amplification circuit 712A (hereinafter also called the output voltage), and is output from the CPU 62 based on the waveform data stored in the waveform storage region 63*b*. In this embodiment, the DAC value is made of 10 bits of data, but for the sake of convenience, in the drawing it is expressed as a hexadecimal number.

The voltage amplification circuit 712A amplifies the output voltage from the D/A converter 711A up to a voltage that is suitable for operating the piezo elements 417. With the voltage amplification circuit 712A of this embodiment, the output voltage from the D/A converter 711A is ramped up to a maximum of around 40V to 49V. The output voltage after amplification is output to the first current amplification circuit 72A as a control signal S_Q1 and a control signal S_Q2.

For example, in the example shown in FIG. 5B, if the DAC value that is input from the CPU 62 to the D/A converter 711A is the hexadecimal value "24Eh" (the binary value "1001001110"), then the output voltage after amplification by the voltage amplification circuit 712A is 25V. If the DAC value that is input from the CPU 62 to the D/A converter 711A is the hexadecimal value "0h" (the binary value "0000000000"), then the output voltage after amplification by the voltage amplification circuit 712A is 1.4V, and if the DAC value that has been input is the hexadecimal value "3FF" (the binary value "1111111111"), then the output voltage after amplification by the voltage amplification circuit 712A is 42.32V. That is, 1.4V is the minimum output voltage of the first drive signal generation section 70A, and each time the DAC value that is input from the CPU 62 increases by 1, the output voltage of the first waveform generation circuit is raised by 0.04V.

However, manufacturing discrepancies prevent the ideal output shown in FIG. 5B from being obtained. A method for adjusting and inhibiting the effects of such manufacturing discrepancies is described later.

<Regarding the Operation of the Drive Signal Generation Sections>

Figure 6A:
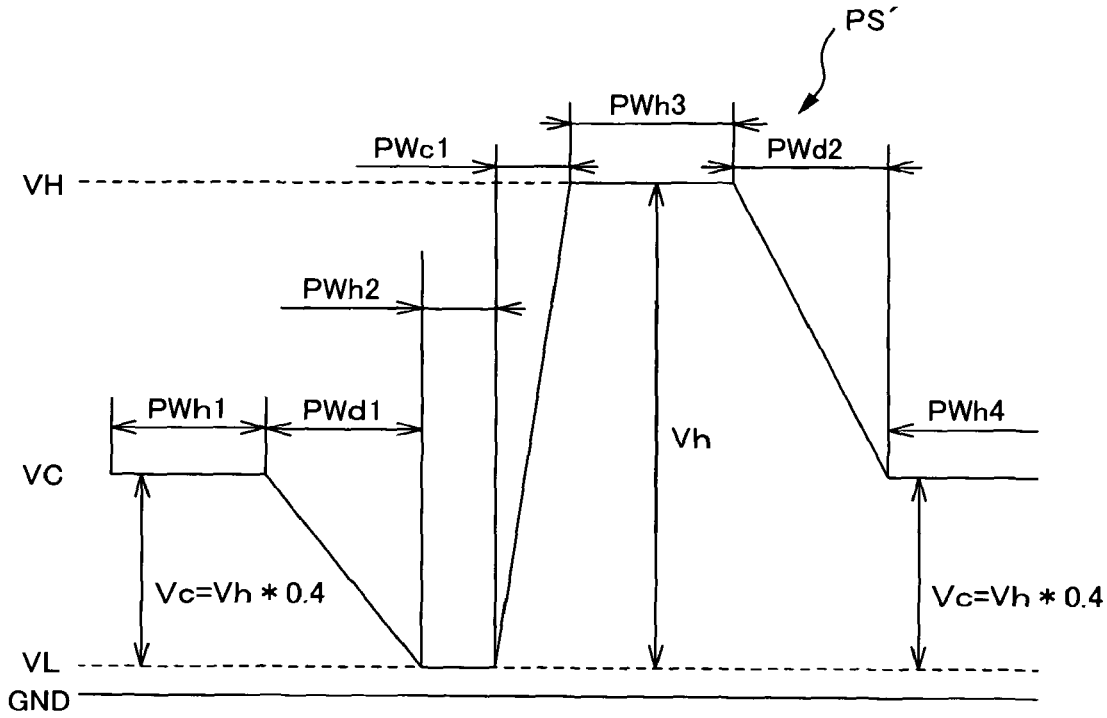
FIG. 6A is a diagram for describing a section of the drive signals that are generated.
Figure 6B:
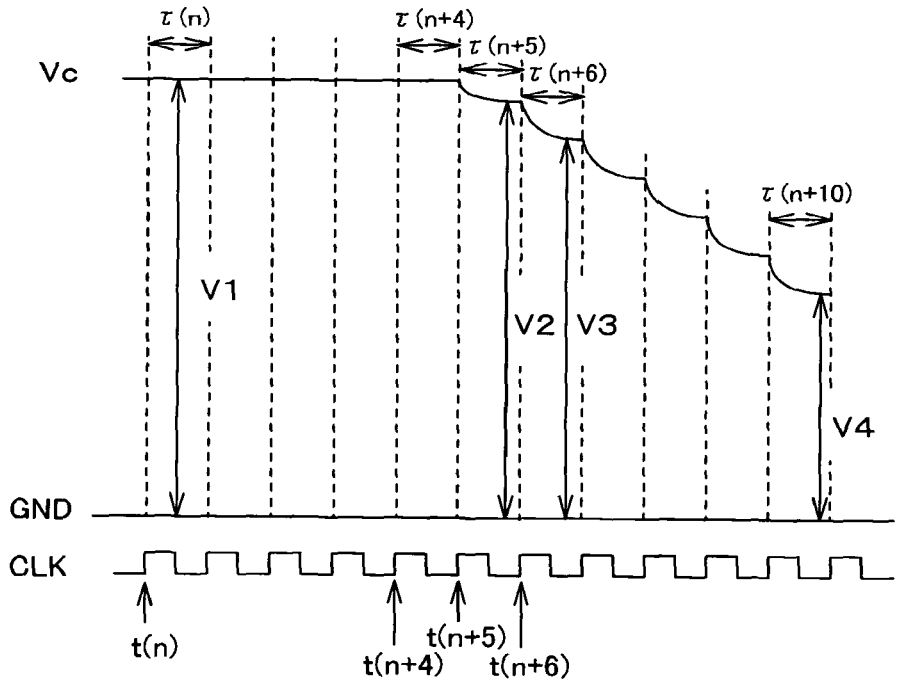
FIG. 6B is a diagram for describing the operation of lowering the output voltage of the first current amplification circuit from voltage V1 to voltage V4.

A specific example of the operation of the first drive signal generation section 70A is described next. FIG. 6A is a diagram for describing a portion of the drive signals COM that is generated. FIG. 6B is a diagram for describing the operation of lowering the output voltage of the first current amplification circuit 72A from a voltage V1 to a voltage V4.

The CPU 62 of the printer-side controller 60 first finds the output voltage for each update period τ based on the parameters for generating the drive signal COM. Taking the drive pulse PS' shown in FIG. 6A as an example, the parameters include the drive voltage Vh, the ratio defining the relationship between the drive voltage Vh and the reference voltage Vc, a time PWh1 during which an intermediate voltage VC is maintained, a time PWd1 during which the voltage is lowered from the intermediate voltage VC to a minimum voltage VL at a constant slope, a time PWh2 during which the minimum voltage VL is maintained, a time PWc1 during which the voltage is raised from the minimum voltage VL to a maximum voltage VH at a constant slope, a time PWh3 during which the maximum voltage VH is maintained, a time PWd2 during which the voltage is lowered from the maximum voltage VH to the intermediate voltage VC at a constant slope, and a time PWh4 during which the intermediate voltage VC is maintained.

Here, the drive voltage Vh is the voltage difference between the maximum voltage VH and the minimum voltage VL in the drive pulse PS'. That is, it corresponds to the difference between the minimum potential (the potential that is determined by the minimum voltage VL) and the maximum potential (the potential that is determined by the maximum voltage VH) at the piezo element 417. The reference voltage Vc determines the reference deformed state of the piezo element 417. In this embodiment, the reference voltage Vc is set to 40% of the drive voltage Vh. The value "0.4" therefore is stored as the ratio defining the relationship between the drive voltage Vh and the reference voltage Vc. The intermediate voltage VC is the voltage that is obtained by adding the minimum voltage VL and the reference voltage Vc. The maximum voltage VH is the voltage that is obtained by adding the drive voltage Vh to the minimum voltage VL. The parameters other than the drive voltage Vh are stored in the waveform storage region 63*b* of the memory 63. As regards the drive voltage Vh, a voltage value that serves as a reference (for the sake of convenience, this may also be called the reference drive voltage Vhs) is stored in the waveform storage region 63*b* of the memory 63. That is, the drive voltage Vh that is actually used is set by correcting the reference drive voltage Vhs based on the temperature around the head 41, for example.

The CPU 62 obtains the temperature around the head 41 at a predetermined timing (for example, at the paper feed timing) and determines the drive voltage Vh based on the surrounding temperature that it has obtained. When it has determined a drive voltage Vh, the CPU 62 calculates the reference voltage Vc, the intermediate voltage VC, and the maximum voltage VH. The CPU 62 then uses the time PWh1 to time PWh4 discussed above to find the output voltage for each update period τ. The update period τ is for example from 0.1 μs (clock CLK=10 MHz) to 0.05 μs (clock CLK=20 MHz). Then, the DAC value is found for each update period τ based on the output voltage for each obtained update period τ, and these are stored in a working area (not shown) of the memory 63, for example.

If a drive signal COM is to be generated, then the CPU 62 outputs the DAC value for each update period τ in sequence to the D/A converter 711A. In the example of FIG. 6B, the DAC value corresponding to a voltage V1 is output at the timing t(n), which is defined by the clock CLK. Thus, the voltage V1 is output from the voltage amplification circuit 712A in the update period τ(n). Then, up to the update period τ(n+4), the DAC value corresponding to the voltage V1 is sequentially input from the CPU 62 to the D/A converter 711A, and the voltage V1 continues to be output from the voltage amplification circuit 712A. At the timing t(n+5), the DAC value corresponding to the voltage V2 is input from the CPU 62 to the D/A converter 711A. Due to this, in the update period τ(n+5) the output from the voltage amplification circuit 712A drops from the voltage V1 to the voltage V2. Similarly, in the timing t(n+6), the DAC value corresponding to the voltage V3 is input from the CPU 62 to the D/A converter 711A, and the output from the voltage amplification circuit 712A drops from the voltage V2 to the voltage V3. In the same manner thereafter, DAC values are sequentially input to the D/A converter 711A, and thus the voltage that is output from the voltage amplification circuit 712A gradually drops. Then, at the update period τ(n+10), the output from the voltage amplification circuit 712A drops to the voltage V4.

In this manner, the drive signal that is shown in FIG. 6A is output from the first waveform generation circuit 71A.

<Regarding the Configuration of the Current Amplification Circuits>

Figure 7A:
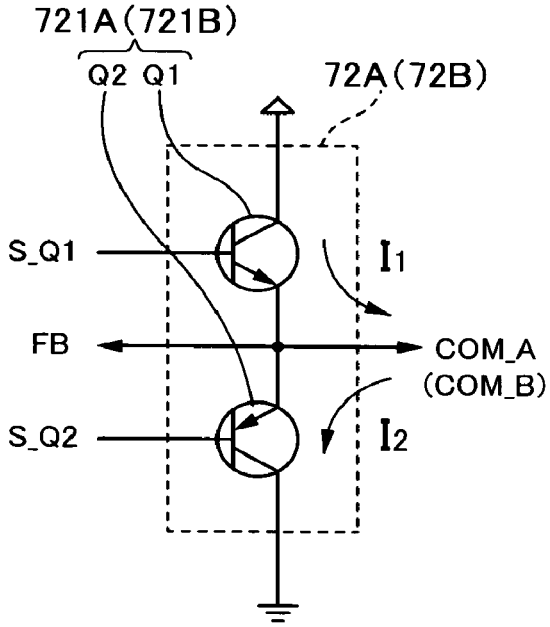
FIG. 7A is a diagram for describing the configuration of the current amplification circuit 72A (72B)
Figure 7B:
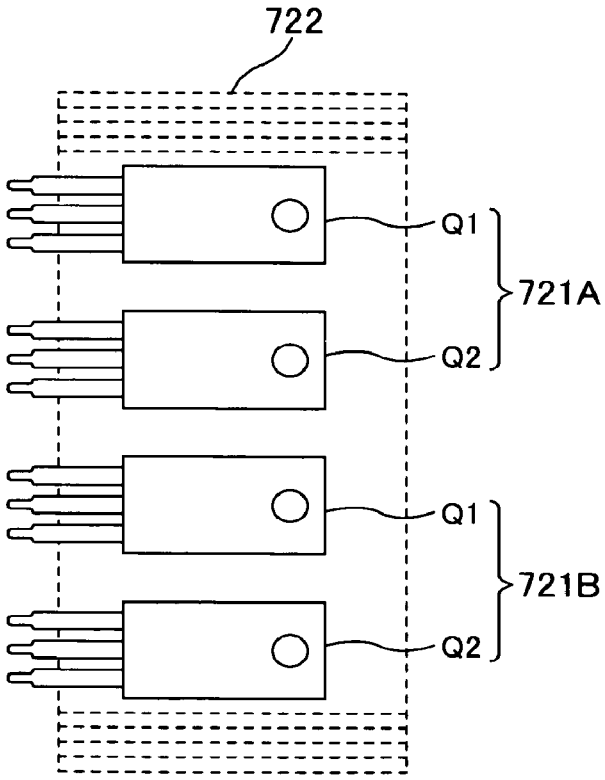
FIG. 7B is an explanatory diagram of the configuration of the two transistors and the heat sink.

The first current amplification circuit 72A will be described next. FIG. 7A is a diagram for describing the configuration of the current amplification circuit 72A (72B). FIG. 7B is an explanatory diagram of the configuration of the two transistor pairs and the heat sink.

The first current amplification circuit 72A is a circuit for supplying sufficient current in such a manner that numerous piezo elements 417 can operate without problem. The first current amplification circuit 72A has a first transistor pair 721A that generates heat in conjunction with the change in voltage of the drive signal COM. The first transistor pair 721A has an NPN-type transistor Q1 and a PNP-type transistor Q2 whose emitter terminals are connected. The NPN-type transistor Q1 is a transistor that operates when the voltage of the drive signal COM is rising. The NPN-type transistor Q1 collector is connected to the power source and its emitter is connected to the output signal line for the drive signal COM. The PNP-type transistor Q2 is a transistor that operates when the voltage is dropping. The PNP-type transistor Q2 collector is connected to the ground (earth) and its emitter is connected to the output signal line for the drive signal COM. It should be noted that the voltage of the section where the emitters of the NPN-type transistor Q1 and the PNP-type transistor Q2 are connected (the voltage of the drive signal COM) is fed back to the voltage amplification circuit 712A as illustrated by FB in the drawing.

The operation of the first current amplification circuit 72A is controlled by the voltage that is output from the first waveform generation circuit 71A. For example, when the output voltage is rising, the NPN-type transistor Q1 is turned on by the control signal S_Q1. In conjunction with this, the voltage of the drive signal COM also rises. On the other hand, when the output voltage is dropping, the PNP-type transistor Q2 is turned on by the control signal S_Q2. Along with this, the voltage of the drive signal COM also drops. It should be noted that if the output voltage is constant, then both the NPN-type transistor Q1 and the PNP-type transistor Q2 will be in the off state. As a result, the drive signal COM is a constant voltage.

A heat sink 722 is attached in common to the first transistor pair 721A and the second transistor pair 721B. The heat sink 722 radiates the heat that is generated by the four transistors to the outside.

<Regarding the Drive Signals COM>

In this embodiment, the first drive signal generation section 70A and the second drive signal generation section 70B generate different drive signals COM. The description will be made with regard to a case where the first drive signal generation section 70A generates a first drive signal COM_A and the second drive signal generation section 70B generates a second drive signal COM_B. However, as will be discussed later, in this embodiment it is also possible for the first drive signal COM_A and the second drive signal COM_B to be switched so that the first drive signal generation section 70A and the second drive signal generation section 70B generate the opposite drive signal COM.

Figure 9:
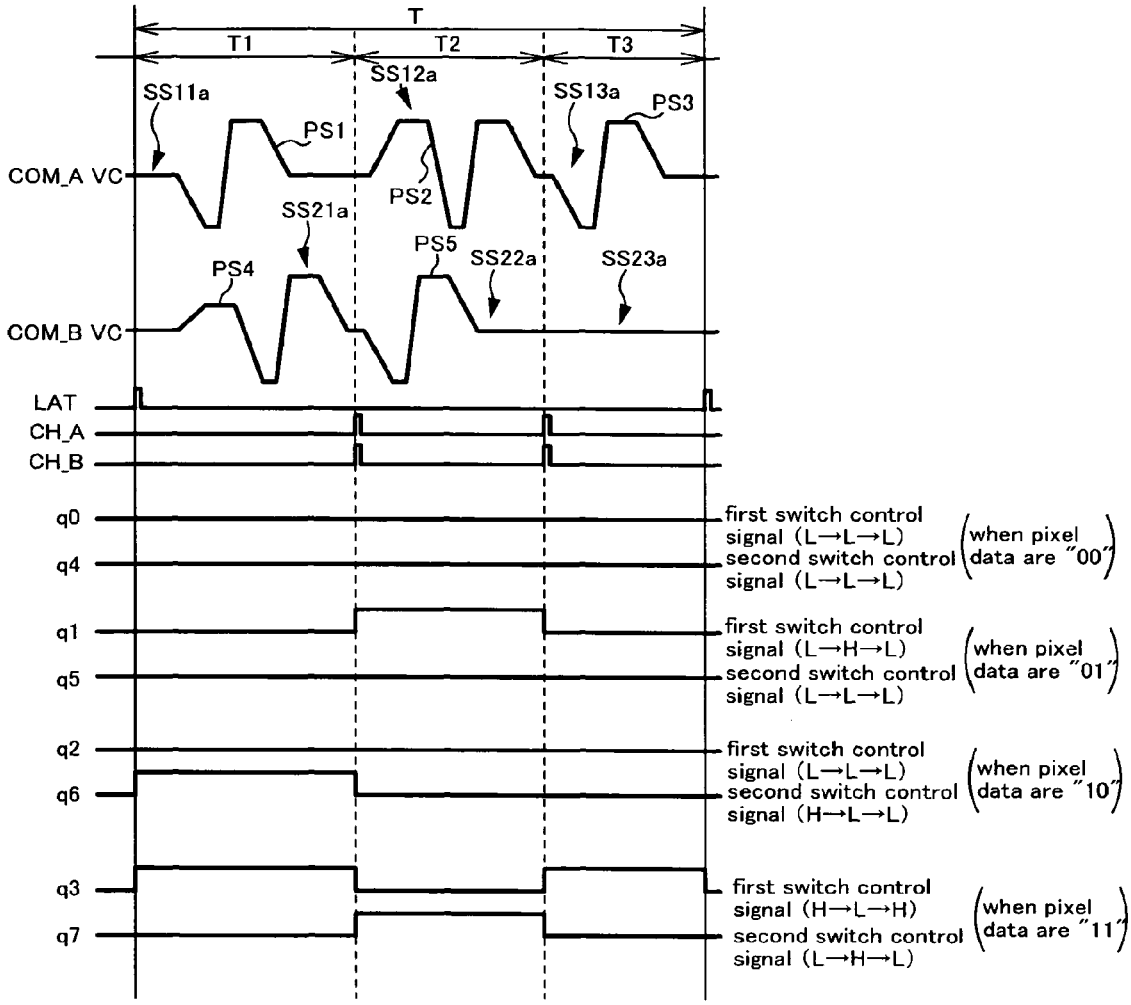
FIG. 9 is a diagram for describing the first drive signal COM_A, the second drive signal COM_B, the head control signal, and the waveform selection signals q0 to q7.

FIG. 9 shows the first drive signal COM_A and the second drive signal COM_B.

The first drive signal COM_A has a first waveform section SS11*a* that is generated during a period T1, a second waveform section SS12*a* that is generated in a period T2, and a third waveform section SS13*a* that is generated in a period T3, of a repeating cycle T. These waveform sections each have a drive pulse. In other words, the first waveform section SS11*a* has a drive pulse PS1. The second waveform section SS12*a* has a drive pulse PS2, and the third waveform section SS13*a* has a drive pulse PS3.

The drive pulse PS1 and the drive pulse PS3 of the first drive signal COM_A are applied to the piezo elements 417 when a large dot is to be formed, and have the same waveform. The drive pulse PS2 is applied to the piezo elements 417 when a small dot is to be formed. The waveform of the drive pulse PS2 is different from that of the drive pulse PS1 and the drive pulse PS3. That is, when the drive pulse PS2 is applied to the piezo elements 417, the sequence by which the piezo elements 417 are deformed is different from the sequence when the drive pulse PS1 is applied to the piezo elements 417. For this reason, the application of the drive pulse PS2 to the piezo elements 417 leads to the ejection of an ink droplet that is different in size from that when the drive pulse PS1 is applied. That is, by applying the drive pulse PS2 to the piezo elements 417, small ink droplets are ejected from the head 41.

The second drive signal COM_B has a first waveform section SS21*a* that is generated in the period T1, a second waveform section SS22*a* that is generated in the period T2, and a third waveform section SS23*a* that is generated in the period T3. In this embodiment, the first waveform section SS21*a* to the third waveform section SS23*a* of the second drive signal COM_B have been given the same duration as the corresponding first waveform section SS11*a* to the third waveform section SS13*a* of the first drive signal COM_A. As a result, the first change signal CH_A of the first drive signal COM_A and the second change signal CH_B of the second drive signal COM_B become H level at the same time. In the second drive signal COM_B, the first waveform section SS21*a* has a drive pulse PS4 and the second waveform section SS22*a* has a drive pulse PS5.

The drive pulse PS4 of the second drive signal COM_B is applied to the piezo elements 417 when a medium dot is to be formed. The waveform of the drive pulse PS4 is different from that of the drive pulse PS1 and the drive pulse PS2. Thus, when the drive pulse PS4 is applied to the piezo elements 417, the piezo elements 417 deform with a different sequence from the sequence corresponding to the drive pulse PS1 and the sequence corresponding to the drive pulse PS2. For this reason, by applying the drive pulse PS4 to the piezo elements 417, it is possible to eject an ink droplet that is different in size from those when the drive pulse PS1 or the drive pulse PS2 is applied. That is, by applying the drive pulse PS4 to the piezo elements 417, medium ink droplets are ejected from the head 41. Consequently, the drive pulse PS4 defines the period from the start to the end of the operation for ejecting ink when a medium dot is to be formed.

The drive pulse PS5 is applied to the piezo elements 417 when a large dot is to be formed. The drive pulse PS5 has the same waveform as the drive pulse PS1 and the drive pulse PS3. Consequently, the drive pulse PS1, the drive pulse PS3, and the drive pulse PS5, which are applied to the piezo elements 417 when a large dot is to be formed, share the same waveform. It should be noted that the third waveform section SS23*a*, which is generated in the period T3, of the second drive signal consists of a constant voltage signal that is constant at the intermediate voltage VC.

<Head Controller HC>

FIG. 8 is a block diagram that describes the configuration of the head controller HC. As shown in the drawing, the head controller HC is provided with first shift registers 81A, second shift registers 81B, first latch circuits 82A, second latch circuits 82B, decoders 83, a control logic 84, first switches 87A, and second switches 87B. Each of the sections other than the control logic 84, that is, the first shift register 81A, the second shift register 81B, the first latch circuit 82A, the second latch circuit 82B, the decoder 83, the first switch 87A, and the second switch 87B, is provided for each piezo element 417. It should be noted that because a piezo element 417 is provided for each nozzle, each of these sections is provided for each nozzle.

The head controller HC performs control in order to eject ink based on the print data (pixel data SI) from the printer-side controller 60. In this embodiment, the pixel data are made of two bits each, and are sent to the recording head 41 in synchronization with the clock signal CLK. The pixel data are sent in order from the higher order bit group to the lower order bit group. Each nozzle row in the head 41 of this embodiment has 180 nozzles, from a first nozzle #1 to a 180$^{th}$ nozzle #180. Thus, the pixel data are sent in the order of the higher order bit of nozzle #1, the higher order bit of nozzle #2, . . . , the higher order bit of nozzle #179, the higher order bit of nozzle #180, the lower order bit of nozzle #1, the lower order bit of nozzle #2, . . . , the lower order bit of nozzle #179, and the lower order bit of nozzle #180. As a result, the higher order bit group of each pixel data is set in the first shift registers 81A, and the lower order bit group is set in the second shift registers 81B.

The first shift registers 81A are electrically connected to the first latch circuits 82A, and the second shift registers 81B are electrically connected to the second latch circuits 82B. When the latch signal LAT from the printer-side controller 60 becomes the H level, that is, when the latch pulse is input to the first latch circuits 82A and the second latch circuits 82B, then the first latch circuits 82A latch the higher order bits of the first shift registers 81A and the second latch circuits 82B latch the lower order bits of the second shift registers 81B.

The first latch circuit 82A and second latch circuit 82B both are electrically connected to a decoder 83. Each pixel data that has been latched by the first latch circuit 82A and the second latch circuit 82B (the pair of the higher order bit and the lower order bit) is input to the decoder 83.

FIG. 9 shows the latch signal LAT, the first change signal CH_A, and the second change signal CH_B. This drawing also shows the waveform selection signals q0 to q7.

The control logic 84 receives the latch signal LAT, the first change signal CH_A, and the second change signal CH_B from the CPU 62. The control logic 84 generates the waveform selection signals q0 to q3 shown in FIG. 9 based on the latch signal LAT and the first change signal CH_A. The control logic 84 also generates the waveform selection signals q4 to q7 shown in FIG. 9 based on the latch signal LAT and the second change signal CH_B. The waveform selection signals q0 to q7 that are generated by the control logic 84 are input to the decoders 83.

The decoder 83 outputs a first switch control signal SW1, which controls whether the first switch 87A is on or off, and a second switch control signal SW2, which controls whether the second switch 87B is on or off, based on the pixel data that have been latched in the first latch circuit 82A and the second latch circuit 82B. If the pixel data are "00", then the decoder 83 outputs the waveform selection signal q0 as the first switch control signal SW1 and outputs the waveform selection signal q4 as the second switch control signal SW2. If the pixel data are "01", then the decoder 83 outputs the waveform selection signal q1 as the first switch control signal SW1 and outputs the waveform selection signal q5 as the second switch control signal SW2. If the pixel data are "10", then the decoder 83 outputs the waveform selection signal q2 as the first switch control signal SW1 and outputs the waveform selection signal q6 as the second switch control signal SW2. If the pixel data are "11", then the decoder 83 outputs the waveform selection signal q3 as the first switch control signal SW1 and outputs the waveform selection signal q7 as the second switch control signal SW2. The first switch 87A turns on if the first switch control signal SW1 is H level, and turns off if the first switch control signal SW1 is L level. Similarly, the second switch 87B turns on if the second switch control signal SW2 is H level, and turns off if the second switch control signal SW2 is L level.

The first drive signal COM_A is input in common to each first switch 87A, and the second drive signal COM_B is input in common to each second switch 87B. If the first switch 87A is on, then the first drive signal COM_A is input to the piezo element 417. If the first switch 87A is off, then the first drive signal COM_A is not input to the piezo element 417. The same applies for the second switch 87B. The output side of the first switch 87A and output side of the second switch 87B both are electrically connected to the piezo element 417. The waveform sections SS11*a* to SS13*a* that make up the first drive signal COM_A are selectively applied to the piezo element 417 by turning the first switch 87A on and off. Also, the waveform sections SS21*a* to SS23*a* that make up the second drive signal COM_B are selectively applied to the piezo element 417 by turning the second switch 87B on and off.

It should be noted that the waveform selection signals q0 to q7 have been set in advance so that the first switch control signal SW1 and the second switch control signal SW2 do not simultaneously become H level, regardless of the pixel data. Thus, the first drive signal COM_A and the second drive signal COM_B are prevented from being simultaneously applied to the piezo element 417.

<Signals Applied to the Piezo Elements 417>

Figure 10:
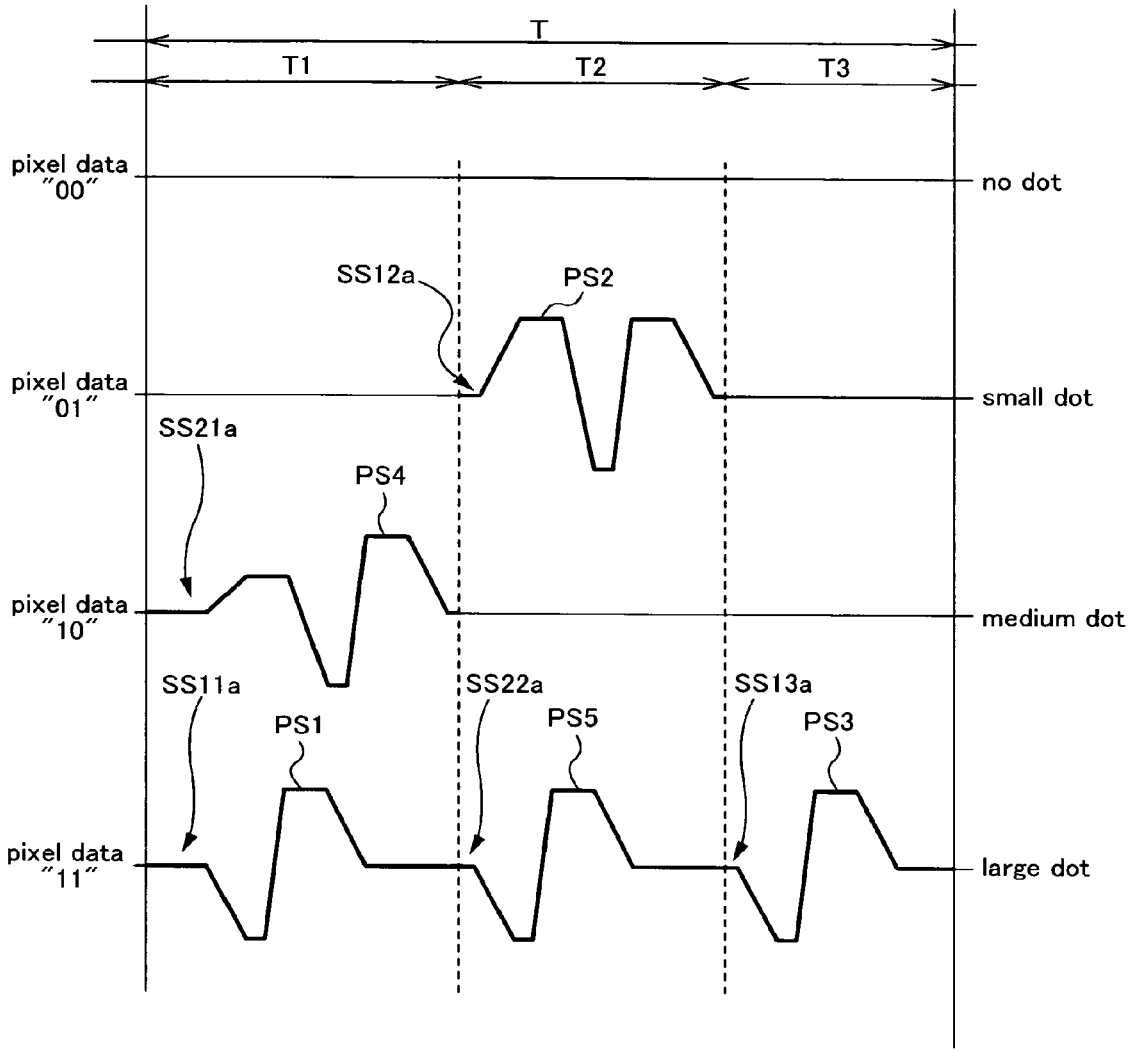
FIG. 10 is a diagram for describing the waveform section that is applied to the piezo element 417.

FIG. 10 is an explanatory diagram of the signals that are applied to the piezo elements 417. The head controller HC applies a signal that corresponds to the pixel data to the piezo elements 417 as described below.

In the case of the pixel data "00", the first switch control signal SW1 and the second switch control signal SW2 both are L level over the period from T1 to T3. The first switch 87A and the second switch 87B therefore remain off and thus none of the drive pulses are applied to the piezo element 417. The result is that ink is not ejected from the nozzle and a dot is not formed.

In the case of the pixel data "01", in the period T2 the first switch control signal SW1 is H level, and thus the drive pulse PS2 of the second waveform section SS12*a* of the first drive signal COM_A is applied to the piezo element 417. As a result, an amount of ink that corresponds to a small dot is ejected from the nozzle.

In the case of the pixel data "10", in the period T1 the second switch control signal SW1 is H level, and thus the drive pulse PS4 of the first waveform section SS21*a* of the second drive signal COM_B is applied to the piezo element 417. As a result, an amount of ink that corresponds to a medium dot is ejected from the nozzle.

In the case of the pixel data "11", in period T1 the first switch control signal SW1 is H level, in period T2 the second switch control signal SW2 is H level, and in period T3 the first switch control signal SW1 is H level. Thus, in period T1 the drive pulse PS1 of the first waveform section SS11*a* of the first drive signal COM_A is applied to the piezo element 417, in period T2 the drive pulse PS5 of the second waveform section SS22*a* of the second drive signal COM_B is applied to the piezo element 417, and in period T3 the drive pulse PS6 of the third waveform section SS13*a* of the first drive signal COM_A is applied to the piezo element 417. As a result, an amount of ink that corresponds to a large dot is ejected from the nozzle.

Printing Operation of the Printer 1

With the printer 1 having the above configuration, the printer-side controller 60 controls the control targets (the paper carry mechanism 20, the carriage movement mechanism 30, the head unit 40, and the drive signal generation circuit 70) in accordance with a computer program that is stored on the memory 63. Thus, this computer program has codes for effecting this control. The operation of printing a paper S is carried out by controlling the control targets.

Figure 11:
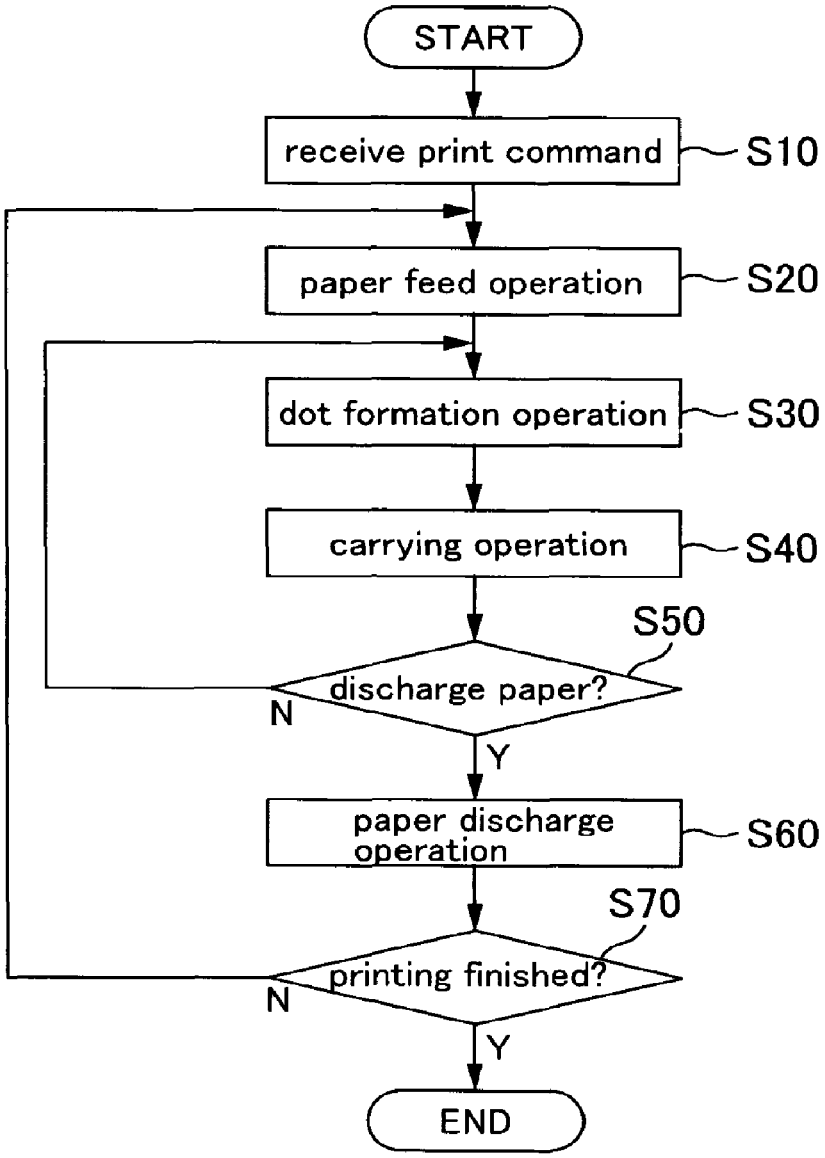
FIG. 11 is a flowchart for describing the printing operation.

Here, FIG. 11 is a flowchart that describes the printing operation. The example printing operation shown here includes a print command reception operation (S10), a paper feed operation (S20), a dot formation operation (S30), a carrying operation (S40), a paper discharge determination (S50), a paper discharge process (S60), and a determination of whether or not printing is finished (S70). These operations are briefly described below.

The print command reception operation (S10) is an operation of receiving a print command from the computer 110. In this operation, the printer-side controller 60 receives the print command through the interface section 61.

The paper feed operation (S20) is an operation of moving the paper S to be printed to position it at a print start position (the so-called indexed position). In this operation, the printer-side controller 60 for example drives the carry motor 22 to rotate the paper feed roller 21 and the carry roller 23.

The dot formation operation (S30) is an operation for forming dots on the paper S. In this operation, the printer-side controller 60 drives the carriage motor 31 and outputs control signals to the drive signal generation circuit and the head 41. Thus, ink is ejected from the nozzles Nz while the head 41 is moving, forming dots on the paper S.

The carrying operation (S40) is an operation of moving the paper S in the carrying direction. In this operation, the printer-side controller 60 drives the carry motor 22 to rotate the carry roller 23. Due to the carrying operation, dots can be formed at positions that are different from those of the dots formed in the previous dot formation operation.

The paper discharge determination (S50) is an operation of determining whether or not it is necessary to discharge the paper S that is being printed. This determination is made by the printer-side controller 60 based on whether or not there still are print data, for example.

The paper discharge process (S60) is a process for discharging the paper S, and is performed if the result of the preceding paper discharge determination is "discharge paper." In this case, the printer-side controller 60 causes rotation of the paper discharge roller 25 so that the paper S, for which printing has finished, is discharged to the outside.

The print over determination (S70) is a determination regarding whether or not to continue printing. This determination also is performed by the printer-side controller 60.

Drive Signal Switching in this Embodiment

<Regarding the Need to Switch the Drive Signals>

The first current amplification circuit 72A consumes power when it generates drive signals COM. When generating drive signals COM, the first current amplification circuit 72A consumes power due to collector loss at the NPN-type transistor Q1 and collector loss at the PNP-type transistor Q2. The same applies for the second current amplification circuit 72B, and thus the following description is in regard to only the first current amplification circuit 72A.

Figures 12, 13:
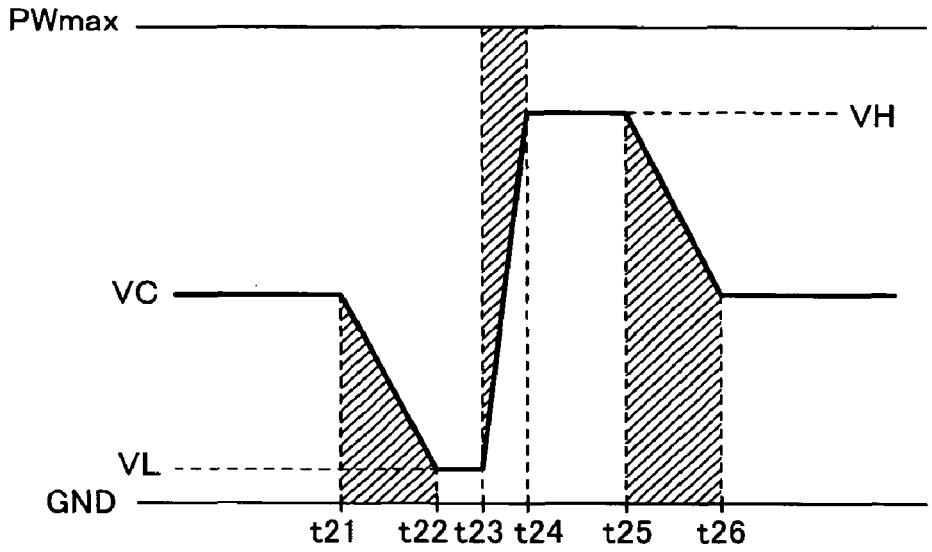
FIG. 12 is an explanatory diagram of the relationship between the drive pulse PS1 and power consumption.
FIG. 13 is an explanatory diagram of the relationship between the first drive signal COM_A and the second drive signal COM_B and power consumption.

FIG. 12 is an explanatory diagram of the relationship between the drive pulse PS1 and the power consumption. Here, the description is made in regard to the power consumption by the transistor pair 721A when the drive pulse PS1 has been applied to the piezo element 417.

The NPN-type transistor Q1 of the first current amplification circuit 72A is in the on state when the voltage of the drive signal COM is to be increased, that is, when the piezo element 417 is to be charged. Conversely, the PNP-type transistor Q2 is in the on state when the voltage of the drive signal COM is to be lowered, that is, when the piezo element 417 is to be discharged.

As a result, in the period from the time t21 to the time t22 in the drawing, the voltage of the drive signal COM drops and thus the PNP-type transistor Q2 consumes power. In the period from the time t23 to the time t24 in the drawing, the voltage of the drive signal COM rises and thus the NPN-type transistor Q1 consumes power. In the period from the time t25 to the time t26 in the drawing, the voltage of the drive signal COM rises and thus the PNP-type transistor Q2 consumes power.

The power consumed by the NPN-type transistor Q1 is the product of the difference between the power source potential PWmax and the potential of the drive signal COM, and the current I1 that flows into the NPN-type transistor Q1 (see FIG. 7A). On the other hand, the power consumed by the PNP-type transistor Q2 is the product of the difference between the potential of the drive signal COM and the ground potential GND, and the current I2 that flows into the PNP-type transistor Q2 (see FIG. 7A). Consequently, the power consumed by the transistor pair 721A when the drive pulse PS1 is applied to the piezo element 417 is calculated based on the potential difference in shaded periods in the drawing and the currents I1 and I2 that flow during these periods. In this embodiment, when the drive pulse PS1 is applied to all 180 piezo elements 417 corresponding to a single nozzle row, the transistor pair 721A consumes 1.5 W of power.

FIG. 13 is an explanatory diagram of the relationship between the first drive signal COM_A and the second drive signal COM_B and the power consumption. Since the drive pulses that are applied to the piezo element 417 are different depending on the size of the dots (see FIG. 10), the power consumption differs depending on the size of the dots. Further, the drive pulse that is applied is included in one of the first drive signal COM_A or the second drive signal COM_B, and thus the transistor pair 721A, which generates the first drive signal COM_A, and the transistor pair 721B, which generates the second drive signal COM_B, have different power consumptions.

For example, if a small dot is to be formed, then only the drive pulse PS2 of the first drive signal COM_A is applied to the piezo elements 417. Thus, if a small dot is to be formed, then the transistor pair 721A, which generates the first drive signal COM_A, alone consumes 3.0 W of power, and the transistor pair 721B, which generates the second drive signal COM_B, does not consume power.

If a medium dot is to be formed, then only the drive pulse PS4 of the second drive signal COM_B is applied to the piezo elements 417, and thus the transistor pair 721A, which generates the first drive signal COM_A, does not consume power, and the transistor pair 721B, which generates the second drive signal COM_B, consumes 2.0 W of power. It should be noted that the reason why a different amount of power consumed when forming a small dot and when forming a medium dot is because the waveform of the drive pulse PS2 for forming a small dot and the waveform of the drive pulse PS4 for forming a medium dot are different.

If a large dot is to be formed, then the drive pulse PS1 of the first drive signal COM_A, the drive pulse PS5 of the second drive signal COM_B, and the drive pulse PS3 of the first drive signal COM_A are applied to the piezo elements 417. Thus, if a large dot is to be formed, then the transistor pair 721A, which generates the first drive signal COM_A, consumes 3.0 W of, and the transistor pair 721B, which generates the second drive signal COM_B, consumes 1.5 W of power.

In this way, regardless of the dot to be formed, the power consumed by the transistor pair 721A, which generates the first drive signal COM_A, and power consumed by the transistor pair 721B, which generates the second drive signal COM_B, are different.

A difference in power consumption also means that there will be a difference in the amount of heat that is generated. Thus, when the first drive signal generation section 70A continues to generate the first drive signal COM_A and the second drive signal generation section 70B continues to generate the second drive signal COM_B, one of the transistor pairs will end up generating more heat than the other. For example, if large dots continue to be formed, then the transistor pair 721A of the first drive signal generation section 70A will evolve more heat than the transistor pair 721B of the second drive signal generation section 70B.

When the generation of heat is concentrated on one transistor pair in this way, then it is necessary to design the heat sink 722 so that it is suited for the transistor pair that generates more heat. This results in a heat sink 722 that is too large for the transistor pair that generates the smaller amount of heat, and increases the size of the apparatus.

Accordingly, in this embodiment, the drive signals COM that are generated by the first drive signal generation section 70A and the second drive signal generation section 70B are alternately switched. By doing this, the transistor pair 721A of the first drive signal generation section 70A and the transistor pair 721B of the second drive signal generation section 70B generate heat equally.

<Process when the Drive Signals are Switched: 1>

A case in which the first drive signal generation section 70A generates the first drive signal COM_A and the second drive signal generation section 70B generates the second drive signal COM_B has been described already. Accordingly, the following description is in regard to a case where the drive signals are switched so that the first drive signal generation section 70A generates the second drive signal COM_B and the second drive signal generation section 70B generates the first drive signal COM_A.

The CPU 62 sequentially outputs DAC values for generating the second drive signal COM_B to the D/A converter 711A of the first waveform generation circuit 71A of the first drive signal generation section 70A. Due to this, the second drive signal COM_B is output from the first drive signal generation section 70A. Similarly, the CPU 62 sequentially outputs DAC values for generating the first drive signal COM_A to the D/A converter 711B of the second waveform generation circuit 71B of the second drive signal generation section 70B. Due to this, the first drive signal COM_A is output from the second drive signal generation section 70B.

As a result, the first drive signal COM_A and the second drive signal COM_B in FIG. 8 are switched. That is, the first drive signal COM_A is input to the second switch 87B and the second drive signal COM_B is input to the first switch 87A. It therefore is also necessary to switch the switch control signal SW1 and the switch control signal SW2. (If the switch signals are not switched, then, for example, in the case of pixel data 01 (small dot), the drive pulse PS5 of the second drive signal COM_B will be applied instead of the drive pulse PS2 of the first drive signal COM_A, and an amount of ink that does not correspond to a correct small dot will be ejected.)

Accordingly, the waveform selection signals q0 to q7 that are output by the control logic 84 are changed in conjunction with this switch in drive signals COM. Specifically, the control logic 84 outputs the waveform selection signal q4 to the signal line to which it had output the waveform selection signal q0, outputs the waveform selection signal q5 to the signal line to which it had output the waveform selection signal q1, outputs the waveform selection signal q6 to the signal line to which it had output the waveform selection signal q2, and outputs the waveform selection signal q7 to the signal line to which it had output the waveform selection signal q3, when the first drive signal generation section 70A had generated the first drive signal COM_A. In this way, the waveform selection signals q0 to q3 and the waveform selection signals q4 to q7 that are output by the control logic 84 are switched in conjunction with the switch in the drive signals COM.

The above process allows the drive signals COM that are generated by the first drive signal generation section 70A and the second drive signal generation section 70B to be switched. Further, through the above process, it is possible to form dots that correspond to the pixel data even when the drive signals COM have been switched.

<Process when the Drive Signals are Switched: 2>

Figure 14:
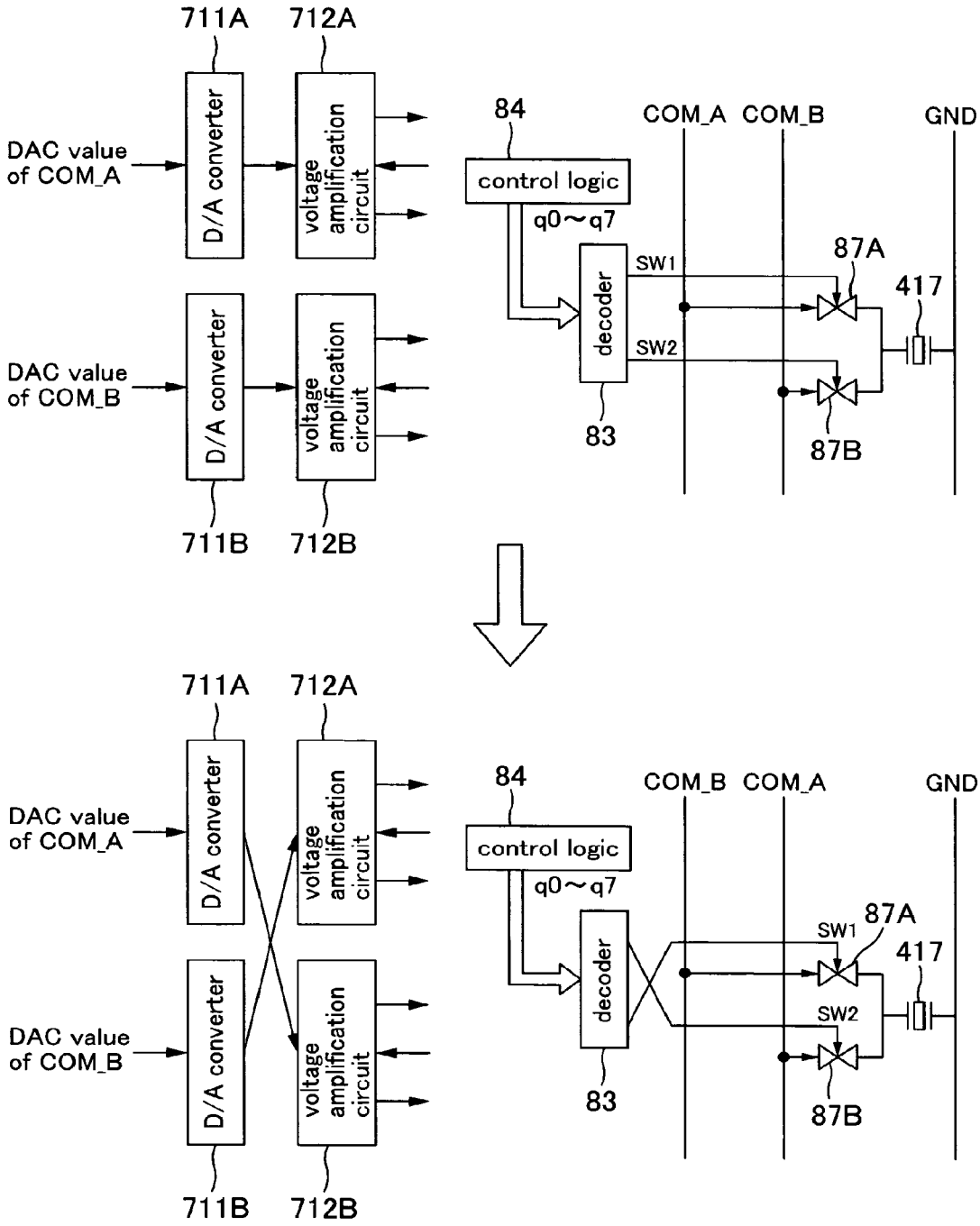
FIG. 14 is a diagram that shows another example of the process when switching the drive signals.

FIG. 14 is a diagram that shows another example of the process when switching the drive signals. The two upper diagrams show a state in which the first drive signal generation section 70A generates the first drive signal COM_A and the second drive signal generation section 70B generates the second drive signal COM_B. The two lower diagrams show a state in which the drive signals are switched so that the first drive signal generation section 70A generates the second drive signal COM_B and the second drive signal generation section 70B generates the first drive signal COM_A.

In this example, the output targets of the two D/A converters are switched. By doing this, the drive signals COM that are generated by the first drive signal generation section 70A and the second drive signal generation section 70B can be switched. Also, in this example, the output targets of the first switch control signal SW1 and the second switch control signal SW2, which are output from the decoder 83, are switched. As a result, it is possible to form dots that correspond to the pixel data even when the drive signals COM have been switched.

It should be noted that in this example, the DAC values input by the CPU 62 to the D/A converter 711A and the D/A converter 711B do not change before and after switching. (In the previous example, the DAC values input by the CPU 62 to the D/A converter 711A and the D/A converter 711B were switched.) Further, in this example, the waveform selection signals q0 to q7 that are input by the control logic 84 to the decoder 83 do not change before and after switching. (In the previous example, the waveform selection signals q0 to q3 and the waveform selection signals q4 to q7 were switched.) Thus, this example allows the processing of the CPU 62 to be simplified and also allows the configuration of the control logic 84 to be simplified.

<Specific Example of the Switch Timing: 1>

Next, the timing at which the drive signals are switched is discussed.

For example, the printer can be configured to switch the first drive signal COM_A and the second drive signal COM_B for each sheet of paper that it prints. This makes it possible for the drive signals to be switched at a periodic timing.

However, there may be an instance where a plurality of sheets of paper are printed in a continuous manner, printing a text image primarily made of large dots on odd-numbered pages and printing an image primarily made of medium dots on even-numbered pages. In such a case, the heat that is generated when forming large dots is concentrated on the transistor pair of the drive signal generation section that generates the first drive signal COM_A, and when forming medium dots, the heat that is generated is concentrated on the transistor pair of the drive signal generation section that generates the second drive signal COM_B (see FIG. 13), and thus when the drive signals are switched each time a sheet of paper is printed, there is a possibility that the heat that is generated will be disproportionately concentrated on the transistor pair of one of the drive signal generation sections.

To avoid this, the drive signals are preferably switched while printing a single sheet of paper. Accordingly, it is, for example, possible for the printer to switch the drive signals every occasion that the dot formation operation (S30, see FIG. 11) has been performed a number of times. By doing this, the transistor pair 721A of the first drive signal generation section 70A and the transistor pair 721B of the second drive signal generation section 70B will generate an equivalent amount of heat even if different types of images are printed on each page in a continuous manner.

However, there may also be cases where in a single sheet of paper, a text image that is primarily made of large dots is printed on the upper part of the paper and an image that is primarily made of medium dots is formed on the lower part of the paper. In such a case, when the timing at which the drive signals are switched per every several dot formation operations (S30) lies between the printing of the upper part of the paper and the printing of the lower part of the paper, there is a possibility that the generation of heat will be concentrated on the transistor pair of one of the drive signal generation sections.

Accordingly, it is preferable that the drive signals are switched each time that the dot formation operation (S30) is performed. Even in cases where a plurality of different types of images are printed on a single sheet of paper, each of those images is often printed through a plurality of dot formation operations. Therefore, if the drive signals are switched per each dot formation operation (S30), then the transistor pair 721A of the first drive signal generation section 70A and the transistor pair 721B of the second drive signal generation section 70B will produce an equivalent amount of heat.

<Specific Example of the Switch Timing: 2>

It is also possible to detect the temperature of the first drive signal generation section 70A and/or the second drive signal generation section 70B and to switch the drive signals based on the results of that detection instead of switching the drive signals at a periodic timing. However, in this case it is necessary to provide a temperature sensor.

Also, because the number of dots that are formed can be counted based on the print data, it is also possible to switch the drive signals at the point that the count value has exceeded a threshold value. In this case, since the amount of heat that is generated differs depending on the size of the dot, it is preferable that this counting is performed taking into account the size of the dots. It is also preferable that the counting is performed separately for the first drive signal generation section 70A and the second drive signal generation section 70B. For example, if small dots are formed, then only the count values of the drive signal generation section that generates the first drive signal COM_A are incremented. In this way, it is possible to switch the drive signals according to the estimated temperature of the first drive signal generation section 70A and the second drive signal generation section 70B.

Discrepancies Among the Properties of the Two Drive Signal Generation Sections Even though the first drive signal generation section 70A and the second drive signal generation section 70B have the same configuration, manufacturing discrepancies, for example, may cause variation in the properties of the first drive signal generation section 70A and the second drive signal generation section 70B.

FIG. 15A shows the drive pulse PS2 that is generated by the first drive signal generation section 70A. FIG. 15B shows the relationship between the DAC value that is input to the first drive signal generation section 70A and the output voltage. FIG. 15C shows the drive pulse PS2 that is generated by the second drive signal generation section 70B. FIG. 15D shows the relationship between the DAC value that is input to the second drive signal generation section 70B and the output voltage.

In the following description, the DAC value that is output from the CPU 62 in order to set the voltage to the maximum voltage VH is referred to as "DAC_VH" (that is, the DAC value that is output from the CPU 62 at the time of the maximum voltage VH is "DAC_VH"). The DAC value that is output from the CPU 62 in order to set the voltage to the minimum voltage VL is referred to as "DAC_VL." The DAC value that is output from the CPU 62 in order to set the voltage to the intermediate voltage VC is referred to as "DAC_VC."

In this example, the second drive signal generation section 70B has the property of outputting a higher voltage than the first drive signal generation section 70A. That is to say, the first drive signal generation section 70A outputs a voltage of 2.00V when it receives the DAC value "00Fh" and outputs a voltage of 27.00V when it receives the DAC value "280h". The second drive signal generation section 70B outputs a voltage of 2.04V when it receives the DAC value "00Fh" and outputs a voltage of 27.36V when it receives the DAC value "280h".

Here, the voltage when the DAC value "00Fh" is input corresponds to the minimum voltage VL of the drive pulse PS2, and the voltage when the DAC value "280h" is input corresponds to the maximum voltage VH of the drive pulse PS2. Thus, the drive voltage Vh_PS21 of the drive pulse PS2 when the first drive signal generation section 70A generates the first drive signal COM_A is 25.00V. On the other hand, the drive voltage Vh_PS22 of the drive pulse PS2 when the second drive signal generation section 70B generates the first drive signal COM_A is 25.36V.

Different drive voltages result in different amounts of expansion and contraction of the piezo element, and thus the change in pressure with respect to the ink within the pressure chamber is different. As a result, when the drive voltage is different, the amount of ink that is ejected also is different. That is to say, the amount of ink that is ejected for the small dot that is formed when the first drive signal generation section 70A generates the first drive signal COM_A and the small dot that is formed when the second drive signal generation section 70B generates the first drive signal COM_A is different, and this leads to a different dot diameter. As a result, the image quality of the print image that is made of such dots will appear coarse.

Accordingly, in the first embodiment described below, the voltages that are output by the first drive signal generation section 70A and the second drive signal generation section 70B are adjusted. In the second embodiment, the number of dots that are formed due to the drive signals that are generated by the first drive signal generation section 70A and the second drive signal is adjusted. In both embodiments, printing the print image using the adjusted drive signals allows the quality of the print image to be increased.

When the drive signals are switched per each dot formation operation as in the above embodiment, the small dots that are formed in one dot formation operation and the small dots that are formed in the next dot formation operation have different dot diameters. Normally, in each dot formation operation, ink droplets are intermittently ejected from the nozzles and form rows of dots (called dot rows or raster lines), and thus when the drive signals are switched per each dot formation operation, raster lines of different thicknesses are formed. Print images that are made of such raster lines have light and dark bands due to the difference in the thickness of the raster lines, and thus the image quality becomes coarse.

Accordingly, in the third embodiment described below, the drive signals that are generated by the first drive signal generation section 70A and the second drive signal generation section 70B are switched during a single dot formation operation, in which a raster line is formed. Thus, each raster line that is formed includes different size dots mixed in among one another and has a uniform thickness, and thus even if there are discrepancies among the properties of the two drive signal generation sections, the image quality can be kept from deteriorating.

First Embodiment

Adjustment of the Voltage

<Overview of how Adjustment Values are Set>

Figure 16:
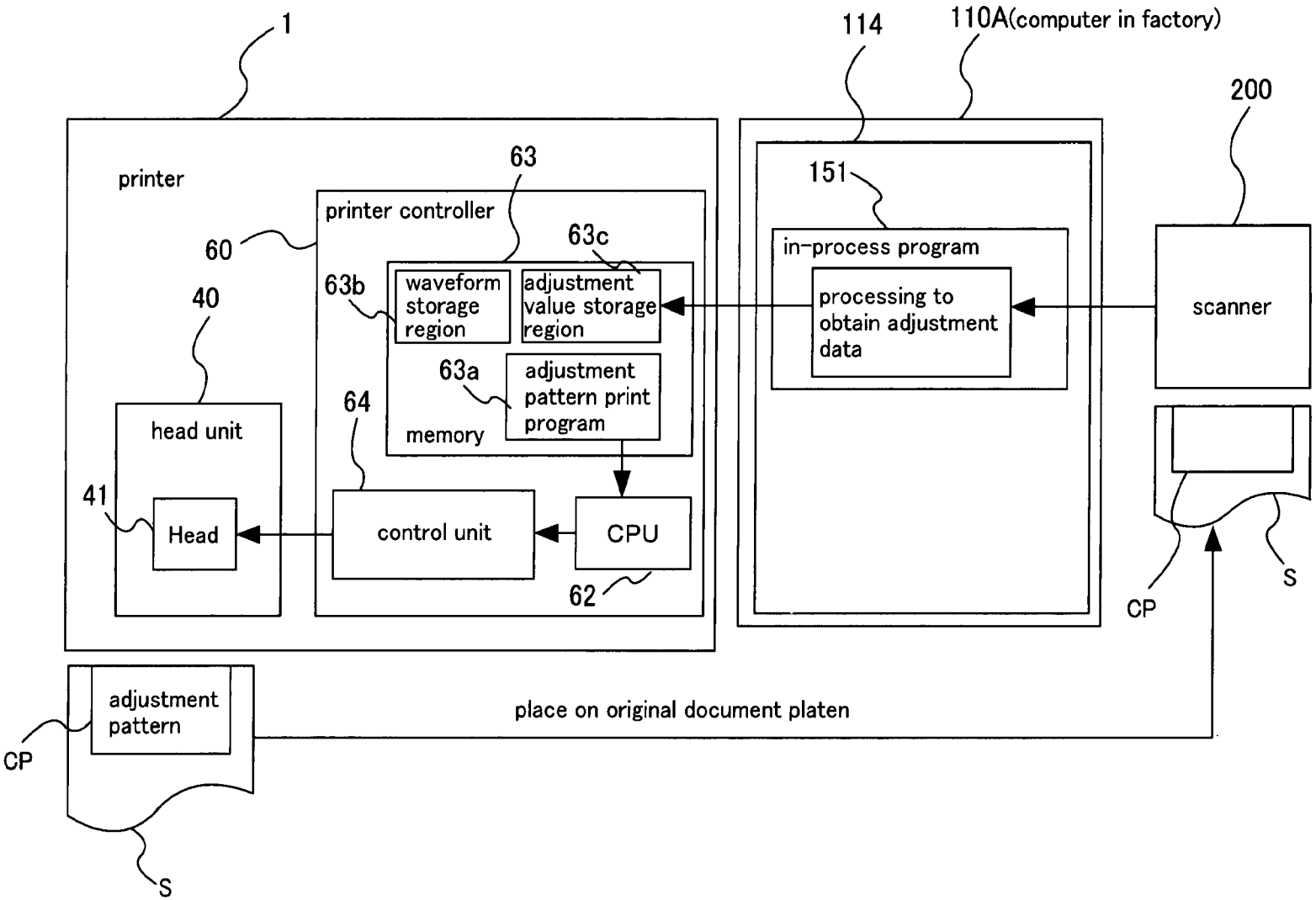
FIG. 16 is a block diagram for describing the device that is used to set the adjustment values.

FIG. 16 is a block diagram for describing the device that is used to set the adjustment value. It should be noted that elements that have been explained already are assigned the same reference numerals as before and thus will not be described. Of these, the computer 110A is a computer that is installed on an inspection line. In the process of inspecting the manufactured printer 1, each printer prints an adjustment pattern and the adjustment pattern that has been printed is read by the scanner device 200, then the computer 110A determines an adjustment value that is specific for that printer and sets that adjustment value in the adjustment value storage region 63*c* of the memory 63 of the printer 1.

In this embodiment, a small dot adjustment value, a medium dot adjustment value, and a large dot adjustment value are set for both the first drive signal generation section 70A and the second drive signal generation section 70B. Here, first the procedure up to setting the small dot adjustment value is described.

<Printing the Adjustment Pattern>

An adjustment pattern print program for causing the printer 1 to print adjustment patterns is stored on the program storage region 63*a* of the memory 63 of the printer 1. The CPU 64 controls the units in the printer 1 in accordance with the adjustment pattern print program to print the adjustment patterns on the paper S.

Figure 17:
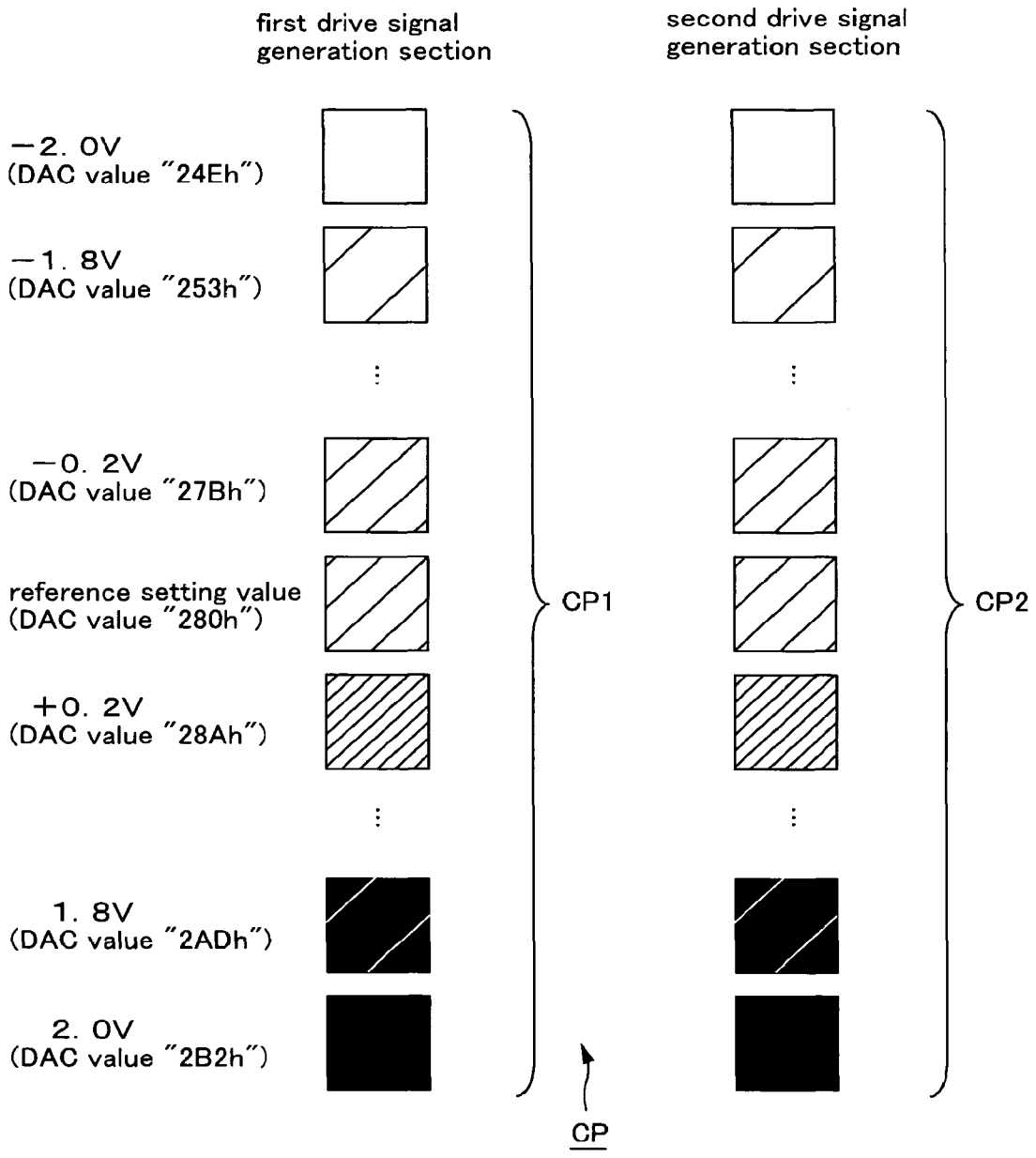
FIG. 17 is an explanatory diagram of the adjustment patterns that are printed on the paper S.

FIG. 17 is an explanatory diagram of the adjustment patterns that are printed on the paper S. A first adjustment pattern group CP1 and a second adjustment pattern group CP2 are printed on the paper S. The first adjustment pattern group CP1 and the second adjustment pattern group CP2 each have a plurality of adjustment patterns lined up in the carrying direction. Each adjustment pattern is made of small dots. That is, each adjustment pattern is formed by applying the drive pulse PS2 of the first drive signal COM_A to the piezo elements 417.

The manner in which the adjustment patterns are formed is described in specific detail below.

First, at the time of the first dot formation operation, the CPU 62 sequentially outputs DAC values for generating the first drive signal COM_A to the first drive signal generation section 70A such that the DAC_VH becomes "24Eh" (so that a DAC value "24Eh" is input when the drive pulse PS2 is at maximum voltage VH). In the first dot formation operation, the printer 1 applies the drive pulse PS2 of the first drive signal COM_A that has been output from the first drive signal generation section 70A to the piezo elements 417, forming the adjustment patterns of the first adjustment pattern group CP1.

Next, at the time of the second dot formation operation, the CPU 62 sequentially outputs DAC values for generating the first drive signal COM_A to the second drive signal generation section 70B so that the DAC_VH becomes "24Eh" (it outputs the DAC values that were output to the first drive signal generation section 70A in the first dot formation operation). Then, in the second dot formation operation, the printer 1 applies the drive pulse PS2 of the first drive signal COM_A that has been output from the second drive signal generation section 70A to the piezo elements 417, forming the adjustment patterns of the second adjustment pattern group CP2.

After the two adjustment patterns are formed at the position denoted by "−2.0V" in the drawing, the printer 1 carries the paper and then performs a third dot formation operation. In the third dot formation operation, the CPU 62 changes the DAC values that are output. In the third dot formation operation, the CPU 62 sequentially outputs DAC values for generating the first drive signal COM_A to the drive signal generation section 70A so that the DAC_VH becomes "253h" (such that a DAC value "253h" in input when the drive pulse PS2 is at maximum voltage), forming the adjustment patterns of the first adjustment pattern group CP1. In the fourth dot formation operation, the CPU 62 sequentially outputs to the second drive signal generation section 70B the DAC values that were output to the first drive signal generation section 70B in the third dot formation operation, forming the adjustment patterns of the second adjustment pattern group CP2. Through the third and fourth dot formation operations, two adjustment patterns are formed at the position denoted as "−1.8V" in the drawing.

Thereafter, the drive signal generation section that generates the first drive signal COM_A is switched per each dot formation operation. The adjustment patterns of the first adjustment pattern group CP1 are formed in odd-numbered dot formation operations and the adjustment patterns of the second adjustment pattern group CP2 are formed in even-numbered dot formation operations. The paper is carried after the even-numbered dot formation operations, and in the next dot formation operation the DAC_VH is raised by "005h" (the DAC value that is output from the CPU 62 when the drive pulse PS2 is at maximum voltage is increased by "005h"). When the DAC_VH is increased by "005h", the maximum voltage VH becomes approximately 0.2V higher, thereby increasing the drive voltage Vh of the drive pulse PS2 by approximately 0.2V.

By continuing the above procedure, the first adjustment pattern group CP1 and the second adjustment pattern group CP2 shown in the drawing are printed on the paper S.

The result is that the adjustment patterns that belong to the first adjustment pattern group CP1 are formed by the drive pulse PS2 of the first drive signal COM_A that is generated by the first drive signal generation section 70A, and the adjustment patterns that belong to the second adjustment pattern group CP2 are formed by the drive pulse PS2 of the first drive signal COM_A that is generated by the second drive signal generation section 70B. The drive voltage Vh of the drive pulse PS2 that is applied to the piezo elements 417 when forming the adjustment pattern differs for each of the plurality of adjustment patterns lined up in the carrying direction. Different drive voltages Vh of the drive pulse PS2 result in different amounts of ink being ejected and thus the diameters of the small dots that are formed on the paper S become different. For this reason, the darkness of each of the plurality of adjustment patterns lined up in the carrying direction is different.

<Setting the Adjustment Values>

After the adjustment patterns have been printed, the inspector of the inspection procedure sets the paper S on the scanner device 200. The scanner device 200 is communicably connected to the computer 110A. The scanner device 200 is for reading, at a predetermined resolution, the darkness of the image that has been printed on the original document. The scanner device 200 then reads the darkness of the adjustment patterns that have been printed on the paper S. The scanner device 200 outputs the darkness data of the adjustment patterns of the first adjustment pattern group CP1 and the second adjustment pattern group CP2 to the computer 110A.

An in-process program 151 is stored on the memory 114 of the computer 110A. The in-process program 151 causes the computer 110A to obtain the darkness data of the adjustment patterns of the first adjustment pattern group CP1 and the second adjustment pattern group CP2 from the scanner device 200. Then, the in-process program 151 compares the reference darkness for the small dot adjustment patterns, which has been determined in advance, with the darkness of the adjustment patterns. The in-process program 151 then chooses the adjustment pattern whose darkness is closest to the reference darkness from those of the first adjustment pattern group CP1 and the second adjustment pattern group CP2.

In the following description, the adjustment pattern at the position denoted "reference setting value" is extracted from the first adjustment pattern group CP1, and the adjustment pattern at the position denoted "−0.2V" is extracted from the second adjustment pattern group CP2. That is, here, the first drive signal generation section 70A is generating the first drive signal COM_A normally but the second drive signal generation section 70B is generating an abnormal first drive signal COM_A due to the effects of manufacturing discrepancies, for example.

The in-process program stores the information regarding the DAC_VH when the adjustment pattern that has been extracted from the first adjustment pattern group CP1 was formed, in the adjustment value storage region 63*c* of the memory 63 of the printer 1 as the small dot adjustment value of the first drive signal generation section 70A. Here, "reference setting value" is stored in the adjustment value storage region 63*c* as the small dot adjustment value of the first drive signal generation section 70A. Similarly, the in-process program stores "−0.2V" (or "−005h") in the adjustment value storage region 63*c* as the small dot adjustment value of the second drive signal generation section 70B, based on the adjustment pattern that has been extracted from the second adjustment pattern group CP2.

<Adjusting the Drive Pulse PS2 for Small Dot Formation>

Figure 18A:
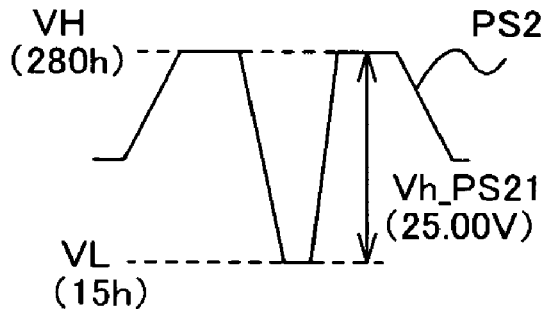
FIG. 18A is an explanatory diagram of the drive pulse PS2 that is generated by the first drive signal generation section 70A.

FIG. 18A is an explanatory diagram of the drive pulse PS2 that is generated by the first drive signal generation section 70A. Here, the first drive signal generation section 70A generates a normal drive pulse PS2, and thus the drive pulse PS2 is not adjusted.

Figure 18B:
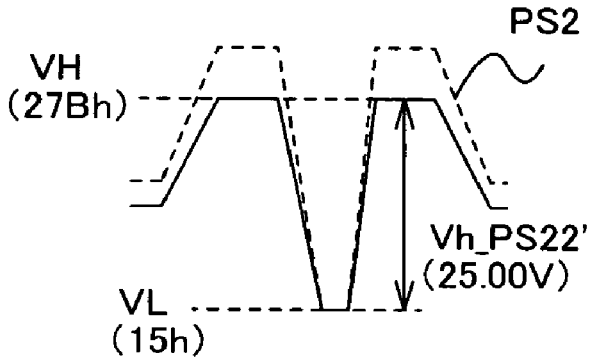
FIG. 18B is an explanatory diagram of the drive pulse PS2 that is generated by the second drive signal generation section 70B.

FIG. 18B is an explanatory diagram of the drive pulse PS2 that is generated by the second drive signal generation section 70B. The drive pulse shown by the dashed line in the drawing is the drive pulse before adjustment. This drive pulse is generated by inputting the same DAC value to the second drive signal generation section 70B as when the first drive signal generation section 70A generates the drive pulse of FIG. 18A. If printing is performed with the second drive signal generation section 70B outputting the drive pulse of the dashed line, then the drive voltage would be higher (25.20V) than the normal drive voltage Vh (25.00V), and thus a small dot whose diameter is larger than the normal dot diameter will be formed.

The waveform shown by the solid line in FIG. 18B is the adjusted waveform. In this embodiment, the DAC values that are sequentially output from the CPU 62 are adjusted so that DAC_VH (the DAC value that is output from the CPU 62 when the drive pulse PS2 is the maximum voltage VH) is "27Bh". The DAC values are adjusted based on the small dot adjustment value of the second drive signal generation section 70B. By doing this, the drive voltage Vh' of the adjusted drive pulse is adjusted to 25.00 V.

It should be noted that the operation for adjusting medium dots is substantially the same as that for adjusting small dots, and thus will not be explained.

<Adjusting the Drive Pulse for Large Dot Formation>

In the following description as well, it is assumed that the first drive signal generation section 70A generates a drive signal with a normal voltage but the second drive signal generation section 70B generates a drive signal with an abnormal voltage.

Figure 19A:
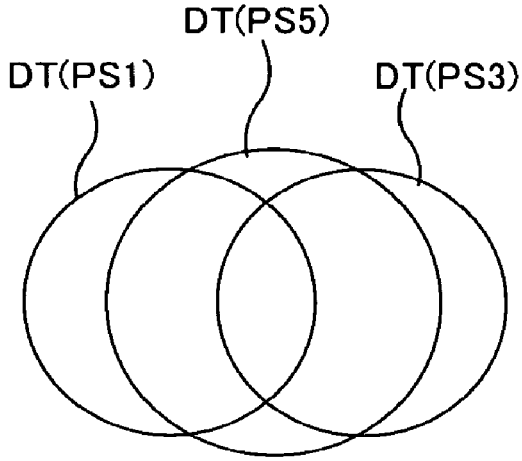
FIG. 19A is an explanatory diagram of the large dot that is formed when the first drive signal generation section 70A generates the first drive signal COM_A and the second drive signal generation section 70B generates the second drive signal COM_B.

FIG. 19A is an explanatory diagram of the large dot that is formed when the first drive signal generation section 70A generates the first drive signal COM_A and the second drive signal generation section 70B generates the second drive signal COM_B. The large dot shown in the drawing is made of the region DT(PS1) that is colored by the ink that is ejected due to the drive pulse PS1 of the first drive signal COM_A, the region DT(PS5) that is colored by the ink that is ejected due to the drive pulse PS5 of the second drive signal COM_B, and the region DT(PS3) that is colored by the ink that is ejected due to the drive pulse PS3 of the first drive signal COM_A. Here, the region DT(PS1) and the region DT(PS3) are formed by ordinary drive pulses, and thus are normal size. The region DT(PS5), however, is formed by an abnormal drive pulse, and thus is larger than the region DT(PS1) and the region DT(PS3).

Figure 19B:
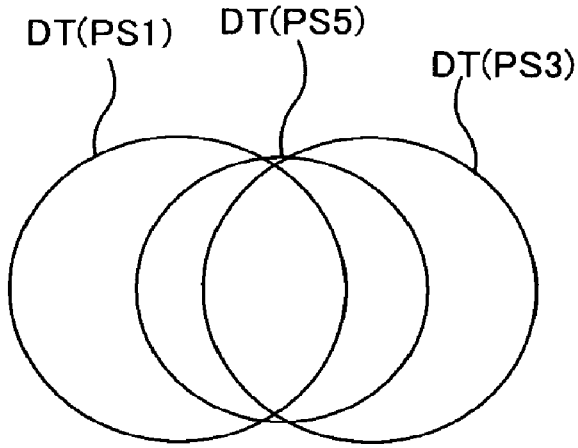
FIG. 19B is an explanatory diagram of the large dot that is formed when the drive signals have been switched so that the first drive signal generation section 70A generates the second drive signal COM_B and the second drive signal generation section 70B generates the first drive signal COM_A.

On the other hand, FIG. 19B is an explanatory diagram of a large dot that is formed when the drive signals have been switched so that the first drive signal generation section 70A generates the second drive signal COM_B and the second drive signal generation section 70B generates the first drive signal COM_A. In this case, the region DT (PS1) and the region DT (PS3) are formed by the drive pulse that is generated by the second drive signal generation section 70B. That is, the region DT(PS1) and the region DT(PS3) are formed by abnormal drive pulses and thus are larger than the region DT(PS5).

It is also possible to form the adjustment patterns mentioned above by large dots such as those shown in FIG. 19A and FIG. 19B. However, since large dots are formed by the drive pulses of the first drive signal COM_A and the drive pulses of the second drive signal COM_B, it is difficult to specify separate adjustment values for the first drive signal generation section 70A and the second drive signal generation section 70B merely by detecting the darkness of the adjustment patterns that are made of such large dots.

Accordingly, in this embodiment, one of the drive signal generation sections generates an adjustment drive signal COM_C that is different from the first drive signal COM_A and the second drive signal COM_B, and large dots are formed with this drive signal to produce adjustment patterns for large dots.

Figure 20:
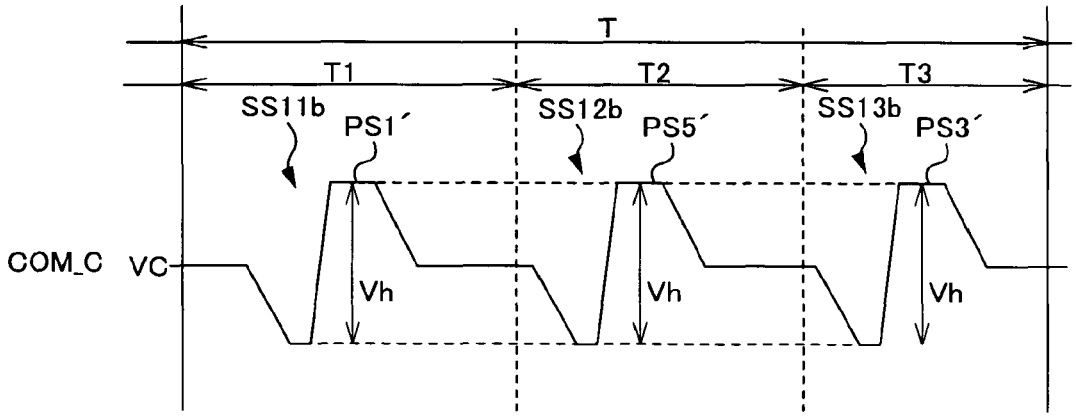
FIG. 20 is an explanatory diagram of the adjustment drive signal COM_C.

FIG. 20 is an explanatory diagram of the adjustment drive signal COM_C. The adjustment drive signal COM_C is generated by the first drive signal generation section 70A or the second drive signal generation section 70B when forming the adjustment patterns for large dots.

Comparing the first drive signal COM_A and the adjustment drive signal COM_C, in period T2, the first drive signal COM_A is the drive pulse PS2 whereas the adjustment drive signal COM_C is the drive pulse PS5'. The drive pulse PS5' of the adjustment drive signal COM_C has the same waveform as the drive pulse PS5 of the second drive signal COM_B. Comparing the second drive signal COM_B and the adjustment drive signal COM_C, in period T1, the second drive signal COM_B is the drive pulse PS4 whereas the adjustment drive signal COM_C is the drive pulse PS1', and in period T3, the second drive signal COM_B does not have a drive pulse whereas the adjustment drive signal COM_C is the drive pulse PS3'. The drive pulse PS1' of the adjustment drive signal COM_C has the same waveform as the drive pulse PS1 of the first drive signal COM_A. Also, its drive pulse PS3' has the same waveform as the drive pulse PS3 of the first drive signal COM_A (that is, the same waveform as the drive pulse PS1).

When forming adjustment patterns for large dots, the first drive signal generation section 70A or the second drive signal generation section 70B generates the adjustment drive signal COM_C. Also, when forming adjustment patterns for large dots, the head controller HC applies the three drive pulses that are included in the adjustment drive signal COM_C to the piezo elements 417. By doing this, the large dots are formed by only the drive signals generated by one of the drive signal generation sections. It should be noted that in order to apply the three drive pulses of the adjustment drive signal COM_C to the piezo elements 417 it is necessary to change the waveform selection signals q0 to q7, but here, description regarding this aspect will be omitted (in other words, the waveform selection signals q0 to q7 are set such that the switch to which the adjustment drive signal COM_C is input is in the on state from periods T1 to T3 and the switch to which the adjustment drive signal COM_C is not input is in the off state from periods T1 to T3).

Figure 21A:
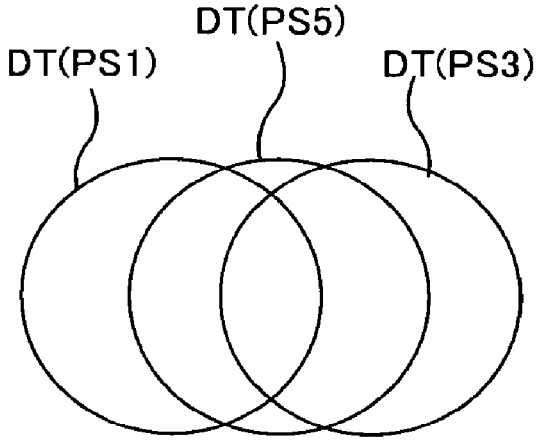
FIG. 21A is an explanatory diagram of the large dot that is formed when the first drive signal generation section 70A generates the adjustment drive signal COM_C.

FIG. 21A is an explanatory diagram of the large dots that are formed when the first drive signal generation section 70A generates the adjustment drive signal COM_C. Since the first drive signal generation section 70A generates drive signals with normal voltage, the large dots that are formed are normal size.

Figure 21B:
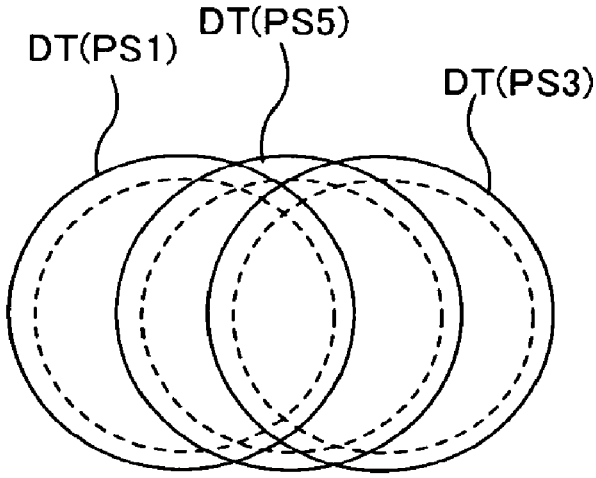
FIG. 21B is an explanatory diagram of the large dot that is formed when the second drive signal generation section 70B generates the adjustment drive signal COM_C.

FIG. 21B is an explanatory diagram of the large dots that are formed when the second drive signal generation section 70B generates the adjustment drive signal COM_C. Since the second drive signal generation section 70B generates drive signals with an abnormal voltage, the large dots that are formed have a larger diameter than the normal dot diameter. It should be noted that the dashed lines in the drawing show the large dots of FIG. 21A.

The adjustment pattern group for large dots is made in substantially the same manner as the adjustment pattern group for small dots. The first adjustment pattern group CP1 and the second adjustment pattern group CP2 are printed on the paper S. The first adjustment pattern group CP1 and the second adjustment pattern group CP2 each have a plurality of adjustment patterns that are lined up in the carrying direction. Each adjustment pattern is made of large dots. That is, each adjustment pattern is formed by applying the three drive pulses of the adjustment drive signal COM_C to the piezo elements 417.

The adjustment patterns that belong to the first adjustment pattern group CP1 are formed by the three drive pulses of the adjustment drive signal COM_C that is generated by the first drive signal generation section 70A. The adjustment patterns that belong to the second adjustment pattern group CP2 are formed by the three drive pulses of the adjustment drive signal COM_C that is generated by the second drive signal generation section 70B. Also, the drive voltage Vh of the drive pulses that are applied to the piezo elements 417 when forming the adjustment patterns is different for each of the plurality of adjustment patterns lined up in the carrying direction. When the drive voltage Vh of the drive pulse changes, the amount of ink that is ejected changes, and thus the diameter of the small dots that are formed on the paper S is different. For this reason, the darkness of the plurality of adjustment patterns lined up in the carrying direction differ from one another.

The in-process program 151 causes the computer 110A to obtain the darkness data of the adjustment patterns of the first adjustment pattern group CP1 and the second adjustment pattern group CP2 for large dots from the scanner device 200. Then, the in-process program 151 compares the reference darkness of the adjustment pattern for the large dots, which has been determined in advance, with the darkness of each of the adjustment patterns, and chooses the adjustment pattern whose darkness is closest to the reference darkness. The in-process program stores information on the drive voltage Vh of the drive pulses when the adjustment pattern that has been extracted from the first adjustment pattern group CP1 was formed, in the adjustment value storage region 63*c* of the memory 63 of the printer 1 as the large dot adjustment value of the first drive signal generation section 70A. Here, the "reference setting value" is stored in the adjustment value storage region 63*c* as the large dot adjustment value of the first drive signal generation section 70A. Similarly, the in-process program stores "−0.4V" (or "−00Ah") in the adjustment value storage region 63*c* as the large dot adjustment value of the second drive signal generation section 70B, based on the adjustment pattern that has been extracted from the second adjustment pattern group CP2.

<Adjusting the Intermediate Voltage VC (within the Same Drive Signal)>

In the following description, the second drive signal generation section 70B shall generate the first drive signal. Also, the small dot adjustment value of the second drive signal generation section 70B shall be "−0.2V" (or "−005h") and the large dot adjustment value shall be "−0.4V" (or "−00Ah").

Figure 22A:
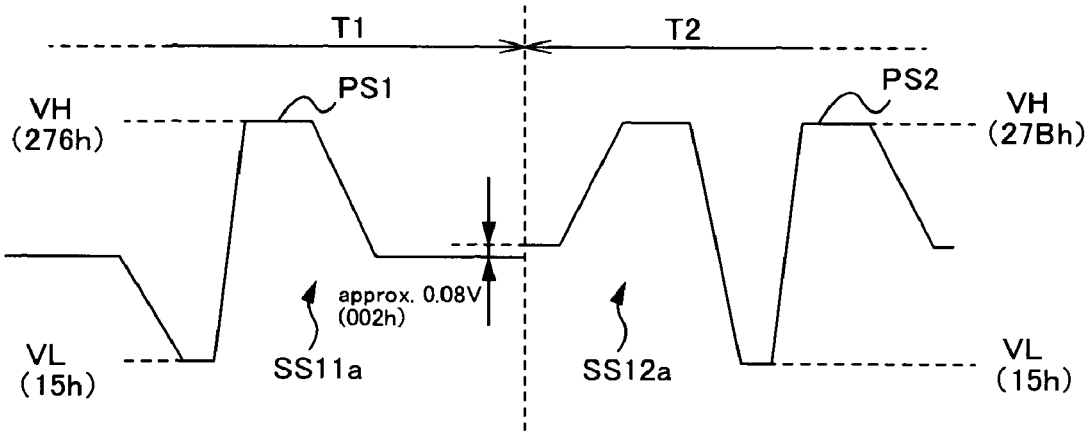
FIG. 22A is an explanatory diagram of the state of the first waveform section SS11*a* and the second waveform section SS12*a* before adjustment of the intermediate voltage is performed.
Figure 22B:
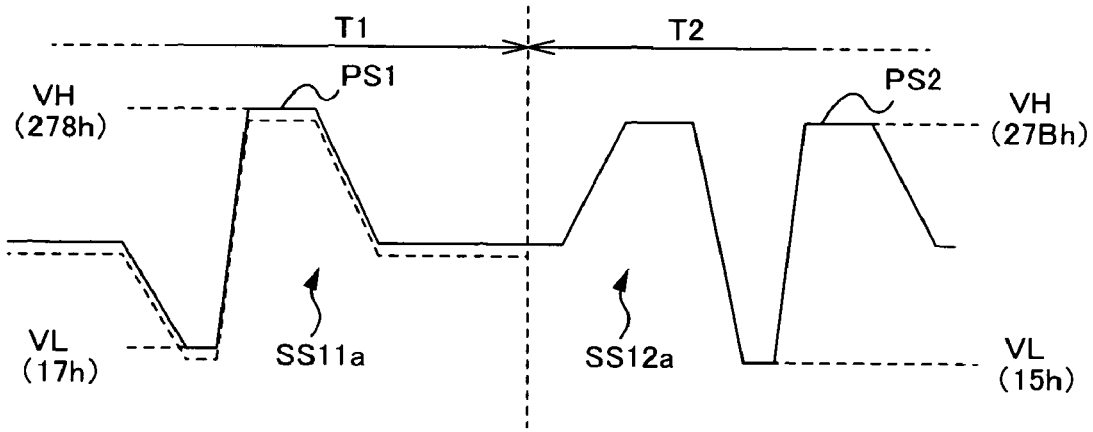
FIG. 22B is an explanatory diagram of the state of the first waveform section SS11*a* and the second waveform section SS12*a* after adjustment of the intermediate voltage.

FIG. 22A is an explanatory diagram of the state of the first waveform section SS11*a* and the second waveform section SS12*a* before adjustment of the intermediate voltage is performed. FIG. 22B is an explanatory diagram of the state of the first waveform section SS11*a* and the second waveform section SS12*a* after adjustment of the intermediate voltage. It should be noted that both cases are for the first drive signal COM_A that is generated by the second drive signal generation section 70B.

During printing, the CPU 62 reads out the adjustment value stored in the adjustment value storage region 63*c* of the memory 63 before it outputs the DAC values to the second drive signal generation section 70B. In a case where the second drive signal generation section 70A generates the first drive signal COM_A, the CPU 62 reads out the large dot adjustment value and the small dot adjustment value that are associated with the second drive signal generation section 70B.

Here, the small dot adjustment value of the second drive signal generation section 70B is "−0.2V", and thus when the second drive signal generation section 70B generates the drive pulse PS2 of the first drive signal COM_A, the DAC_VH (the DAC value that is output from the CPU 62 when the drive pulse PS2 is maximum voltage) is set to "27Bh" (=280h−005h). On the other hand, the large dot adjustment value of the second drive signal generation section 70B is "−0.4V", and thus when the second drive signal generation section 70B generates the drive pulse PS1 or PS3 of the first drive signal COM_A, the DAC_VH is set to "276h" (=280h−00Ah).

On the other hand, the reference voltage Vc is set to 0.4 times the drive voltage Vh (=maximum voltage VH−minimum voltage VL). That is, DAC_VC (the DAC value at the time of the intermediate voltage VC) becomes (DAC_VH−DAC_VC)×0.4 (the value obtained by subtracting the DAC value at the time of the minimum voltage VL from the DAC value at the time of the maximum voltage VH, and then multiplying that by 0.4).

As shown in FIG. 22A, if the intermediate voltage VC is not adjusted, then the DAC_VC of the first waveform section SS11*a* is a different value from the DAC_VC of the second waveform section SS12*a* because the DAC_VH of the drive pulse PS1 and the DAC_VH of the drive pulse PS2 are different. That is, the intermediate voltages VC of the two waveform sections are different. Specifically, there is a "005h" difference between the DAC_VH of the two waveform sections, and thus the difference in the intermediate voltages VC of the two waveform sections becomes approximately 0.08V, which corresponds to the DAC value "002h".

If the difference between the intermediate voltages VC of the two waveform sections becomes large, then a sudden voltage change will occur when moving from period T1 to period T2. The result is that the initial intermediate voltage VC of the second waveform section SS12*a* oscillates, and this may affect the ejection of ink due to the drive pulse PS2.

Accordingly, in this embodiment, as shown in FIG. 22B, if the intermediate voltages VC of the two waveform sections are different, then the waveform of the lower intermediate voltage is shifted so that the intermediate voltages VC of the two waveform sections are aligned. In other words, in this embodiment, the DAC_VC of the two waveforms (the DAC value that is output from the CPU 62 when at the intermediate voltage VC) are matched. Specifically, when the second drive signal generation section 70B generates the waveform section SS11 of first drive signal COM_A, the CPU 62 outputs a DAC value to which the shift amount (in the case of FIG. 22B, the amount "002h") has been added, to the second drive signal generation section 70B. It should be noted that although not shown, the CPU 62 similarly outputs a DAC value to which the DAC value of the shift amount has been added, to the second drive signal generation section 70B when the second drive signal generation section 70B generates the drive pulse PS3 of first drive signal COM_A. As a result, the intermediate voltage VC of the first drive signal COM_A that is generated by the second drive signal generation section 70B becomes the same for all waveforms.

It should be noted that although not described, the CPU 62 similarly adjusts the intermediate voltage VC of the second drive signal COM_B based on the medium dot adjustment value and the large dot adjustment value for the second drive signal generation section 70B. Thus, the intermediate voltages of the first waveform section SS21*a* and the second waveform section SS22*a* of the second drive signal (see FIG. 9) are matched.

<Adjusting the Intermediate Voltage VC (Between Other Drive Signals)>

In the following description, the first drive signal generation section 70A generates the first drive signal COM_A and the second drive signal generation section 70B generates the second drive signal COM_B. Also, the intermediate voltage VC of the first drive signal COM_A that is generated by the first drive signal generation section 70A is adjusted so that it is the same among the waveform sections. Likewise, the intermediate voltage VC of the second drive signal COM_B that is generated by the second drive signal generation section 70B is adjusted so that it is the same among the waveform sections.

Figure 23A:
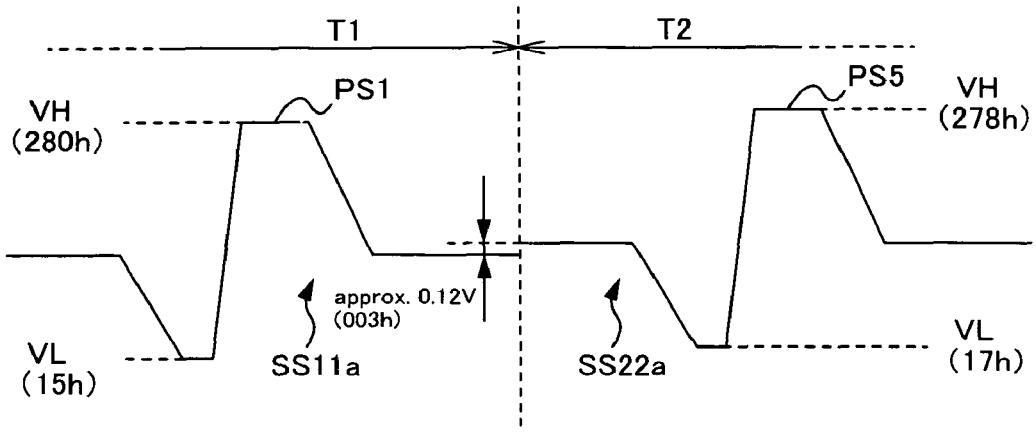
FIG. 23A is an explanatory diagram of the state of the first waveform section SS11*a* of the first drive signal COM_A and the second waveform section SS22*a* of the second drive signal COM_B before adjustment of the intermediate voltage VC.
Figure 23B:
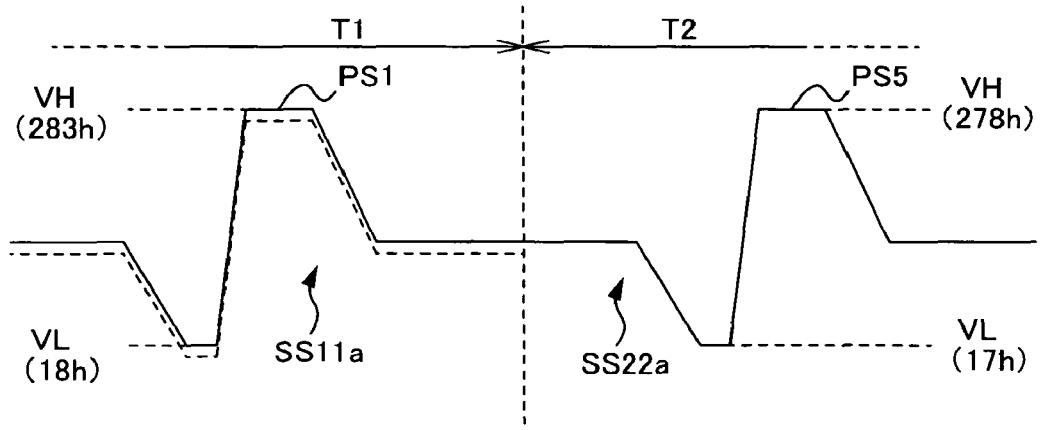
FIG. 23B is an explanatory diagram of the state of the first waveform section SS11*a* and the second waveform section SS22*a* after adjustment of the intermediate voltage VC.

FIG. 23A is an explanatory diagram of the state of the first waveform section SS11*a* of the first drive signal COM_A and the second waveform section SS22*a* of the second drive signal COM_B before adjustment of the intermediate voltage VC. FIG. 23B is an explanatory diagram of the state of the first waveform section SS11*a* and the second waveform section SS22*a* after adjustment of the intermediate voltage VC. It should be noted that the first waveform section SS11*a* is generated by the first drive signal generation section 70A and the second waveform section SS22*a* is generated by the second drive signal generation section 70B.

When forming a large dot, the first drive signal COM_A and the second drive signal COM_B are applied to the piezo elements 417 in period T1 and period T2, respectively. However, the first drive signal COM_A and the second drive signal COM_B are generated by separate drive signal generation sections. That is, when forming a large dot, the intermediate voltage VC of period T1 and the intermediate voltage VC of period T2 are generated by different drive signal generation sections.

As discussed earlier, discrepancies in the properties of the drive signal generation sections can for example result in the intermediate voltage VC that is output by the first drive signal generation section 70A and the intermediate voltage VC that is output by the second drive signal generation section 70B being different from one another, even though the same DAC_VC has been input. Additionally, since adjustment has been performed so that the intermediate voltages are the same within the same drive signal, the intermediate voltage of the first drive signal COM_A and the intermediate voltage of the second drive signal COM_B become different.

If the difference between the intermediate voltage VC of the first drive signal COM_A and the intermediate voltage VC of the second drive signal COM_B is large, then when a large dot is formed, a voltage signal that changes suddenly when moving from period T1 to period T2 will be applied to the piezo elements 417. As a result, unanticipated ink may be ejected, and the piezo elements 417 may be damaged.

Accordingly, in this embodiment, after adjusting the intermediate voltages VC of the waveform sections in each drive signal COM (see FIG. 22B), then the drive signal having the lower intermediate voltage VC of the two drive signals is shifted so as to align the intermediate voltages VC of the two drive signals.

To align the intermediate voltages VC of the two drive signals, first the intermediate voltages VC of each drive signal COM are detected. Detection of the intermediate voltage VC is performed by an inspector in the inspection procedure using a detector (not shown). The inspector then inputs the value of the intermediate voltage VC of the first drive signal COM_A and the value of the intermediate voltage VC of the second drive signal COM_B to the computer 110A. The computer 110A calculates the difference between the intermediate voltages VC of the two drive signals. Here, the calculated difference between the intermediate voltages VC of the two drive signals is 0.12V (see FIG. 23A). The computer 110A then stores the calculated value "0.12V" (or "003h") in the adjustment value storage region 63*c* of the memory 63 of the printer 1 as information that indicates the shift amount of the intermediate voltage VC.

Then, during printing, when the first drive signal generation section 70A is to generate the first drive signal COM_A, the CPU 62 reads the information of the adjustment value storage region 63*c* and outputs a DAC value to which the shift amount (in the case of FIG. 23B, the amount of "003h") has been added, to the first drive signal generation section 70A. As a result, the intermediate voltage VC of the first drive signal COM_A that is generated by the first drive signal generation section 70A becomes identical to that of the second drive signal COM_B that is generated by the second drive signal generation section 70B. This consequently allows to prevent an electric signal that changes suddenly from being applied to the piezo element 417 when a large dot is to be formed.

It should be pointed out that there is a possibility that the intermediate voltages VC will change if the first drive signal generation section 70A generates the second drive signal COM_B and the second drive signal generation section 70B generates the first drive signal COM_A (i.e., if the drive signals are switched). Accordingly, in the inspection process, the inspector detects the intermediate voltage when the first drive signal generation section 70A generates the second drive signal COM_B and the intermediate voltage when the second drive signal generation section 70B generates the first drive signal COM_A. The computer 110A then calculates the difference between the intermediate voltages VC of the two drive signals and stores the shift amount of the DAC value in the adjustment value storage region 63*c* of the memory 63 of the printer 1.

That is, two shift amounts are stored in the adjustment value storage region 63*c* of the memory 63. One of the shift amounts is the shift amount when the first drive signal generation section 70A generates the first drive signal COM_A and the second drive signal generation section 70B generates the second drive signal COM_B. The other shift amount is the shift amount when the drive signals have been switched.

When a print image is to be printed, the dot diameters will be uniform if the drive signal generation sections generate the drive signals that have been adjusted as above, and this will increase the image quality of the print image.

Second Embodiment

Adjustment of the Dot Number

In the second embodiment, the number of dots that are formed due to the drive signal that is generated by the first drive signal generation section 70A is adjusted based on an adjustment value that corresponds to the first drive signal generation section 70A. Likewise, the number of dots that are formed due to the drive signal that is generated by the second drive signal generation section 70B also is adjusted based on an adjustment value that corresponds to the second drive signal generation section 70B. This is described in detail below.

In this embodiment, as in the first embodiment discussed above, adjustment patterns are printed and the darkness of those printed adjustment patterns is detected, and based on the results of this detection, adjustment values are set in the adjustment value storage region 63*c* of the memory 63 of the printer 1. The adjustment value storage region 63*c* stores a small dot adjustment value, a medium dot adjustment value, and a large dot adjustment value in association with the first drive signal generation section 70A. The adjustment value storage region 63*c* also stores a small dot adjustment value, a medium dot adjustment value, and a large dot adjustment value in association with the second drive signal generation section 70B. The description up to this point is the same as in the first embodiment discussed above and thus will not be described further.

Figure 24:
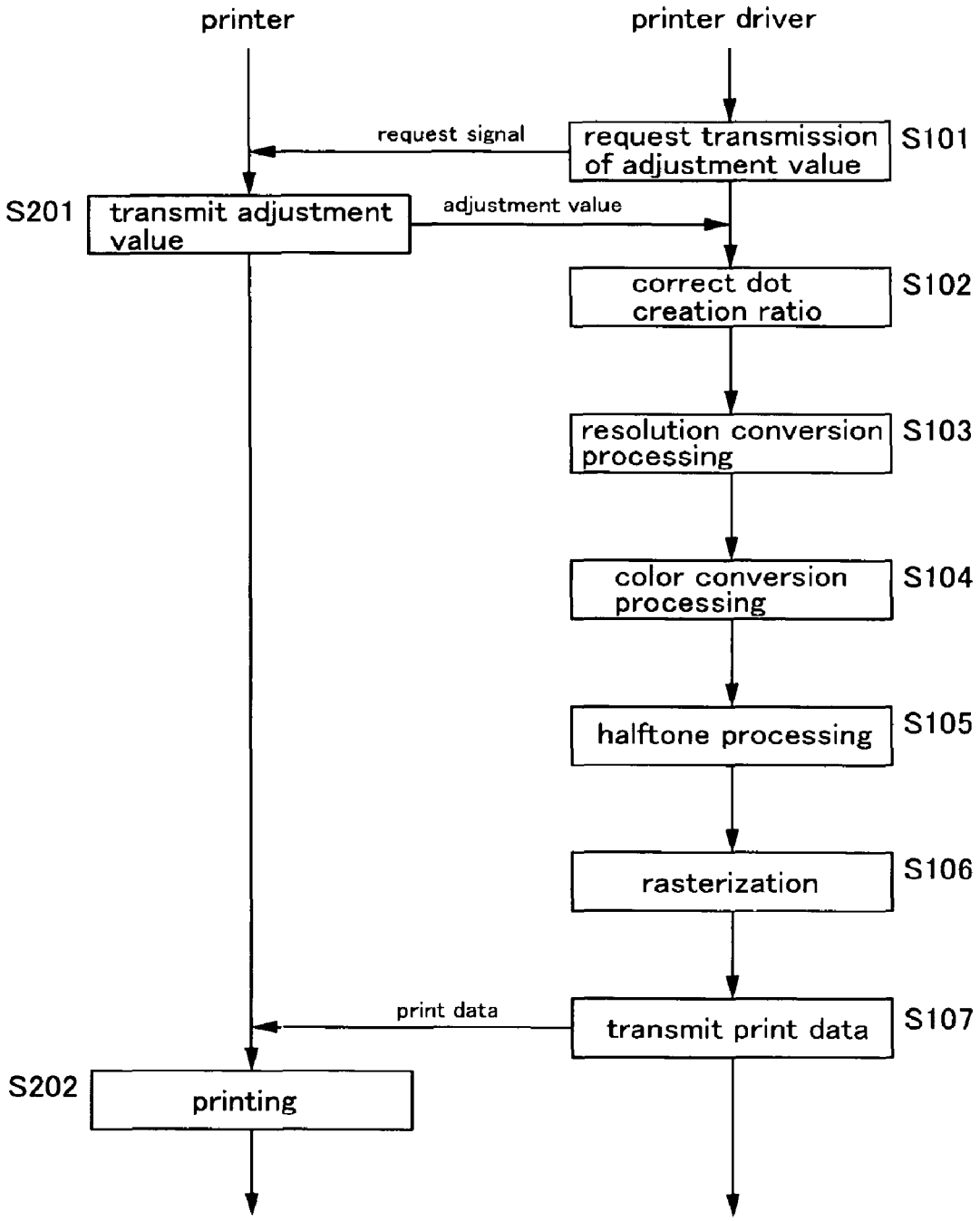
FIG. 24 is a flowchart for describing the flow of the embodiment.

FIG. 24 is a flowchart for describing the flow of this embodiment. The procedure from S103 to S106 in the drawing is the normal procedure, and thus will be described first.

<Normal Printer Driver Processing>

The printer driver performs resolution conversion, color conversion, halftone processing, and rasterization in order to convert the image data that are output from the application program into print data.

In resolution conversion (S103), the printer driver converts the resolution of the RGB image data that are output from the application program to the print resolution when the printer 1 performs printing. For example, if the print resolution is 720 dpi, then the printer driver converts the resolution of the RGB image data that are output from the application program into RGB image data at 720 dpi. It should be noted that the RGB image data are in 256 gradations.

In color conversion (S104), the printer driver converts the RGB image data whose resolution has been converted, into a CMYK (cyan, magenta, yellow, black) color space that can be expressed by the printer 1. For example, the printer driver converts the RGB image data of 256 gradations into CMYK image data of 256 gradations.

In halftone processing (S105), the printer driver converts image data having many gradations into image data having few gradations that can be expressed by the printer 1. Here, the printer 1 can express four gradations (no dot, small dot, medium dot, large dot), and thus the printer driver converts the CMYK image data of 256 gradations into CMYK pixel data of four gradations. It should be noted that the pixel data that are included in the image data are the 2-bit data mentioned earlier.

For halftone processing it is possible to use dithering, γ-correction, or error diffusion, for example. Dithering is used in this embodiment, and will be described in detail later.

In rasterization (S106), the printer driver changes the CMYK image data that have been subjected to halftone processing in the data order in which they are to be transferred to the printer 1. It should be noted that the rasterized data are output to the printer 1 as the above print data.

Figure 25:
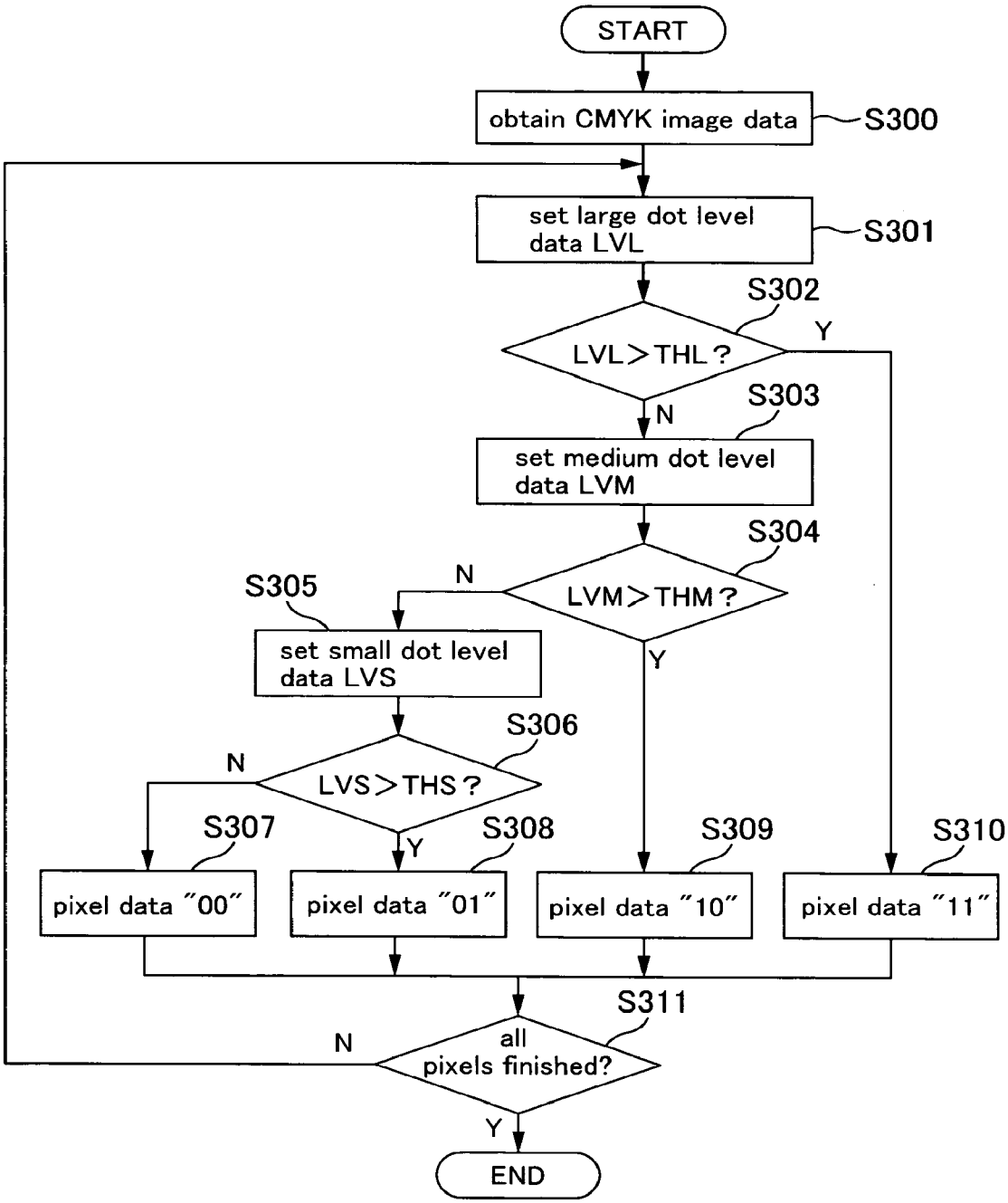
FIG. 25 is a flowchart for describing halftone processing through dithering.

Halftone processing through dithering is described in detail here. FIG. 25 is a flowchart for describing halftone processing through dithering. The printer driver (that is, the computer 110 on which the printer driver is installed) executes the following steps in accordance with this flowchart. That is to say, the printer driver has program code for executing the following steps.

First, in step S300, the printer driver 1110 obtains CMYK image data that have been color converted. The CMYK image data are for example made of image data expressed by gradation values of 256 gradations for each ink color C, M, Y, and K. That is, the CMYK image data include C image data for cyan (C), M image data for magenta (M), Y image data for yellow (Y), and K image data for black (K). The C, M, Y, and K image data are made of C, M, Y, and K pixel data, respectively, that indicate the gradation value for that ink color. It should be noted that the following description applies to any of the C, M, Y, and K ink data, and thus K image data will be described as representative of these.

The printer driver executes the processing of steps S301 to S311 with respect to all of the K pixel data in the K image data, sequentially changing the K pixel data to be processed. Through this processing, the 256-gradation K image data are converted into 2-bit data that indicate one of four gradation values for each K pixel data.

First, in step S301, the printer driver sets the level data LVL for large dots based on the gradation value of the K pixel data to be processed. This setting is made using a creation ratio table, for example.

Figure 26:
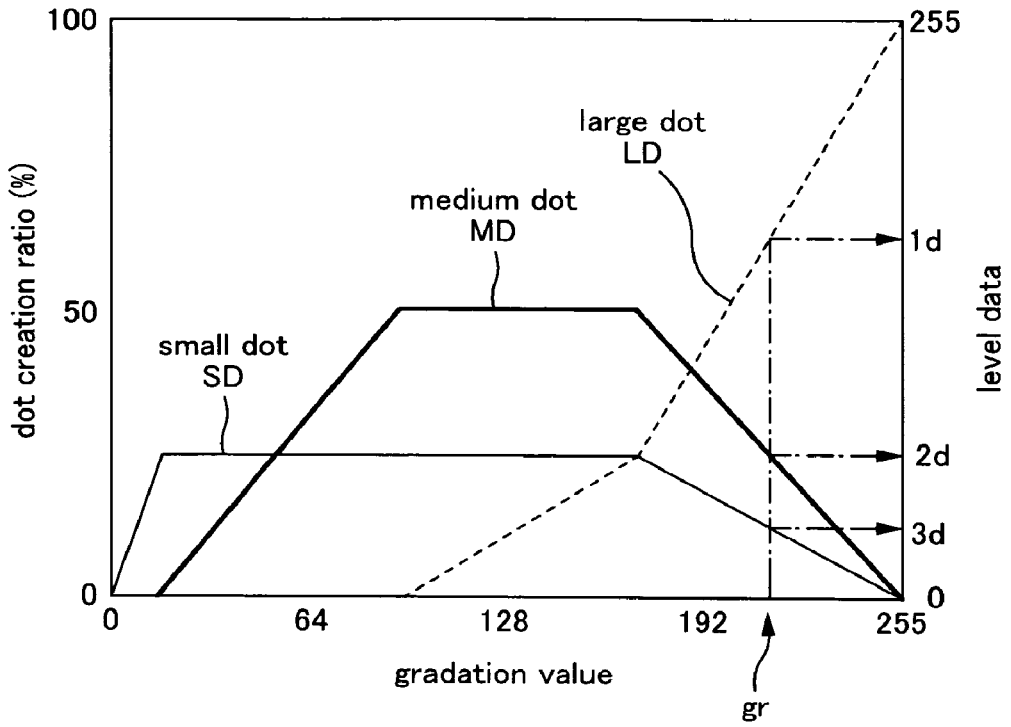
FIG. 26 is a diagram that shows the creation ratio table that is used to set the level data for large, medium, and small dots.

Here, FIG. 26 is a diagram that shows the creation ratio table that is used to set the level data for large, medium, and small dots. In this diagram, the horizontal axis indicates gradation values (0-255), the vertical axis on the left indicates the dot creation ratio (%), and the vertical axis on the right indicates the level data. The level data are data in which the creation ratio of the dot has been converted to one of 256 gradations from 0 to 255. The "dot creation ratio" means, when a uniform area is expressed at a constant gradation value, the ratio of the number of pixels in which dots are formed to the number of pixels in that area. Let us take as an example in which a dot creation ratio at a certain gradation value is large dot 65%, medium dot 25%, and small dot 10%, and in which an area of 100 pixels is printed with this dot creation ratio. In this case, of those 100 pixels, 65 pixels will have large dots formed therein, 25 will have medium dots formed therein, and 10 will have small dots formed therein. The profile SD indicated by the thin solid line in FIG. 26 shows the creation ratio for small dots. The profile MD indicated by the thick solid line shows the creation ratio for medium dots, and the profile LD indicated by the broken line shows the creation ratio for large dots.

Next, in step S301, the printer driver reads the level data LVL corresponding to the gradation value from the large dot profile LD. For example, as shown in FIG. 26, if the gradation value of the K pixel data to be processed is gr, then level data LVL of ld are obtained from the point of intersection with the profile LD. In practice, the profile LD is stored on a memory such as a ROM (not shown) that is provided in the computer 110, in the form of a one-dimensional table, for example. The printer driver 1110 then reads the level data LVL by referencing this table.

In step S302, the printer driver determines whether or not the level data LVL that correspond to the K pixel data to be processed are larger than a threshold value THL. Here, the printer driver determines whether the dot is on or off through dithering. A different threshold value THL is set for each pixel block of a so-called dither matrix. The dither matrix that is used in this embodiment expresses a value from 0 to 254 for 16×16 square pixel blocks.

Figure 27:
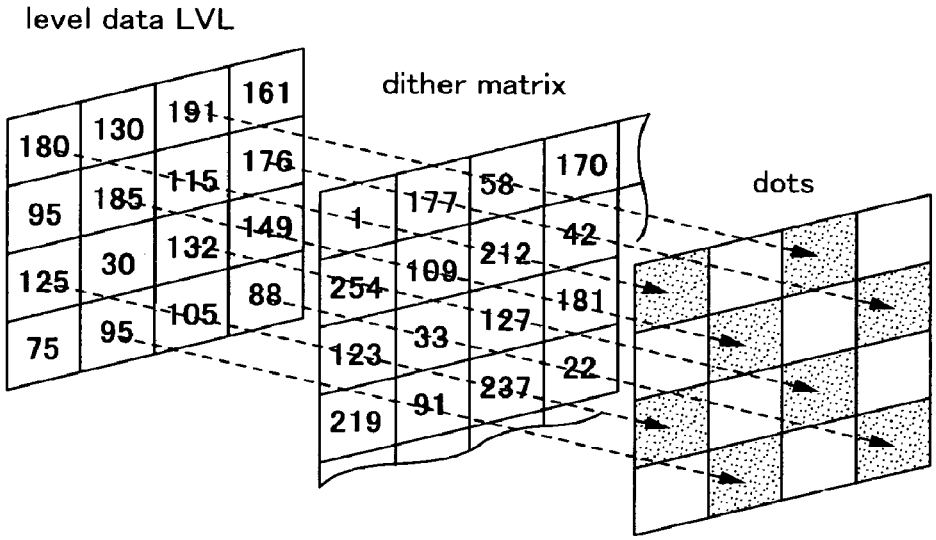
FIG. 27 is a diagram that illustrates how a dot is determined to be on or off through dithering.

FIG. 27 is a diagram that shows how a dot is determined to be on or off through dithering. For the sake of convenience, the drawing shows the results of the on/off determination performed for only some of the K pixel data. The following is an overview of the operation of the on/off determination in this example.

First, the printer driver compares the level data LVL of each K pixel data with the threshold value THL of the pixel block on the dither matrix corresponding to that K pixel data. If the level data LVL are larger than the threshold value THL, then the dot is turned on (that is, a dot is formed), and if the level data LVL are smaller, then the dot is turned off (that is, a dot is not formed). In the drawing, the pixel data in the shaded areas of the dot matrix are K pixel data in which the dot is turned on. That is, in step S302, the printer driver advances to step S310 if the level data LVL are larger than the threshold value THL, and advances to step S303 in all other cases.

Here, if the printer driver has advanced the procedure to step S310, then it records the value "11" in association with that K pixel data to be processed to designate it as pixel data (2-bit data) that indicate a large dot, and advances the procedure to step S311. Then, in step S311, the printer driver determines whether or not the processing for all K pixel data has ended, and if it has ended, then the printer driver ends halftone processing. On the other hand, if the processing has not ended, then the printer driver moves to K pixel data that have not yet been processed and returns the procedure to step S301.

If the procedure has been advanced to step S303, then the printer driver sets the medium dot level data LVM. The medium dot level data LVM are set through the creation ratio table described above, based on the gradation value of the K pixel data to be processed. The method for setting the medium dot level data LVM is the same as that for setting the large dot level data LVL. For example, in the example of FIG. 26, the level data LVM corresponding to the gradation value gr is found as 2*d*, which is shown by the point of intersection with the profile MD, which indicates the medium dot creation ratio.

In step S304, the printer driver compares the medium dot level data LVM and the threshold value THM in size to determine whether to turn the medium dot on or off. The method by which the dot is determined to be either on or off is the same as that for large dots. Here, in the determination of whether the medium dot is on or off, the threshold value THM is set to a different value than the threshold value THL for a large dot. That is, if the on/off determination is made using the same dither matrix for large dots and medium dots, then pixel blocks whose dots become on easily will match for large and medium dots. In other words, there is an increased probability that when the large dot is off the medium dot also will be off. As a result, there is a possibility that the creation ratio for medium dots will be lower than the desired creation ratio. In order to circumvent this problem, in the present embodiment the dither matrix is changed for large dots and medium dots. That is, the pixel blocks that become on easily are changed for large dots and medium dots, thereby allowing both dots to be formed appropriately.

Figures 28A, 28B, 29:
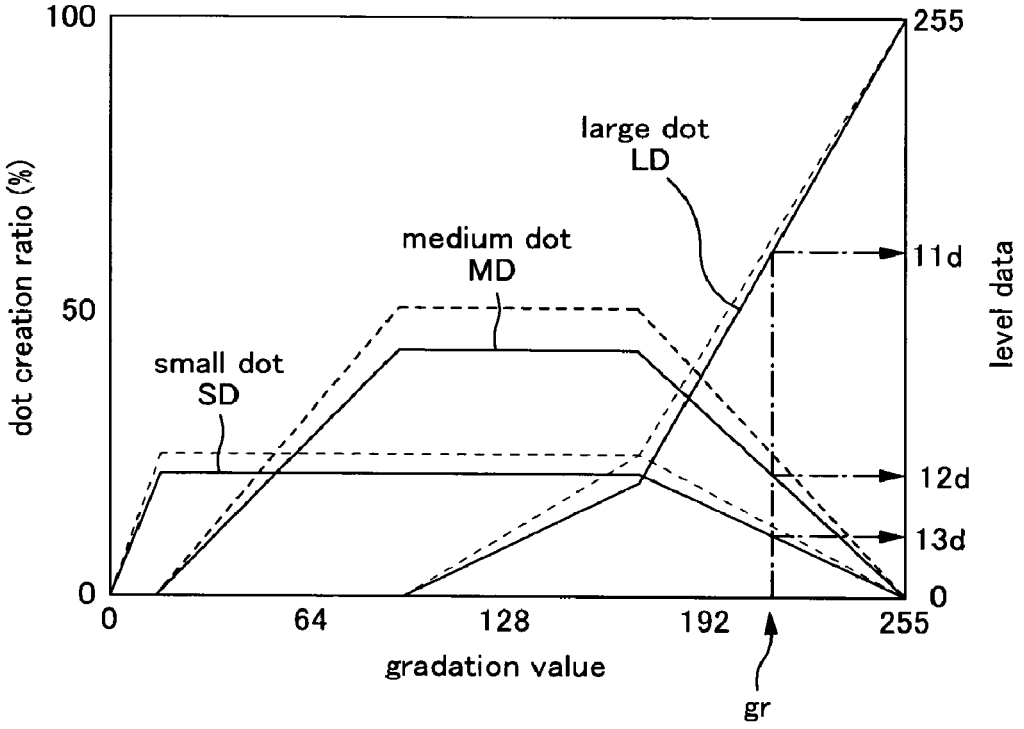
FIG. 28A is an explanatory diagram of the first dither matrix TM that is used for determining large dots.
FIG. 28B is an explanatory diagram of the second dither matrix UM that is used for determining medium dots.
FIG. 29 is an explanatory diagram of the dot creation ratio table that is used for odd-numbered dot formation operations.

FIG. 28A is an explanatory diagram of a first dither matrix TM that is used for the determination of large dots. FIG. 28B is an explanatory diagram of a second dither matrix UM that is used for the determination of medium dots. The second dither matrix UM is obtained by symmetrically moving the threshold values in the first dither matrix TM about the center in the carrying direction (in the drawings, the vertical direction). It should be noted that, as discussed above, a 16×16 matrix is used in this embodiment, but for the sake of simplifying the drawings, a 4×4 matrix is shown. It is also possible to use completely different dither matrices for the large and medium dots.

In step S304, if the medium dot level data LVM is larger than the medium dot threshold value THM, then the printer driver determines that a medium dot should be turned on and advances the procedure to step S309, and in other cases, the printer driver advances the procedure to step S305. Here, if the procedure is advanced to step S309, then the printer driver records the pixel data "10," which indicates a medium dot, in association with the K pixel data being processed, and advances the procedure to step S311. In step S311, the printer driver determines whether or not the processing for all K pixel data has ended, and if it has ended, then the printer driver ends halftone processing. On the other hand, if the processing has not ended, then the printer driver moves to K pixel data that have not yet been processed and returns the procedure to step S301.

If the procedure has been advanced to step S305, then the printer driver sets the small dot level data LVS in the same way that it sets the level data for large dots and medium dots. It should be noted that the dither matrix for small dots preferably is different from those for the medium dots and the large dots discussed above in order to prevent a drop in the small dot creation ratio.

In step S306, the printer driver compares the level data LVS with the small dot threshold value THS, and if the level data LVS is larger than the small dot threshold value THS, then it advances the procedure to step S308, and in other cases it advances the procedure to S307. Here, if the procedure is advanced to step S308, then the printer driver records the pixel data "01," which indicates a small dot, in association with the K pixel data being processed, and advances the procedure to step S311. Then, in step S311, the printer driver determines whether or not the processing for all K pixel data has ended, and if the processing has not ended, then the printer driver moves to K pixel data that have not yet been processed and returns the procedure to step S301. On the other hand, if the processing has finished, then halftone processing is ended.

If the procedure has been advanced to step S307, then the printer driver records the pixel data "00," which indicates non-formation of a dot, in association with the K pixel data being processed, and advances the procedure to step S311. Then, in step S311, the printer driver determines whether or not the processing for all K pixel data has ended, and if the processing has not ended, then the printer driver moves to K pixel data that have not yet been processed and returns the procedure to step S301. On the other hand, if the processing has finished, then halftone processing is ended.

<Adjusting the Dot Creation Ratio in the Present Embodiment>

Returning to FIG. 24, the description of the present embodiment is continued below. The processing shown on the right side of FIG. 24 is performed by the printer driver. The processing shown in the left side of the drawing is performed by the printer.

First, in step S101, the printer driver sends a request signal for requesting transmission of the adjustment values, to the printer 1 before the normal processing of S103 to S106. The timing at which the printer driver sends the request signal can be immediately before the printing process or can be immediately after the printer driver has been installed on the computer 110.

Once the printer 1 has received the request signal from the printer driver, in step S201, the printer-side controller 60 reads the small dot adjustment value, the medium dot adjustment value, and the large dot adjustment value of the first drive signal generation section 70A, and the small dot adjustment value, the medium dot adjustment value, and the large dot adjustment value of the second drive signal generation section 70B, from the adjustment value storage region 63*c* of the memory 63. The printer-side controller 60 then transmits the adjustment values that it has read from the memory 63 to the computer 110.

Once the printer driver has received the adjustment values from the printer 1, in step S102, the printer driver corrects the creation ratio table in FIG. 26, taking it as a reference, based on the adjustment values, creating two types of dot creation ratio tables. One of the dot creation ratio table is used for the pixel data that correspond to the pixels in which dots are formed through the odd-numbered dot formation operations. The other dot creation ratio table is used for the pixel data that correspond to the pixels in which dots are formed through the even-numbered dot formation operations. It should be noted that in the odd-numbered dot formation operations, the first drive signal generation section 70A generates the first drive signal COM_A and the second drive signal generation section 70B generates the second drive signal COM_B. In the even-numbered dot formation operations, the first drive signal generation section 70A generates the second drive signal COM_B and the second drive signal generation section 70B generates the first drive signal COM_A.

FIG. 29 is an explanatory diagram of the dot creation ratio table that is used for the odd-numbered dot formation operations. The dashed line in the drawing is the creation ratio table of FIG. 26, and serves as the reference creation ratio table. On the other hand, the solid line in the drawing indicates the creation ratio table that has been corrected based on the adjustment values.

In the odd-numbered dot formation operations, the drive pulse PS2 for forming small dots (see FIG. 9) is generated by the first drive signal generation section 70A. Thus, the profile SD indicating the dot creation ratio for small dots is corrected based on the small dot adjustment value that is associated with the first drive signal generation section. For example, if the small dot adjustment value of the first drive signal generation section 70A is "−0.2V", then the drive voltage Vh of the drive pulse PS2 that is generated by the first drive signal is higher than normal and thus the small dot that is formed is larger than normal, and therefore, the profile SD is corrected to lower the small dot creation ratio.

Similarly, in the odd-numbered dot formation operations, the drive pulse PS4 for forming medium dots (see FIG. 9) is generated by the second drive signal generation section 70B. Thus, the profile MD indicating the dot creation ratio for medium dots is corrected based on the medium dot adjustment value that is associated with the second drive signal generation section.

In the odd-numbered dot formation operations, of the drive pulses for forming large dots, the drive pulse PS1 and the drive pulse PS3 are generated by the first drive signal generation section 70A and the drive pulse PS5 is generated by the second drive signal generation section 70B. Thus, the profile LD showing the dot creation ratio for large dots is corrected based on the large dot adjustment value that is associated with the first drive signal generation section and the large dot adjustment value that is associated with the second drive signal generation section. However, two of the three drive pulses for forming large dots are formed by the first drive signal generation section 70A, and thus the profile LD is corrected giving more weight to the large dot adjustment value that is associated with the first drive signal generation section.

It should be noted that the dot creation ratio tables that are used for the even-numbered dot formation operations are created in substantially the same manner. Although not described in detail here, it should be noted that the profile SD indicating the dot creation ratio for small dots is corrected based on the small dot adjustment value that is associated with the second drive signal generation section. The profile MD indicating the dot creation ratio for medium dots is corrected based on the medium dot adjustment value that is associated with the first drive signal generation section. The profile LD indicating the dot creation ratio for large dots is corrected based on the large dot adjustment value that is associated with the first drive signal generation section and the large dot adjustment value that is associated with the second drive signal generation section, giving more weight to the large dot adjustment value that is associated with the second drive signal generation section.

The printer driver then uses the two types of dot creation ratio tables thus created to perform halftone processing (S105). In normal halftone processing, the same dot creation ratio table is adopted for all pixel data so as to convert pixel data in 256 gradations into pixel data in four gradations (2-bit data). However, in the halftone processing of this embodiment, the two types of dot creation tables are used selectively depending on the pixel to be processed.

First, at the time of halftone processing, the printer driver determines whether the pixel to be processed is a pixel in which a dot is formed in an odd-numbered dot formation operation or is a pixel in which a dot is formed in an even-numbered dot formation operation. This determination can be performed based on the position of the pixel data to be processed within the image data.

If the pixel to be processed is a pixel in which a dot is formed in an odd-numbered dot formation operation, then the printer driver uses the dot creation ratio table of FIG. 29 to convert the pixel data into 2-bit data. Similarly, if the pixel to be processed is a pixel in which a dot is formed in an even-numbered dot formation operation, then the printer driver uses the other dot creation ratio table to convert the pixel data into 2-bit data. It should be noted that the process of converting pixel data of 256 gradations into 2-bit data based on the dot creation ratio table is the same as the process of FIG. 25, and thus will not be described.

Then, after rasterization (S106), in step S107 the printer driver sends the print data to the printer 1. The printer-side controller 60 receives the print data and then performs printing based on those print data (S202, see FIG. 11).

If halftone processing has been performed using the dot creation ratio table of FIG. 26, then five out of ten pixel data for ten pixels will be converted to "10" (2-bit data indicating a medium dot). In this case, if the drive voltage Vh of the drive pulse PS4 for forming a medium dot is higher than normal, the ink amount per ink droplet will increase and thus the image of that 10-pixel area will become darker.

Accordingly, in this embodiment, a dot creation ratio table corrected as in FIG. 29 is used. As a result, for example only four of the ten pixel data of ten pixels will be converted to "10," thereby reducing the number of pixel data that indicate a medium dot. When the printer 1 performs printing based on such print data, a medium dot will be formed in four pixels out of ten instead of five pixels out of ten as originally intended. That is, the amount of ink that is ejected per ten pixels is reduced by an amount of ink corresponding to one medium dot.

The image of the 10-pixel area therefore is lighter than when a medium dot is formed in five pixels. However, since the ink amount that is ejected per pixel area is greater when the drive voltage Vh of the drive pulse PS4 for forming medium dots is higher than normal, reducing the number of dots has the overall effect of correcting the darkness of the image of the 10-pixel area to the normal darkness.

Put differently, in the first embodiment above, the ink amount that is ejected per pixel area is adjusted, whereas in the second embodiment, the total amount of ink that is ejected to an area constituted by a plurality of pixels is adjusted.

Third Embodiment

Changing the Drive Signals During Dot Formation Operation

<Operation of the Drive Signal Generation Sections>

Figure 32:
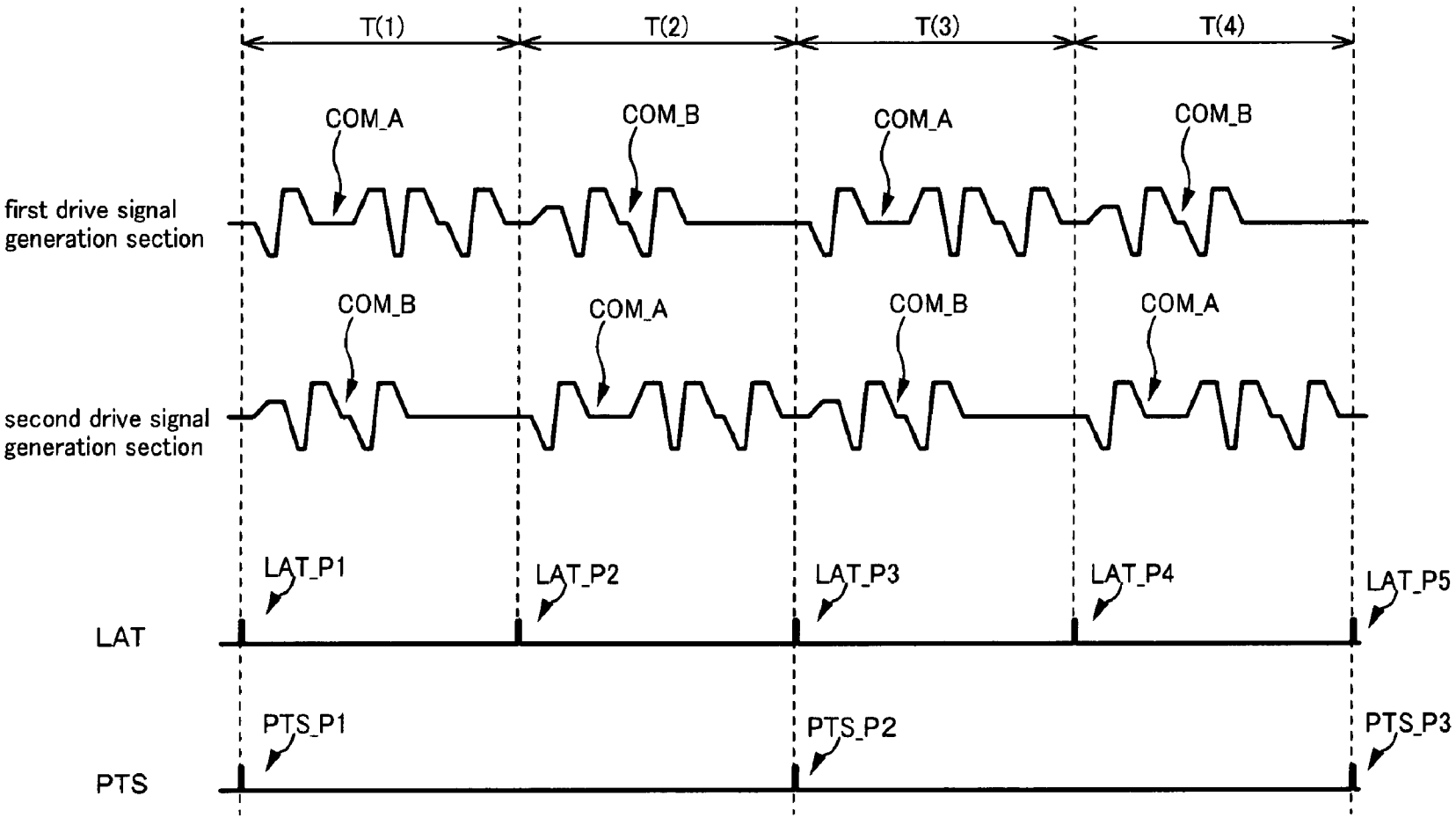
FIG. 32 is an explanatory diagram of the drive signals that are generated by the drive signal generation sections in the third embodiment.

FIG. 32 is an explanatory diagram of the drive signals that are generated by the drive signal generation sections of this embodiment. In the drawing, the detection signal PTS and the latch signal LAT are shown in order to illustrate the drive signal timing.

The detection signal PTS is a detection signal that is output from the linear encoder 51. The linear encoder 51 outputs a pulse PTS_P each time the carriage CR has moved 1/360 inch in the movement direction. This means that when the pulse PTS_P of the detection signal PTS is output, the carriage CR has moved by 1/360 inch since the pulse PTS_P immediately prior was output. The detection signal PTS is output from the linear encoder 51 to the printer-side controller 60.

The printer-side controller 60 measures the pulse period of the detection signal PTS from the linear encoder 51 and computes the time of one half of this pulse period. Then, the printer-side controller 60 outputs a pulse LAT_P as the LAT signal in synchronization with the pulse PTS_P of the detection signal PTS, and also outputs another pulse LAT_P when the time of one half of the pulse period of the detection signal PTS has elapsed since the other pulse LAT_P has been output. For example, the printer-side controller outputs a pulse LAT_P3 of the latch signal LAT based on the pulse PTS_P2 of the detection signal PTS in the drawing, and also calculates the time of one half of the pulse period of the pulse PTS_P1 and the pulse PTS_P2 of the detection signal PTS and outputs a pulse LAT_P4 after the pulse LAT_P3 of the latch signal LAT.

In the latch signal LAT that is generated in this manner, an output of the pulse LAT_P means that the carriage CR has moved approximately 1/720 inch since the pulse LAT_P immediately prior was output. Also, when the printer performs printing at 720 dpi resolution, the latch signal LAT becomes a signal that indicates that the carriage CR has moved the distance of one pixel. The ink for one pixel is ejected between pulses of the latch signal LAT. That is, the repeating period T discussed earlier is a period in which the ink for one pixel is ejected. In the drawing, the drive signals are shown for a duration of four pixels, and the period T corresponding to the n-th pixel is denoted as T(n).

In the periods T corresponding to odd-numbered pixels, the first drive signal generation section 70A generates the first drive signal COM_A and the second drive signal generation section 70B generates the second drive signal COM_B. For example, in the drawing, in the period T(1) corresponding to the first pixel and the period T(3) corresponding to the third pixel, the first drive signal generation section 70A generates the first drive signal COM_A and the second drive signal generation section 70B generates the second drive signal COM_B. Hereafter, the periods corresponding to odd-numbered pixels (e.g. period T(1) and period T(3)) are referred to as "odd pixel periods."

In the periods T corresponding to even-numbered pixels, the first drive signal generation section 70A generates the second drive signal COM_B and the second drive signal generation section 70B generates the second drive signal COM_B. For example, in the drawing, in the period T(2) corresponding to the second pixel and the period T(4) corresponding to the fourth pixel, the first drive signal generation section 70A generates the second drive signal COM_B and the second drive signal generation section 70B generates the second drive signal COM_B. Hereafter, the periods corresponding to even-numbered pixels (e.g. period T(2) and period T(4)) are referred to as "even pixel periods."

It should be noted that each time the detection signal PTS is input to the printer-side controller 60, the first drive signal generation section 70A consecutively generates the drive signals for two periods in the order of the first drive signal COM_A and then the second drive signal COM_B. Similarly, each time the detection signal PTS is input to the printer-side controller 60, the second drive signal generation section 70B consecutively generates the drive signals for two periods in the order of the second drive signal COM_B and then the first drive signal COM_A. The first drive signal generation section 70A generates the first drive signal COM_A in odd pixel periods and generates the second drive signal COM_B in even pixel periods. Likewise, the second drive signal generation section 70B generates the second drive signal COM_B in odd pixel periods and generates the first drive signal COM_A in even pixel periods.

As a result, the drive signals that are generated by the first drive signal generation section 70A and the second drive signal generation section 70B are switched each time that the ink for one pixel is ejected. In other words, in this embodiment the drive signals that are generated by the first drive signal generation section 70A and the second drive signal generation section 70B are switched per each latch signal LAT.

<Signal Lines>

Figure 33:
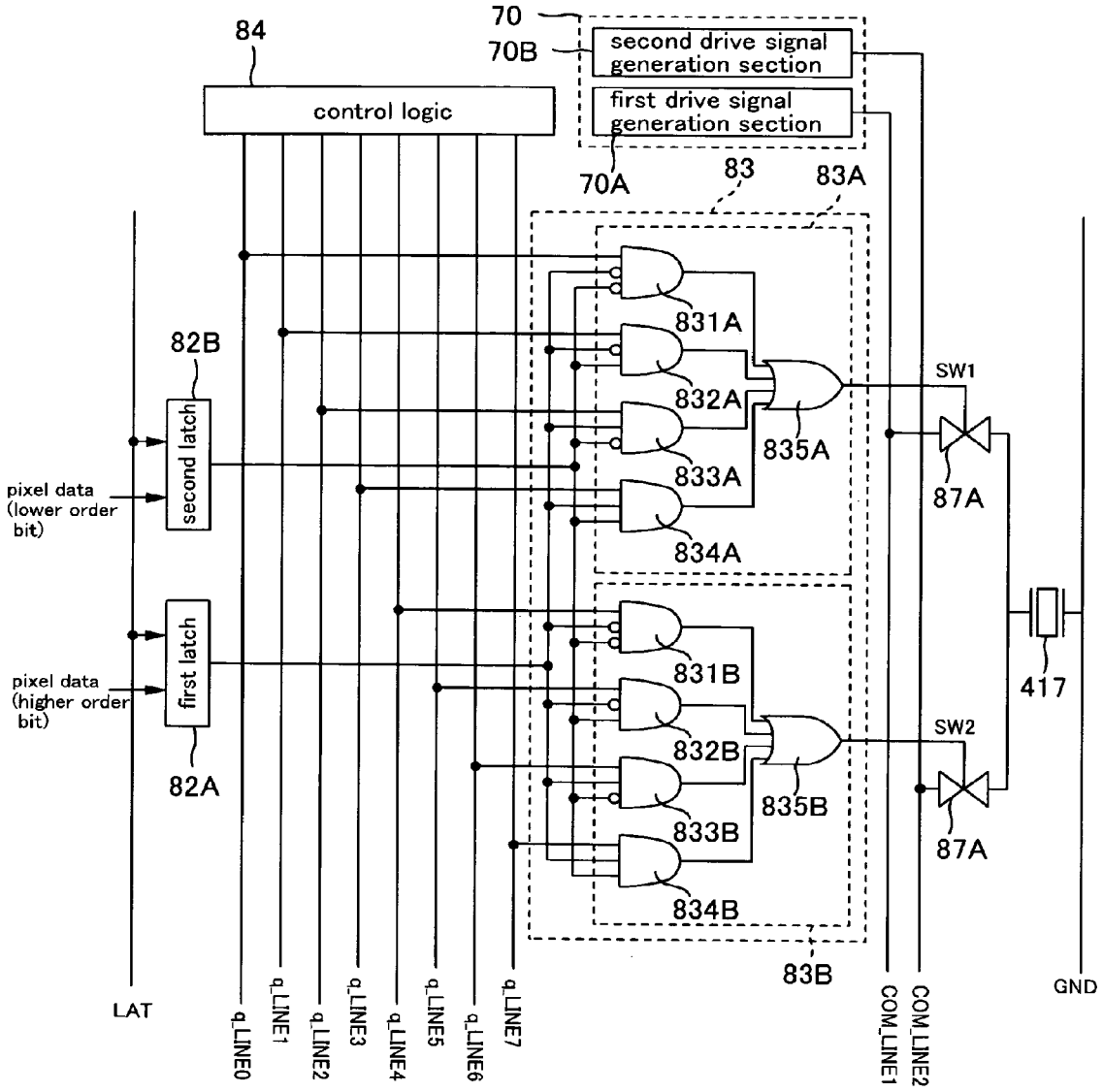
FIG. 33 is an explanatory diagram of the signal lines over which the various signals are transmitted.

FIG. 33 is an explanatory diagram of the signal lines for conveying the various signals. FIG. 34 is an explanatory diagram of the relationship between the 2-bit pixel data that is input to the decoder 83 and the first switch control signal SW1 and the second switch control signal SW2 that are output from the decoder 83.

The drive signal generation section 70 is connected to a first signal line COM_1 and a second signal line COM_2, which are signal lines for conveying the drive signals. The first signal line COM_LINE1 conveys the drive signals that are generated by the first drive signal generation section 70A, and the second signal line COM_LINE2 conveys the drive signals that are generated by the second drive signal generation section 70B. The first signal line COM_LINE1 is connected to the first switch 87A, and the second signal line COM_LINE2 is connected to the second switch 87B. Thus, if the first switch 87A is on, then the signal of the first signal line (the signal that has been output by the first drive signal generation section 70A) will be input to the piezo element 417, and if the second switch 87B is on, then the signal of the second signal line (the signal that has been output by the second drive signal generation section 70B) will be input to the piezo element 417.

The control logic 84 is connected to the waveform selection signal lines q_LINE0 to q_LINE7, which are signal lines for conveying the waveform selection signals q0 to q7 discussed above. Although described in greater detail later, the control logic 84 sends the waveform selection signal q0 or the waveform selection signal q4 to the waveform selection signal line q_LINE0 and the waveform selection signal line q_LINE4, sends the waveform selection signal q1 or the waveform selection signal q5 to the waveform selection signal line q_LINE1 and the waveform selection signal line q_LINE5, sends the waveform selection signal q2 or the waveform selection signal q6 to the waveform selection signal line q_LINE2 and the waveform selection signal line q_LINE6, and sends the waveform selection signal q3 or the waveform selection signal q7 to the waveform selection signal line q_LINE3 and the waveform selection signal line q_LINE7.

The decoder 83 is described next. The decoder 83 has a first decoder section 83A and a second decoder section 83B. The first decoder 83A has four AND gates 831A to 834A, and a singe OR gate 835A.

Each AND gate 831A to 834A of the first decoder section 83A is provided with three input terminals and one output terminal. The three input terminals are each connected to one of the waveform selection signal lines q_LINE0 to q_LINE3, the first latch circuit 82A in which the higher order bit of the pixel data is latched, and the second latch circuit 82B in which the lower order bit of the pixel data is latched. The AND gates 831A to 834A each differ in how they receive the higher order bit data and the lower order bit data of the pixel data SI. That is, the AND gate 831A receives the signal of the waveform selection signal line q_LINE0, the inverted data of the higher order bit of the pixel data SI, and the inverted data of the lower order bit of the pixel data SI. Thus, if the pixel data SI are the data [00], then the output from the AND gate 831A is in accordance with the signal of the waveform selection signal line q_LINE0. The AND gate 832A receives the signal of the waveform selection signal line q_LINE1, the inverted data of the higher order bit of the pixel data SI, and the data of the lower order bit of the pixel data SI. Thus, if the pixel data SI are the data [01], then the output from the AND gate 832A is in accordance with the waveform selection signal line q_LINE1. The AND gate 833A receives the signal of the waveform selection signal line q_LINE2, the data of the higher order bit of the pixel data SI, and the inverted data of the lower order bit of the pixel data SI. Thus, if the pixel data SI are the data [10], then the output from the AND gate 832A is in accordance with the signal of the waveform selection signal line q_LINE2. The AND gate 834A receives the signal of the waveform selection signal line q_LINE3, the data of the higher order bit of the pixel data SI, and the data of the lower order bit of the pixel data SI. Thus, if the pixel data SI are the data [11], then the output from the AND gate 832A is in accordance with the signal of the waveform selection signal line q_LINE3.

The OR gate 835A of the first decoder section 83A is provided with four input terminals and one output terminal. Its four input terminals receive the output from the AND gates 831A to 834A. The OR gate 835A outputs the first switch control signal SW1. That is, it selects the signal from the waveform selection signal line q_LINE0 to the waveform selection signal line q_LINE3 that corresponds to the latched pixel data SI and outputs this as the first switch control signal SW1.

The second decoder section 83B has substantially the same configuration as the first decoder section. The OR gate 835B of the second decoder section 83B selects the signal from the waveform selection signal lines q_LINE4 to q_LINE7 that corresponds to the latched pixel data SI, and outputs this as the second switch control signal SW2.

That is, the decoder 83 selects the signal from the waveform selection signal lines q_LINE0 to q_LINE3 that corresponds to the latched pixel data SI, and outputs this as the first switch control signal SW1. The decoder 83 also selects the signal from the waveform selection signal lines q_LINE4 to q_LINE7 that corresponds to the latched pixel data SI, and outputs this as the second switch control signal SW1.

<Signals that Travel Down the Signal Lines>

FIG. 35 is an explanatory diagram of the signals that travel down the signal lines.

As described above, the first drive signal generation section 70A generates the first drive signal COM_A in the odd pixel periods and generates the second drive signal COM_B in the even pixel periods. Also, the second drive signal generation section 70B generates the second drive signal COM_B in the odd pixel periods and generates first drive signal COM_A in the even pixel periods.

Thus, the first drive signal COM_A is conveyed to the first signal line COM_LINE1 in the odd pixel periods and the second drive signal COM_B is conveyed thereto in the even pixel periods. Likewise, the second drive signal COM_B is conveyed to the second signal line COM_LINE2 in the odd pixel periods and the first drive signal COM_A is conveyed thereto in the even pixel periods.

Incidentally, since switching the drive signals that are transmitted to the first signal line COM_LINE1 and the second signal line COM_LINE2 in this way also switches the drive signals that are input to the first switch 87A and the second switch 87B, it is also necessary to switch the switch control signal SW1 and the switch control signal SW2. (If the switch signals are not switched, then, for example, in the case of the pixel data 01 (small dot), the drive pulse PS5 of the second drive signal COM_B will be applied instead of the drive pulse PS2 of the first drive signal COM_A, and this will lead to the ejection of an amount of ink that does not correspond to a normal small dot.)

Accordingly, the control logic 84 changes the signal that is output to the waveform selection signal lines in conjunction with this switch in the drive signals. Specifically, the control logic 84 outputs the waveform selection signal q0 to the waveform selection signal line q_LINE0 in the odd pixel periods and outputs the waveform selection signal q4 to the waveform selection signal line q_LINE0 in the even pixel periods. Similarly, the control logic 84 outputs the waveform selection signal q1 to the waveform selection signal line q_LINE1 in the odd pixel periods and outputs the waveform selection signal q5 to the waveform selection signal line q_LINE1 in the even pixel periods. The control logic 84 outputs the waveform selection signal q2 to the waveform selection signal line q_LINE2 in the odd pixel periods and outputs the waveform selection signal q6 to the waveform selection signal line q_LINE2 in the even pixel periods. The control logic 84 outputs the waveform selection signal q3 to the waveform selection signal line q_LINE3 in the odd pixel periods and outputs the waveform selection signal q7 to the waveform selection signal line q_LINE3 in the even pixel periods. The control logic 84 outputs the waveform selection signal q4 to the waveform selection signal line q_LINE4 in the odd pixel periods and outputs the waveform selection signal q0 to the waveform selection signal line q_LINE4 in the even pixel periods. The control logic 84 outputs the waveform selection signal q5 to the waveform selection signal line q_LINE5 in the odd pixel periods and outputs the waveform selection signal q1 to the waveform selection signal line q_LINE5 in the even pixel periods. The control logic 84 outputs the waveform selection signal q6 to the waveform selection signal line q_LINE6 in the odd pixel periods and outputs the waveform selection signal q2 to the waveform selection signal line q_LINE6 in the even pixel periods. The control logic 84 outputs the waveform selection signal q7 to the waveform selection signal line q_LINE7 in the odd pixel periods and outputs the waveform selection signal q3 to the waveform selection signal line q_LINE7 in the even pixel periods. In this way, in conjunction with the switch in drive signals COM, the waveform selection signals q0 to q3 and the waveform selection signals q4 to q7 that are output by the control logic 84 are switched.

Through the above process, dots that correspond to the pixel data can be formed even when the drive signals COM have been switched.

<Manner in which Dots are Formed>

To describe the effects of the present embodiment, the manner in which dots are formed is described next. In the following description, medium dots are the only dots that will be formed.

Figure 36A:
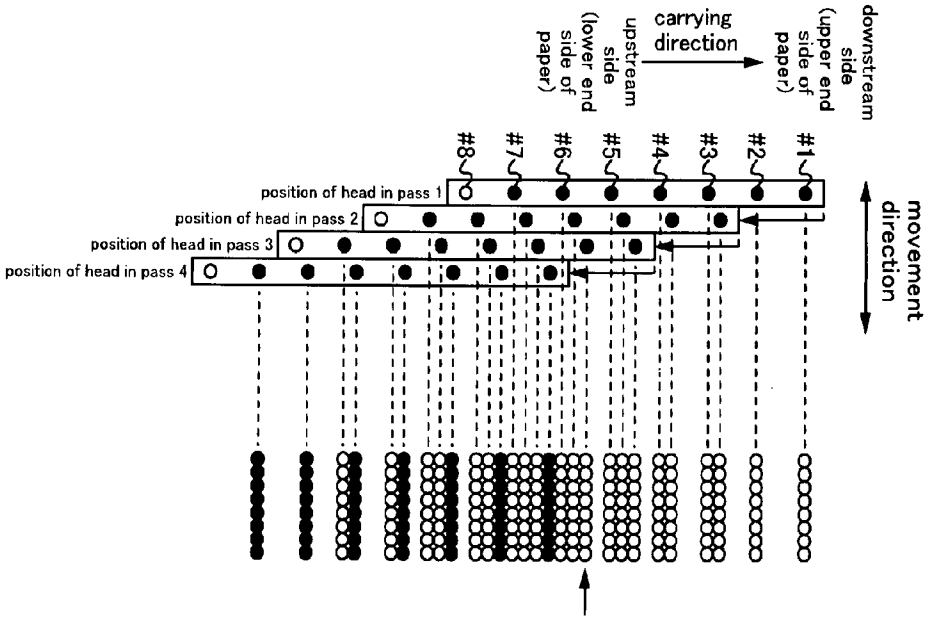
FIG. 36A and FIG. 36B are explanatory diagrams of how dots are formed when there are no discrepancies among the properties of the two drive signal generation sections.
Figure 36B:
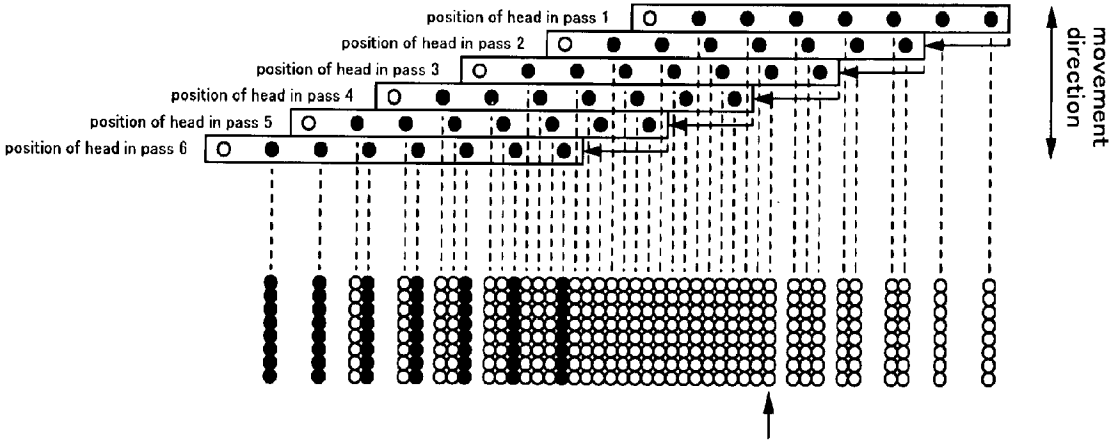

FIG. 36A and FIG. 36B are explanatory diagrams of the manner in which dots are formed when there are no discrepancies in the properties of the two drive signal generation sections. FIG. 36A shows the position of the nozzle row in passes 1 to 4 and how the dots are formed, and FIG. 36B shows the position of the nozzle row in passes 1 to 6 and how the dots are formed. It should be noted that a pass refers to the operation in which ink is ejected from moving nozzles in order to form dots (i.e., the dot formation operation). Pass n means the n-th dot formation operation.

For the sake of convenience, only one nozzle row of the nozzle rows that are provided for each color is shown. The nozzle row is provided with eight nozzles (nozzle #1 to nozzle #8), but in practice it has 180 nozzles. The nozzles shown as solid circles in the drawing are nozzles that can eject ink, and the nozzles shown as empty circles are nozzles that cannot eject ink. For the sake of convenience, in the illustration the nozzle row is shown moving with respect to the paper, but the drawing shows the relative position of the nozzle row and the paper, and in practice the paper is moving in the carrying direction. Further, for the brevity of description, the nozzles are shown forming only a small number of dots (empty circles in the drawing), but in practice, ink droplets are intermittently ejected from the nozzles, which are moving in the movement direction, and thus many dots are formed side by side in the movement direction. These rows of dots are also called raster lines. The dots indicated by solid circles are formed in the final pass, and the dots indicated by empty circles are formed in the passes prior to that.

Here, the nozzle pitch (spacing between nozzles) is 1/180 inch. The dot pitch (spacing between dots) is 1/720 inch. Thus, the spacing between raster lines also is 1/720 inch. It should be noted that in this print mode, the pass and carrying operations are alternately repeated to continuously form raster lines side by side in the carrying direction in such a manner that, in a single pass, raster lines that are not recorded are formed interposed between the raster lines. Here, three raster lines are interposed between the raster lines that are formed in a single pass.

In a case where there are no discrepancies among the properties of the two drive signal generation sections, all of the medium dots that are formed are the same size. However, if there are discrepancies in the properties of the two drive signal generation sections, then there is a difference between the size of the medium dots that are formed when the second drive signal generation section 70B generates the second drive signal COM_B and the size of the medium dots that are formed when the first drive signal generation section 70A generates the second drive signal COM_A. In the description that follows, the former is larger than the latter.

Figure 37:
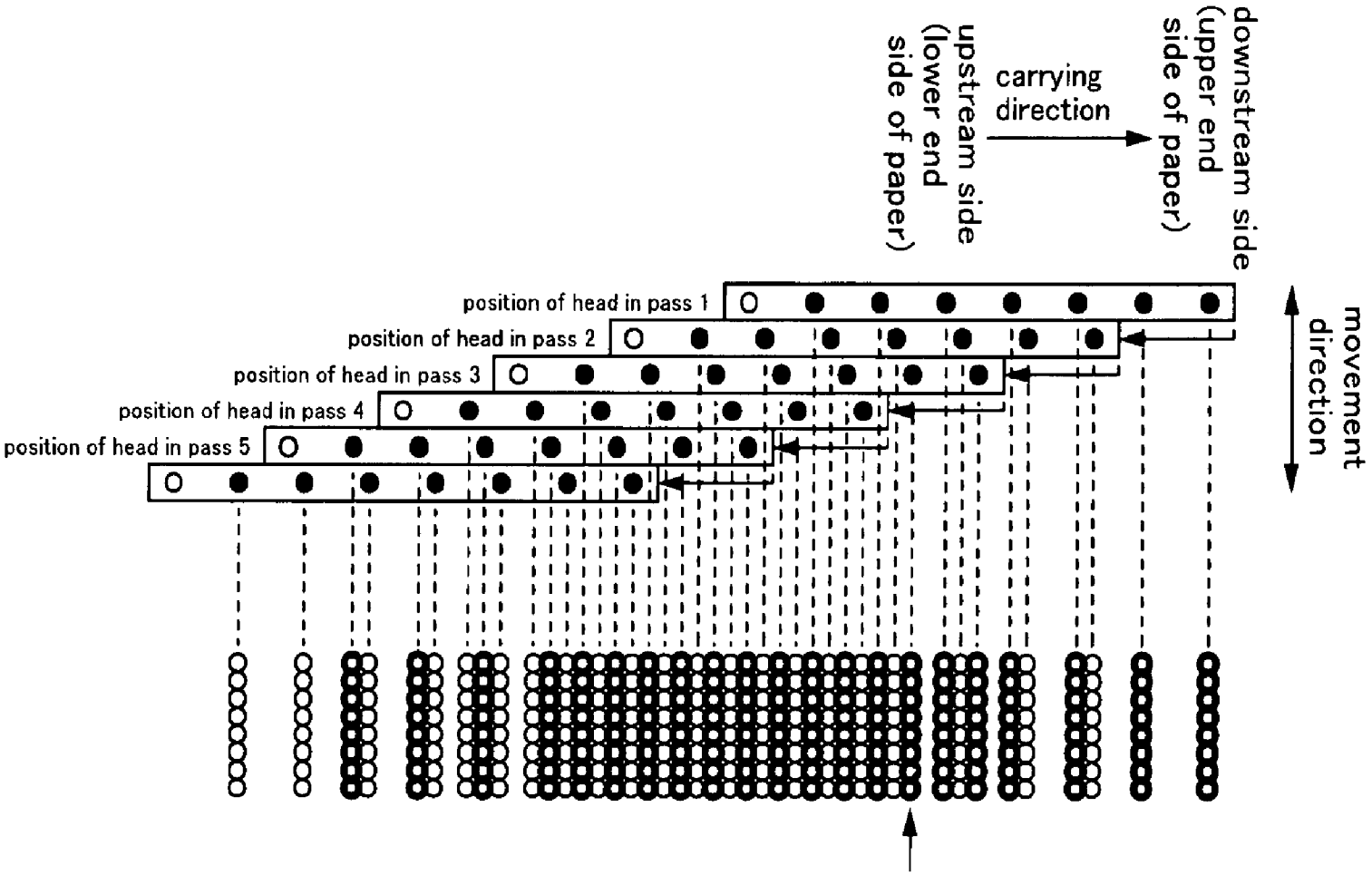
FIG. 37 is an explanatory diagram of how dots are formed when there are discrepancies among the properties of the two drive signal generation sections and the drive signals are switched each dot formation operation.

FIG. 37 is an explanatory diagram of dot formation in a case where there are discrepancies among the properties of the two drive signal generation sections and the drive signals are switched per each dot formation operation. In the drawing, the medium dots that are formed large (the medium dots that are formed when the second drive signal generation section 70B generates the second drive signal COM_B) are indicated by the thick lines.

In FIG. 37, the drive signals are switched per each dot formation operation (pass). Here, the second drive signal generation section 70B generates the second drive signal COM_B in the odd-numbered passes and the first drive signal generation section 70A generates the second drive signal COM_B in the even-numbered passes. The result here is that the raster lines alternate in thickness. This causes a striped pattern in the movement direction.

Figure 38A:
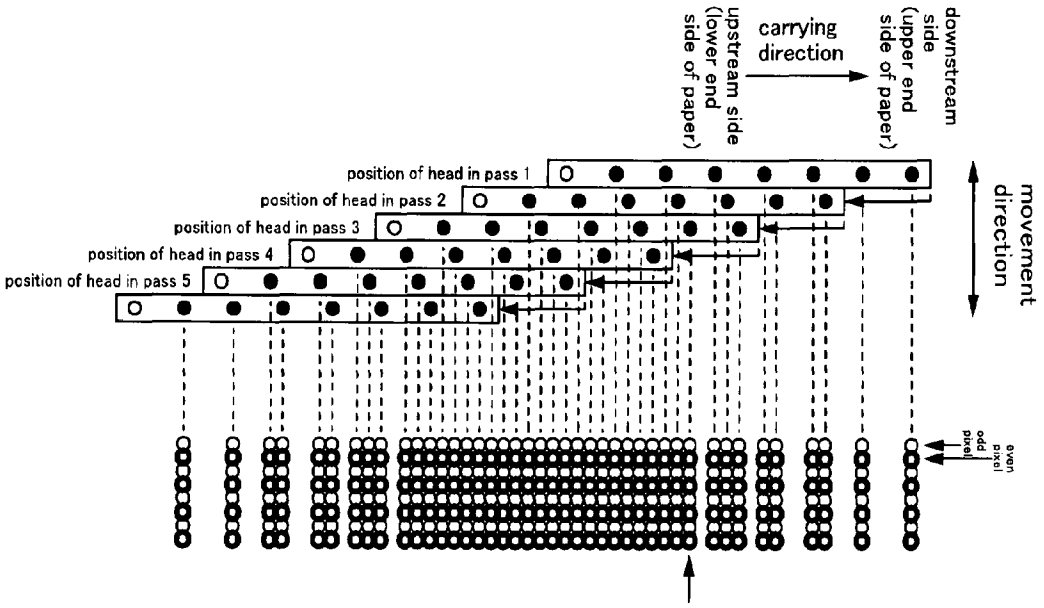
FIG. 38A is an explanatory diagram of how dots are formed when there are discrepancies among the properties of the two drive signal generation sections and the drive signals are switched as in the third embodiment.

FIG. 38A is an explanatory diagram of dot formation in a case where there are discrepancies among the properties of the two drive signal generation sections and the drive signals are switched according to the present embodiment. In this embodiment, the drive signals are switched during a single dot formation operation for forming a raster line. Specifically, the second drive signal generation section 70B generates the second drive signal COM_B in odd pixel periods and the first drive signal generation section generates the second drive signal COM_B in even pixel periods.

According to the method of switching the drive signals in the present embodiment, each raster line is made of alternating dots indicated by the thin-line circles and dots indicated by the thick-line circles side by side. Each raster line thus has the same thickness, and this allows the occurrence of stripes in the movement direction to be inhibited.

Figure 38B:
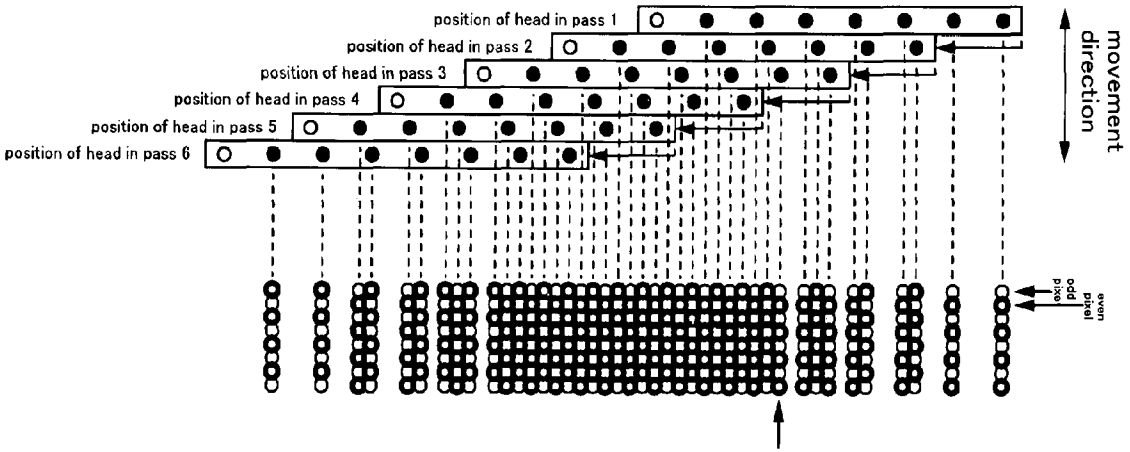
FIG. 38B is an explanatory diagram of an improved example.

FIG. 38B is an explanatory diagram of an improved example of the drive signal switching of the present embodiment. In this improved example, the order in which the drive signal generation sections generate the drive signals is changed per each dot formation operation (pass) for forming the raster lines, in addition to the drive signals being changed during each dot formation operation. Specifically, in odd-numbered passes, the second drive signal generation section 70B generates the second drive signal COM_B in the odd pixel periods and the first drive signal generation section 70A generates the second drive signal COM_B in the even pixel periods. On the other hand, in even-numbered passes, the first drive signal generation section 70A generates the second drive signal COM_B in the odd pixel periods and the second drive signal generation section generates the second drive signal COM_B in the even pixel periods.

The drive signal switching in this improved example leads to raster lines that are the same thickness, and this allows the formation of a striped pattern in the movement direction to be inhibited. Additionally, with the method of drive signal switching according to this improved example, the medium dots that are formed large (the dots indicated by the thick line in the drawing) are not adjacent in the carrying direction. Thus, compared to the case of FIG. 38A, the image quality is more uniform, and this increases the image quality.

Other Embodiments

The foregoing embodiments primarily describe a printer, but it goes without saying that they also include the disclosure of a printing apparatus, a recording apparatus, a liquid ejection apparatus, a printing method, a recording method, a liquid ejection method, a printing system, a recording system, a computer system, a program, a storage medium on which a program is stored, a display screen, a screen display method, and a printed article manufacturing method.

Furthermore, printers, etc. were described in the foregoing embodiments as examples of the invention, but the foregoing embodiments are for the purpose of elucidating the present invention, and are not to be interpreted as limiting the invention. The invention can of course be altered and improved without departing from the gist thereof, and includes equivalents. In particular, the embodiments mentioned below also are within the scope of the invention.

<Drive Signals>

In the foregoing embodiments, the first waveform section SS11*a* through the third waveform section SS13*a* of the first drive signal COM_A and the first waveform section SS21*a* through the third waveform section SS23*a* of the second drive signal COM_B are set to the same duration. Accordingly, the first change signal CH_A for the first drive signal COM_A and the second change signal CH_B for the second drive signal COM_B become H level at the same time. The drive signals and the change signals are not limited to this, however.

Figure 30:
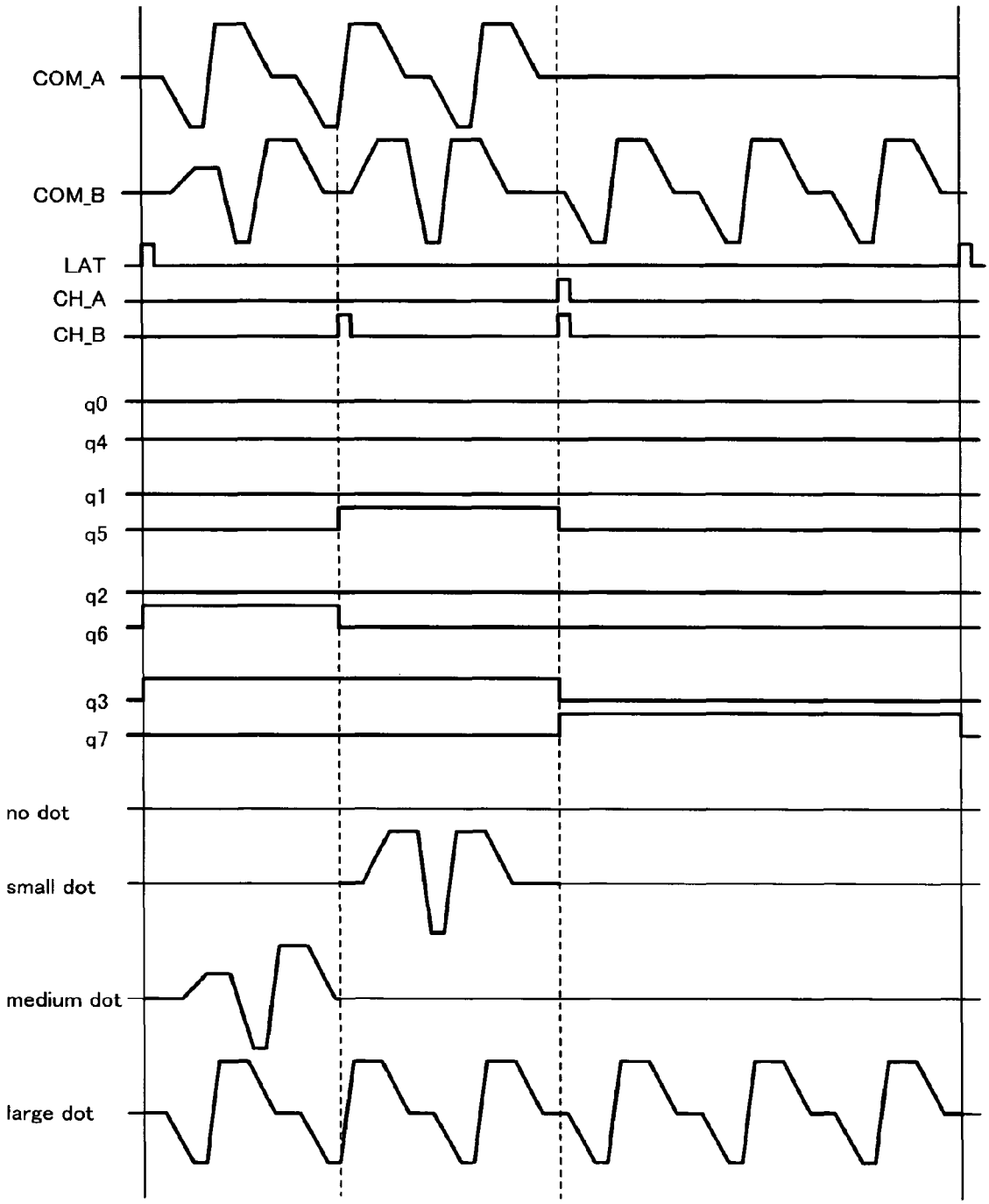
FIG. 30 is an explanatory diagram of a separate embodiment of the various signals.

FIG. 30 is an explanatory diagram of another embodiment of the various signals. The drawing shows the first drive signal COM_A, the second drive signal COM_B, the head control signals (LAT signal, first change signal CH_A, second change signal CH_B), the waveform selection signals q0 to q7, and the signal that is applied to the piezo element. In this embodiment, the first change signal CH_A and the second change signal CH_B do not become H level at the same time. The waveform selection signals q0 to q3 are generated by the control logic 84 based on the latch signal LAT and the first change signal CH_A. The waveform selection signals q4 to q7 are generated by the control logic 84 based on the latch signal LAT and the second change signal CH_A. A signal that corresponds to the pixel data is accordingly applied to the piezo element, and this leads to the formation of a dot.

In this embodiment, when small dots or medium dots are formed, the generation of heat is concentrated on the transistor pair of the drive signal generation section that generates the second drive signal COM_B. Thus, if the drive signals are switched in this embodiment as well, then the transistor pair 721A of the first drive signal generation section 70A and the transistor pair 721B of the second drive signal generation section 70B generate an equivalent amount of heat.

It should be noted that in this embodiment, if large dots are formed, then the transistor pair 721A of the first drive signal generation section 70A and the transistor pair 721B of the second drive signal generation section 70B will generate an equivalent amount of heat even if the drive signals are not switched. Thus, it is also possible to not switch the signals when printing a text image, which primarily is made of large dots, and to switch the drive signals when printing photographic images, which primarily are made of small dots and medium dots. That is, in this embodiment it is also possible for the CPU 62 to determine whether or not to switch the drive signals depending on the type of the image to be printed.

<Drive Signal Switch Timing>

In the third embodiment discussed above, the drive signals that are generated by the drive signal generation sections are switched per each latch signal LAT. In other words, in the third embodiment, the drive signal that is generated by each drive signal generation section is switched each time the carriage CR moves by 1/720 inch, which corresponds to the size of one pixel. However, even if not at this timing, as long as the drive signals are switched at some point during the dot formation operation for forming raster lines, the drop in image quality due to differences in the thickness of the raster lines can be inhibited.

Figure 39:
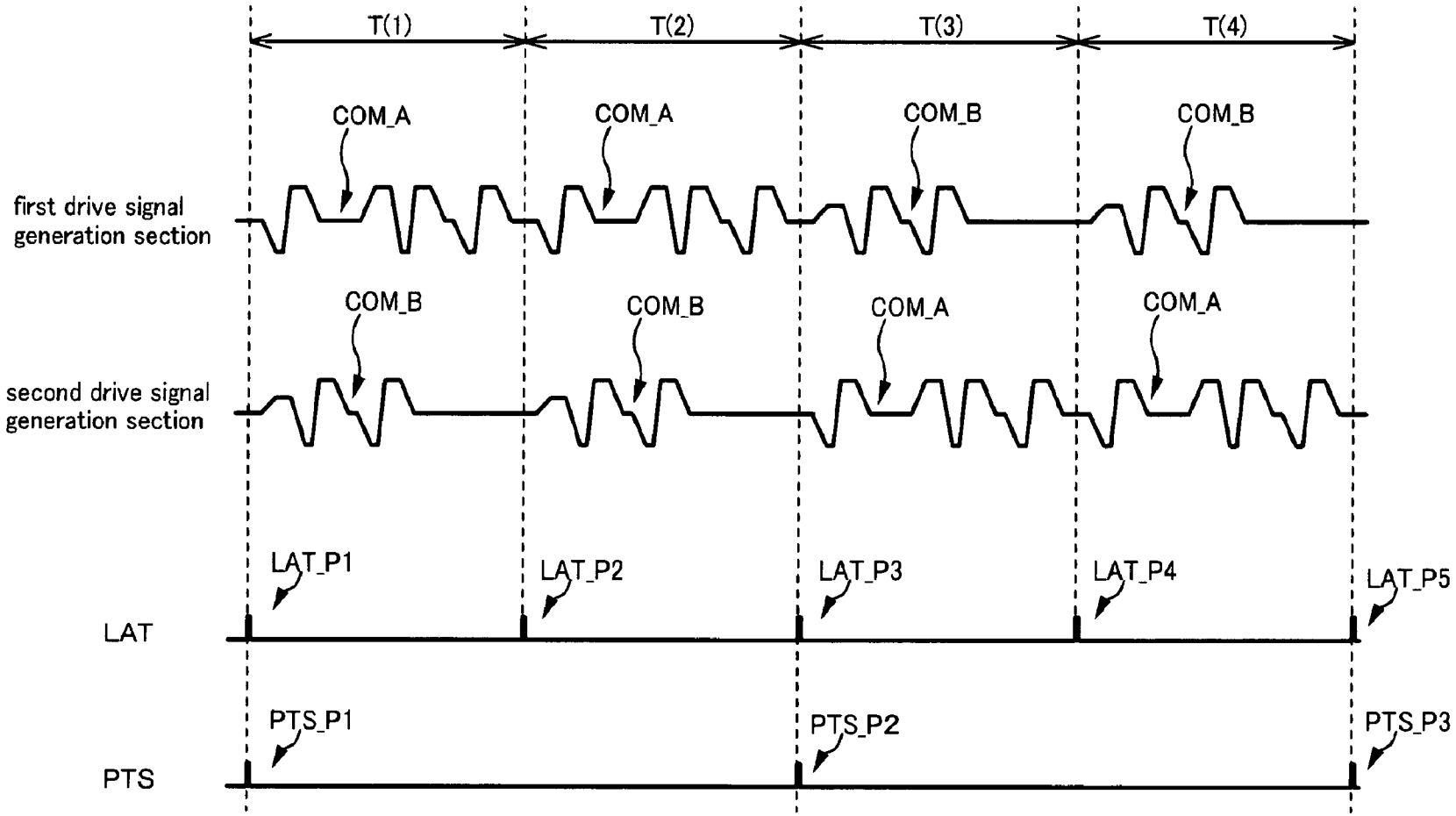
FIG. 39 is an explanatory diagram of the drive signals that are generated by the drive signal generation sections in a separate embodiment.

FIG. 39 is an explanatory diagram of the drive signals that are generated by the drive signal generation sections according to another embodiment. As shown here, it is also possible for the drive signals that are generated by the drive signal generation sections to be switched per each detection signal PTS. That is, it is also possible for the drive signals that are generated by the first drive signal generation section 70A and the second drive signal generation section 70B to be switched each time that the carriage CR has moved by 1/360 inch, which corresponds to the area of two pixels.

Figure 40:
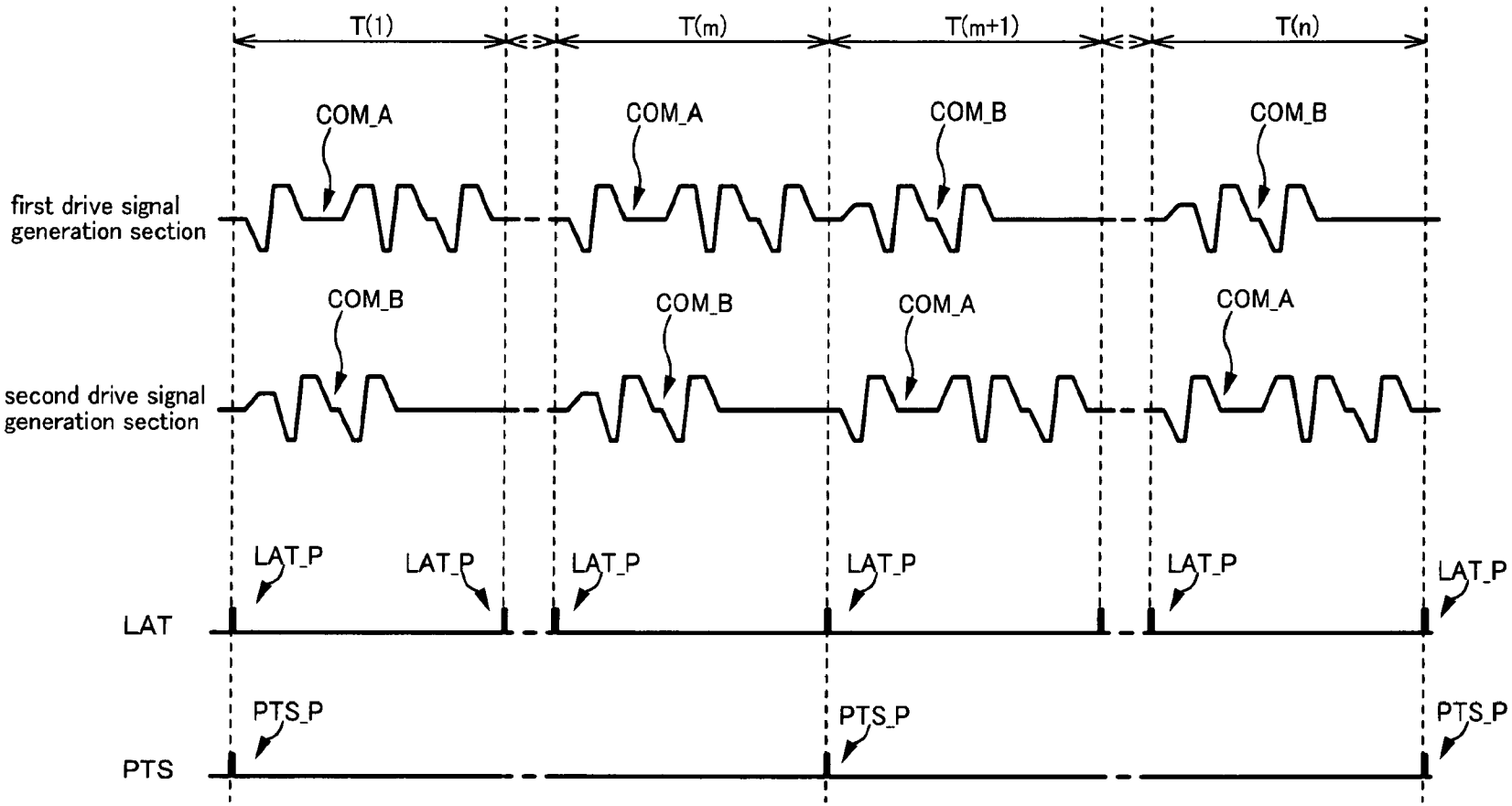
FIG. 40 is an explanatory diagram of the drive signals that are generated by the drive signal generation sections in another separate embodiment.

FIG. 40 is an explanatory diagram of the drive signals that are generated by the drive signal generation section in a yet further embodiment. Even if the drive signals are not repeatedly switched in a periodic manner as in the foregoing embodiment, as long as the drive signals are switched at some point during the dot formation operations, it is possible to inhibit a drop in image quality due to differences in the thickness of the raster lines.

<Drive Signal Generation Sections>

In the foregoing embodiments, there were two drive signal generation sections. This is not a limitation, however. The drive signal generation circuit can also have more than two drive signal generation sections. In this case, at a certain timing, the first drive signal generation section 70A generates the first drive signal COM_A, the second drive signal generation section 70B generates the second drive signal COM_B, and a third drive signal generation section generates a third drive signal, and at a separate timing, the first drive signal generation section 70A generates the second drive signal COM_B, the second drive signal generation section 70B generates the first drive signal COM_A, and a third drive signal generation section generates the third drive signal. The drive signals are generated by the first drive signal generation section and the second drive signal generation section in the same way here as in the foregoing embodiments, and thus the same effects as those of the foregoing embodiments are obtained.

<Switching the Drive Signals>

In the foregoing embodiments, at a certain timing the first drive signal generation section 70A generates the first drive signal COM_A and the second drive signal generation section 70B generates the second drive signal COM_B, and at a separate timing the first drive signal generation section 70A generates the second drive signal COM_B and the second drive signal generation section 70B generates the first drive signal COM_A. That is, in the foregoing embodiments, the drive signals that are generated by the first drive signal and the drive signals that are generated by the second drive signal are switched.

However, it is not always necessary to switch the drive signals. For example, if a third drive signal generation section is provided separately from the first drive signal generation section 70A and the second drive signal generation section, then it is also possible that at a certain timing the first drive signal generation section 70A generates the first drive signal COM_A, the second drive signal generation section 70B generates the second drive signal COM_B, and a third drive signal generation section generates a third drive signal, and at a separate timing, the first drive signal generation section 70A generates the second drive signal COM_B, the second drive signal generation section 70B generates the third drive signal, and the third drive signal generation section generates the first drive signal COM_A.

In this way, even if the drive signals that are generated are rotated among three drive signal generation sections, the drive signal generation section that generates the first drive signal is changed like in the foregoing embodiments. Thus, for example when forming small dots, before this change the first drive signal generation section 70A generates the first drive signal COM_A and thus power is consumed by the first drive signal generation section 70A, and after the change, the second drive signal generation section 70B generates the first drive signal COM_A and thus power is consumed by the second drive signal generation section 70B. Consequently, changing the drive signal generation section that generates the first drive signal COM_A results in the first drive signal generation section 70A and the second drive signal generation section 70B generating heat equally.

In a case where the drive signals that are generated are rotated among three drive signal generation sections and there are discrepancies among the properties of the drive signal generation sections, a high quality print image can be obtained as long as when the first drive signal generation section 70A generates the first drive signal COM_A, the ink amount is corrected based on the small dot adjustment value that is associated with the first drive signal generation section 70A, and when the second drive signal generation section 70B generates the first drive signal COM_A, the ink amount is corrected based on the small dot adjustment value that is associated with the second drive signal generation section 70B.

Further, in a case where the drive signals that are generated are rotated among three drive signal generation sections and there are discrepancies among the properties of the drive signal generation sections, by changing the drive signal generation section that generates the first drive signal COM_A during the dot formation operation, there will be a mix of small dots of different sizes, and thus the image quality becomes uniform and is improved.

<Regarding the Printing Apparatus>

Figure 31A:
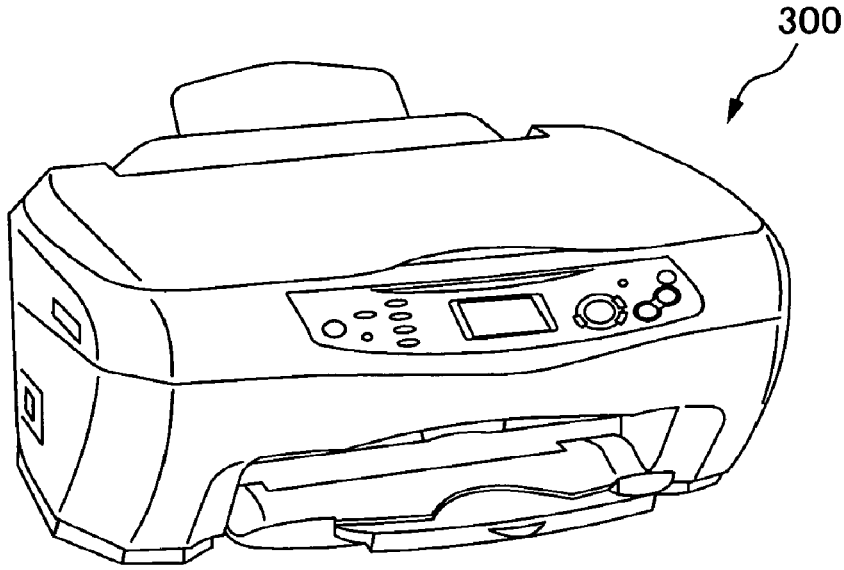
FIG. 31A is a perspective view for describing the external appearance of the SPC compound device.
Figure 31B:
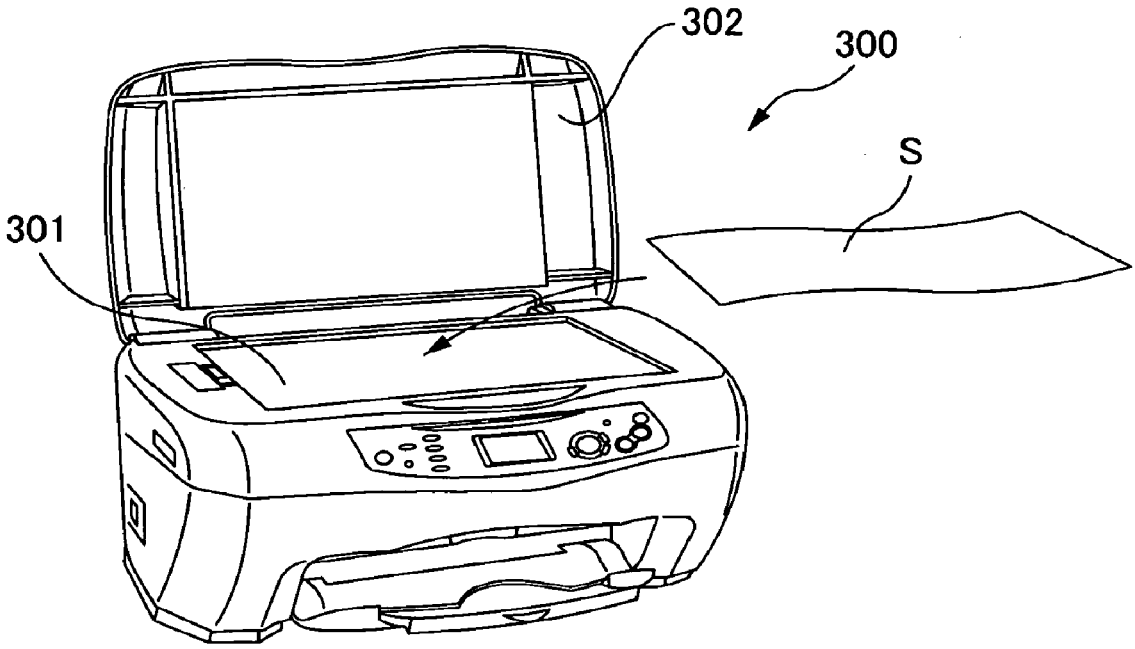
FIG. 31B is a perspective view for describing the SPC compound device when the original document platen cover is open.

The printer 1 described above was dedicated to carrying out printing of an image. However, the printing apparatus is not limited to the printer 1. Here, FIG. 31A is a perspective view for describing the external appearance of a scanner-printer-copier compound device 300 (hereinafter, also referred to as SPC compound device). FIG. 31B is a perspective view for describing the SPC compound device 300 when an original document platen cover 302 is open. The SPC compound device 300 has a scanner function for reading the darkness of the image on the original document, a printer function of printing an image on a medium such as paper based on image data, and a local copier function of printing an image that has been input through the scanner function onto paper, etc. That is, the SPC compound device 300 therein incorporates an image reading section for reading the darkness of an image printed on a medium. The image reading section is equivalent to the read carriage 202 of the scanner device 200 discussed earlier. The SPC compound device 300 also is encompassed by the printing apparatus of the invention. With the SPC compound device 300, a paper S on which adjustment patterns CP have been printing is placed on the original document platen glass 301 and the SPC compound device 300 reads the darkness of the adjustment patterns CP. With this configuration, adjustment is performed based on the darkness of the adjustment patterns that have been read by the image reading section, and thus adjustment can be performed after the printing apparatus has been shipped as well.

<Regarding the Printer>

A printer is described in the above embodiments, but this is not a limitation. For example, it is also possible to adopt the same technology as that of the embodiments to various types of recording apparatuses that employ inkjet technology, such as a color filter manufacturing device, a dyeing device, a fine processing device, a semiconductor manufacturing device, a surface processing device, a three-dimensional shape forming machine, a liquid vaporizing device, an organic EL manufacturing device (particularly a macromolecular EL manufacturing device), a display manufacturing device, a film formation device, and a DNA chip manufacturing device, for example. The methods and the manufacturing of these also fall within the scope of application. Even when the present technology is adopted to such fields, there is the feature that liquid can be directly ejected (written) to the target object, and thus a reduction in material, process steps, and costs can be achieved over conventional implementations.

<Regarding the Ink>

Since the foregoing embodiments were embodiments of a printer, a dye ink or a pigment ink was ejected from the nozzles. However, the liquid that is ejected from the nozzles is not limited to such inks. For example, it is also possible to eject from the nozzles a liquid (including water) including metallic material, organic material (particularly macromolecular material), magnetic material, conductive material, wiring material, film-formation material, electronic ink, processing liquid, and genetic solution. A reduction in material, process steps, and costs can be achieved if such liquid is directly ejected toward a target object.

<Regarding the Nozzles>

In the foregoing embodiments, ink was ejected using piezoelectric elements. However, the method for ejecting the liquid is not limited to this. It is also possible to employ other methods as well, including the method of generating bubbles in the nozzles using heat.

In Summary (1-1) The printer described above (one example of the liquid ejection apparatus) has piezo elements 417 (one example of the elements) that are driven in order to form dots, a first drive signal generation section 70A and a second drive signal generation section 70B that generate drive signals COM for driving the piezo elements 417, and a controller that is constituted by a printer-side controller 60 and a head controller HC.

The printer-side controller 60 inputs DAC values to the first drive signal generation section 70A and the second drive signal generation section 70B to cause the first drive signal generation section 70A and the second drive signal generation section 70B to generate drive signals. For example, when dots are to be formed in a certain dot formation operation (S30, see FIG. 11), the printer-side controller 60 causes the first drive signal generation section 70A to generate the first drive signal COM_A and causes the second drive signal generation section 70B to generate the second drive signal COM_B.

Here, if a small dot is to be formed, then only the drive pulse PS2 of the first drive signal COM_A that is generated by the first drive signal generation section 70A is applied to the piezo element 417 (see FIG. 9). Thus, when forming a small dot, only the first drive signal generation section 70A, which generates the first drive signal COM_A, consumes power, and the second drive signal generation section 70B, which generates the second drive signal COM_B, does not consume power (see FIG. 13). In this way, the power consumption of the first drive signal generation section 70A and the power consumption of the second drive signal generation section 70B are different when dots of a predetermined size are formed.

This difference in power consumption equates to a difference in the amount of heat generated. Thus, when the first drive signal generation section 70A continues to generate the first drive signal COM_A and the second drive signal generation section 70B continues to generate the second drive signal COM_B, heat will tend to be more concentrated on the first drive signal generation section COM_A than the second drive signal generation section 70B.

Accordingly, when dots are to be formed in another dot formation operation, the printer-side controller 60 of the printing apparatus switches the drive signals COM that are generated by the first drive signal generation section 70A and the second drive signal generation section 70B to cause the first drive signal generation section 70A to generate the second drive signal COM_B and cause the second drive signal generation section 70B to generate the first drive signal COM_A.

Thus, when forming small dots, for example, power is consumed in only the second drive signal generation section 70B, which generates the first drive signal COM_A, and the second drive signal generation section 70B generates more heat than the first drive signal generation section 70A. When the heat that is generated before and after the drive signals are switched is taken as a whole, the first drive signal generation section 70A and the second drive signal generation section 70B generate an equal amount of heat.

(1-2) In the embodiment, at a certain timing the first drive signal generation section 70A generates the first drive signal COM_A and the second drive signal generation section 70B generates the second drive signal COM_B, and at a separate timing the first drive signal generation section 70A generates the second drive signal COM_B and the second drive signal generation section 70B generates the first drive signal COM_A. That is, according to the foregoing embodiment, the drive signal that is generated by the first drive signal and the drive signal that is generated by the second drive signal are switched. Thus, the first drive signal generation section 70A and the second drive signal generation section 70B generate heat equally.

It should be noted that it is also possible for the drive signal generation circuit to have more than two drive signal generation sections, and for example can have three drive signal generation sections. In this case, at a certain timing the first drive signal generation section 70A generates the first drive signal COM_A, the second drive signal generation section 70B generates the second drive signal COM_B, and the third drive signal generation section generates a third drive signal, and at a separate timing the first drive signal generation section 70A generates the second drive signal COM_B, the second drive signal generation section 70B generates the first drive signal COM_A, and the third drive signal generation section generates the third drive signal. The drive signals that are generated by the first drive signal generation section and the second drive signal generation section are switched in this case as well, and thus the same effects as in the embodiment described above are achieved.

(1-3) In the above embodiment, the drive signal that is generated by the first drive signal and the drive signal that is generated by the second drive signal are switched, but it is not absolutely necessary that the drive signals are switched. For example, if a third drive signal generation section is provided in addition to the first drive signal generation section 70A and the second drive signal generation section 70B, then it is also possible that at a certain timing the first drive signal generation section 70A generates the first drive signal COM_A, the second drive signal generation section 70B generates the second drive signal COM_B, and the third drive signal generation section generates a third drive signal, and at a separate timing the first drive signal generation section 70A generates the second drive signal COM_B, the second drive signal generation section 70B generates the third drive signal, and the third drive signal generation section generates the first drive signal COM_A. Thus, the drive signal generation sections will generate an equal amount of heat even when the drive signals that are generated are rotated among three drive signal generation sections.

(1-4) The above printer alternately repeats a dot formation operation of forming dots on paper (an example of the medium) (S30, see FIG. 11), and a carrying operation of carrying the paper (S40). Each dot formation operation the printer-side controller 60 switches the drive signals COM that are generated by the first drive signal generation section 70A and the second drive signal generation section 70B. For example, when the first drive signal generation section 70A generates the first drive signal COM_A and the second drive signal generation section 70B generates the second drive signal COM_B in a certain dot formation operation, then the first drive signal generation section 70A will generate the second drive signal COM_B and the second drive signal generation section 70B will generate the first drive signal COM_A in the next dot formation operation.

Thus, the first drive signal generation section 70A and the second drive signal generation section 70B generate an equal amount of heat regardless of the image that is printed.

(1-5) It is not absolutely necessary that the printer-side controller switches the drive signals COM each dot formation operation. For example, since the printer prints an image on a sheet of paper by repeating the dot formation operation a plural number of times, it is also possible for the printer-side controller 60 to switch the drive signals COM that are generated by the first drive signal generation section 70A and the second drive signal generation section 70B during printing of the image to the paper.

By doing this, the first drive signal generation section 70A and the second drive signal generation section 70B generate an equal amount of heat. However, in a case where there are two different types of images printed to a single sheet of paper, then there is a possibility that heat will be generated predominantly in one of the drive signal generation sections if the timing at which the drive signals COM are switched comes after one of the images has been printed but before the next image is printed.

It should be noted that even if the drive signals are changed while the image is printed on the paper, it is not absolutely necessary that the drive signals that are generated by the two drive signal generation sections are switched. For example, if the drive signals are changed while printing the image on the paper, then it is also possible to rotate the drive signals that are generated among three drive signal generation sections.

(1-6) It is not absolutely necessary that the printer-side controller switches the drive signals COM while printing a single sheet of paper. Since the above printer can print a plurality of sheets of paper in a continuous manner, it is also possible for the printer-side controller 60 to switch the drive signals COM that are generated by the first drive signal generation section 70A and the second drive signal generation section 70B each time a sheet of paper is printed.

Thus, the first drive signal generation section 70A and the second drive signal generation section 70B generate heat equally. However, there is a possibility that heat will be generated predominantly in one of the drive signal generation sections if the type of image that is printed on the odd pages is different from the type of image that is printed on the even pages.

It should be noted that it is not absolutely necessary to switch the drive signals that are generated by the two drive signal generation sections even if the drive signals are changed each time a sheet of paper is printed. For example, if the drive signals are changed each time a sheet of paper is printed, then it is also possible to rotate the drive signals that are generated among three drive signal generation sections.

(1-7) It is not absolutely necessary for the printer-side controller 60 to switch the drive signals COM at a periodic timing (e.g. every dot formation operation, every fixed number of dot formation operations, every time a sheet of paper is printed, every time a fixed number of sheets of paper are printed).

For example, it is also possible to provide at least one of the first drive signal generation section 70A and the second drive signal generation section 70B with a temperature sensor that detects the temperature. The printer-side controller 60 then switches the drive signals COM that are generated by the first drive signal generation section 70A and the second drive signal generation section 70B based on the results of the detection by the temperature sensor. That is, it is only necessary that heat is not generated predominantly in one of the drive signal generation sections.

It should be noted that even if the drive signals are changed according to the results of the detection by the temperature sensor, it is not always necessary to switch the drive signals that are generated by the two drive signal generation sections. For example, if the drive signals are changed based on the results of the detection by the temperature sensor, then it is also possible to rotate the drive signals that are generated among three drive signal generation sections.

(1-8) It is also possible for the printer-side controller 60 to count the number of dots that are formed and then, based on the results of that count, switch the drive signals COM that are generated by the first drive signal generation section 70A and the second drive signal generation section 70B. Since the first drive signal generation section 70A and the second drive signal generation section 70B generate heat depending on the dots that are formed, the printer-side controller 60 can estimate the amount of heat that is generated by the first drive signal generation section 70A and the second drive signal generation section 70B based on the results of the count, and then take steps so that heat is not generated predominantly by one of the drive signal generation sections.

It should be noted that it is not always necessary to switch the drive signals that are generated by the two drive signal generation sections, even if the drive signals are changed according to the count results. If the drive signals are changed according to the count results, then for example it is also possible to rotate the drive signals that are generated among three drive signal generation sections.

(1-9) The above printer has a heat sink 722 (one example of the cooling device). The heat sink 722 cools the first transistor pair 721A of the first drive signal generation section 70A and the second transistor pair 721B of the second drive signal generation section 70B.

If the generation of heat is concentrated on one of the drive signal generation sections, it is necessary to design the heat sink 722 taking into account the drive signal generation section that will generate the larger amount of heat. Doing this, however, means that a heat sink 722 that is too large for the drive signal generation section generates the smaller amount of heat is provided, and this increases the size of the apparatus.

In contrast, in the above printer the first drive signal generation section 70A and the second drive signal generation section 70B generate heat equally, and thus a smaller heat sink 722 can be designed.

(1-10) The above printer can form large dots, medium dots, and small dots. The head controller HC selectively applies drive pulses included in the first drive signal COM_A and the second drive signal COM_B to the piezo elements 417 according to the size of the dot to be formed. For example, if the pixel data are 01, then a small dot should be formed and thus the head controller HC inputs the waveform selection signal q1 to the first switch 87A as the first switch signal SW1, and inputs the waveform selection signal q5 to the second switch 87B as the second switch control signal SW2. Thus, the head controller HC applies the drive pulse PS2 of the first drive signal COM_A to the piezo elements 417.

(1-11) If a large dot is to be formed, then the drive pulse PS1, the drive pulse PS5, and the drive pulse PS3 are applied to the piezo elements 417. Say, however, that while the first drive signal generation section 70A is generating the drive pulse PS1 for forming a large dot, the second drive signal generation section 70B is generating the drive pulse PS4 for forming a medium dot. In this way, when a drive pulse for forming a dot of a certain size is generated by one drive signal generation section while a drive pulse for forming a dot of another size is generated by the other drive signal generation section, then the period T shown in FIG. 9 can be shortened. As a result, the print resolution is increased, and the movement speed of the carriage can be increased and thus the printing speed is increased.

(1-12) When a large dot is to be formed, the head controller HC applies the drive pulse PS1 and the drive pulse PS3, which are included in the first drive signal COM_A, to the piezo elements 417, and applies the drive pulse PS5, which is included in the second drive signal COM_B, to the piezo elements 417.

If the first drive signal COM_A has the drive pulse PS5 instead of the drive pulse PS2 so that large dots are formed by only the first drive signal COM_A, then the one drive signal generation section that generates the first drive signal COM_A will consume 4.5 W of power and the other drive signal generation section will not consume power. As a result, the generation of heat will be concentrated on the one drive signal generation section that generates the first drive signal COM_A.

In contrast, the above head controller HC spreads out the three drive pulses for forming large dots over the first drive signal COM_A and the second drive signal COM_B. Thus, when forming large dots, the drive signal generation section that generates the first drive signal COM_A will consume 3.0 W of power and the drive signal generation section that generates the second drive signal COM_B will consume 1.5 W of power. That is, the degree to which the amount of heat that is generated in a single dot formation operation is unevenly distributed can be reduced.

(1-13) Combining all of the structural elements of the above embodiment allows all of the effects to be achieved, and this is favorable. It goes without saying that not all of the structural features of the above embodiment are essential.

(1-14) With the above printing method, first a printer that has piezo elements 417, the first drive signal generation section 70A, and the second drive signal generation section 70B is prepared. Then, when printing is performed, at a certain timing the first drive signal generation section 70A generates the first drive signal COM_A and the second drive signal generation section 70B generates the second drive signal COM_B, forming dots of a predetermined size. At a separate timing, the first drive signal generation section 70A generates the second drive signal COM_B and the second drive signal generation section 70B generates the first drive signal COM_A, forming dots of the predetermined size.

Consequently, the first drive signal generation section 70A and the second drive signal generation section 70B produce an equal amount of heat.

It should be noted that the printing method is not limited to a method of switching the drive signals that are generated by the two drive signal generation sections. For example, it can also be a printing method in which the drive signals that are generated are rotated among three drive signal generation sections.

(1-15) The above printer has piezo elements 417, the first drive signal generation section 70A, and the second drive signal generation section 70B. The printer also is provided with the memory 63, on which a program is stored. The CPU 62 of the printer inputs DAC values to the first drive signal generation section 70A and the second drive signal generation section 70B according to this program.

Specifically, the program causes the CPU 62 of the printer to input DAC values so that at a certain timing the first drive signal generation section 70A generates the first drive signal COM_A and the second drive signal generation section 70B generates the second drive signal COM_B. The program also causes the CPU 62 of the printer to input DAC values so that at a separate timing the first drive signal generation section 70A generates the second drive signal COM_B and the second drive signal generation section 70B generates the first drive signal COM_A.

Consequently, the first drive signal generation section 70A and the second drive signal generation section 70B produce an equal amount of heat.

It should be noted that the program is not limited to a program for causing the printer to switch the drive signals that are generated by the two drive signal generation sections. For example, the program can also cause the printer to rotate the drive signals that are generated among three drive signal generation sections.

(1-16) The printing system discussed above is provided with a computer and a printer. With this printing system, when the printer performs printing based on print data from the computer, the first drive signal generation section 70A and the second drive signal generation section 70B produce an equal amount of heat.

It should be noted that the printing system is not limited to a method in which the drive signals that are generated by two drive signal generation sections are switched. For example, it can also be a printing system in which the drive signals that are generated are rotated among three drive signal generation sections.

(2-1) The printing system made of the printer described above and a computer has piezo elements 417 (one example of the elements) that are driven in order to eject ink, a first drive signal generation section 70A and a second drive signal generation section 70B that generate drive signals COM for driving the piezo elements 417, and a controller that is constituted by a host-side controller, a printer-side controller 60 and a head controller HC.

The printer-side controller 60 inputs DAC values to the first drive signal generation section 70A and the second drive signal generation section 70B to cause the first drive signal generation section 70A and the second drive signal generation section 70B to generate drive signals. For example, when dots are to be formed in a certain dot formation operation (S30, see FIG. 11), the printer-side controller 60 causes the first drive signal generation section 70A to generate the first drive signal COM_A and causes the second drive signal generation section 70B to generate the second drive signal COM_B.

Here, if a small dot is to be formed, then only the drive pulse PS2 of the first drive signal COM_A that is generated by the first drive signal generation section 70A is applied to the piezo elements 417 (see FIG. 9). Thus, when forming a small dot, only the first drive signal generation section 70A, which generates the first drive signal COM_A, consumes power, and the second drive signal generation section 70B, which generates the second drive signal COM_B, does not consume power (see FIG. 13). In this way, the power consumption of the first drive signal generation section 70A and the power consumption of the second drive signal generation section 70B are different when dots of a predetermined size are formed.

This difference in power consumption equates to a difference in the amount of heat generated. Thus, when the first drive signal generation section 70A continues to generate the first drive signal COM_A and the second drive signal generation section 70B continues to generate the second drive signal COM_B, heat will tend to be more concentrated on the first drive signal generation section COM_A than the second drive signal generation section 70B.

Accordingly, in the above printing system, when dots are to be formed in a separate dot formation operation, the printer-side controller 60 switches the drive signals COM that are generated by the first drive signal generation section 70A and the second drive signal generation section 70B so that the first drive signal generation section 70A generates the second drive signal COM_B and the second drive signal generation section 70B generates the first drive signal COM_A.

Thus, if small dots are to be formed, for example, then power is consumed by only the second drive signal generation section 70B, which generates the first drive signal COM_A, and the second drive signal generation section 70B generates more heat than the first drive signal generation section 70A. When the heat that is generated before and after the drive signals are switched is taken as a whole, the first drive signal generation section 70A and the second drive signal generation section 70B generate an equal amount of heat.

However, due to the effects of manufacturing discrepancies, there may be differences in the amount of ink that is ejected for the small dots that are formed by the first drive signal generation section 70A and the small dots that are formed by the second drive signal generation section 70B. When print images are formed by nonuniform ink amounts, there is a possibility that the print image may appear coarse.

Accordingly, in the above printing system, adjustment values are stored in the adjustment value storage region 63*a* of the memory 63 in advance. With regard to small dots, for example, a small dot adjustment value that is associated with the first drive signal generation section 70A and a small dot adjustment value that is associated with the second drive signal generation section 70B are stored on the adjustment value storage region 63*a*.

When the first drive signal generation section 70A generates the first drive signal COM_A for forming a small dot, the amount of ink that is ejected is corrected based on the small dot adjustment amount that is associated with the first drive signal generation section 70A. Then, when the drive signals are switched and the second drive signal generation section 70B generates the first drive signal COM_A for forming a small dot, the amount of ink that is ejected is corrected based on the small dot adjustment amount that is associated with the second drive signal generation section 70B. That is, the small dot adjustment value is also a correction value for correcting the amount of ink that is ejected.

Thus, the print image that is formed by the first drive signal generation section 70A and the print image that is formed by the second drive signal generation section 70B are adjusted according to the respective properties of the drive signal generation sections, and thus a high-quality print image can be obtained.

(2-2) In the embodiment, at a certain timing the first drive signal generation section 70A generates the first drive signal COM_A and the second drive signal generation section 70B generates the second drive signal COM_B, and at a separate timing the first drive signal generation section 70A generates the second drive signal COM_B and the second drive signal generation section 70B generates the first drive signal COM_A. That is, according to this embodiment, the drive signal that is generated by the first drive signal and the drive signal that is generated by the second drive signal are switched. Thus, the first drive signal generation section 70A and the second drive signal generation section 70B generate heat equally.

It should be noted that it is also possible for the drive signal generation circuit to have more than two drive signal generation sections, and for example can have three drive signal generation sections. In this case, at a certain timing the first drive signal generation section 70A generates the first drive signal COM_A, the second drive signal generation section 70B generates the second drive signal COM_B, and the third drive signal generation section generates a third drive signal, and at a separate timing the first drive signal generation section 70A generates the second drive signal COM_B, the second drive signal generation section 70B generates the first drive signal COM_A, and the third drive signal generation section generates the third drive signal. The drive signals that are generated by the first drive signal generation section and the second drive signal generation section are switched in this case as well, and thus the same effects as in the embodiment described above are attained.

(2-3) In the above embodiment, the drive signal that is generated by the first drive signal and the drive signal that is generated by the second drive signal are switched, but it is not absolutely necessary that the drive signals are switched. For example, if a third drive signal generation section is provided in addition to the first drive signal generation section 70A and the second drive signal generation section 70B, then it is also possible that at a certain timing the first drive signal generation section 70A generates the first drive signal COM_A, the second drive signal generation section 70B generates the second drive signal COM_B, and the third drive signal generation section generates a third drive signal, and at a separate timing the first drive signal generation section 70A generates the second drive signal COM_B, the second drive signal generation section 70B generates the third drive signal, and the third drive signal generation section generates the first drive signal COM_A. Thus, even when the drive signals that are generated are rotated among three drive signal generation sections, adjustments can be made according to the properties of each drive signal generation section as long as the ink amounts are corrected based on the adjustment values that are associated with each drive signal generation section, and thus high-quality print images can be obtained.

(2-4) The printer-side controller 60 and the head controller HC for example cause the first drive signal generation section 70A to generate the first drive signal COM_A for forming small dots in order to form the correction pattern group CP1 for obtaining the small dot adjustment value on the paper. The printer-side controller 60 and the head controller HC switch the drive signals and then cause the second drive signal generation section 70B to generate the first drive signal COM_A in order to form the correction pattern group CP2 for obtaining the small dot adjustment value on the paper.

Consequently, by reading these adjustment pattern groups it is possible to obtain a small dot adjustment value that is associated with the first drive signal generation section 70A (example of the first correction value) and a small dot adjustment value that is associated with the second drive signal generation section 70B (example of the second correction value).

(2-5) In the first embodiment discussed above, the amount of ink in one droplet of ink (the amount of ink that is ejected in order to form a single dot that is formed in a single pixel) is adjusted. This allows discrepancies in the dot diameter due to the properties of the drive signal generation sections to be inhibited, and thus a high-quality print image can be obtained.

It should be noted that it is also possible to adjust the quantity of one ink droplet (the amount of ink that is ejected in order to form a single dot that is formed in a single pixel) in a case where the drive signals that are generated are rotated among three drive signal generation sections.

(2-6) In the first embodiment discussed above, the printer-side controller 60 corrects the drive voltage Vh of the drive pulse PS2 based on the small dot correction value of the first drive signal generation section 70A when the first drive signal generation section 70A generates the drive pulse PS2 of the first drive signal COM_A. On the other hand, when the drive signals COM have been switched and the second drive signal generation section 70A generates the drive pulse PS2 of the first drive signal COM_A, the printer-side controller 60 corrects the drive voltage Vh of the drive pulse PS2 based on the small dot correction value of the second drive signal generation section 70B (see FIG. 18).

Thus, the amount of ink that is ejected when the drive pulse PS2 is applied to the piezo elements 417 is adjusted.

It should be noted that it is also possible to correct the drive voltage of the drive pulses based on the adjustment values in a case where the drive signals that are generated are rotated among three drive signal generation sections.

(2-7) Each first drive signal COM_A includes a plurality of drive waveforms. The printer-side controller 60 performs adjustment so that the intermediate voltage of the drive waveforms of the first drive signal COM_A is constant (see FIG. 22B).

Thus, sudden voltage changes can be kept from occurring within the same drive signal.

It should be noted that it is also possible to perform adjustment so that the intermediate voltage is constant in a case where the drive signals that are generated are rotated among three drive signal generation sections as well.

(2-8) The printer-side controller 60 performs adjustment so that the intermediate voltage of the first drive signal COM_A is aligned with the intermediate voltage of the second drive signal COM_B. It is therefore possible to inhibit application to the piezo elements 417 of a voltage that changes suddenly, when the drive waveforms of the second drive signal COM_B are applied to the piezo elements 417 after the drive waveforms of the first drive signal COM_A have been applied to the piezo elements 417.

It should be noted that it is also possible to align the intermediate voltages of the drive signals that are generated by the drive signal generation sections in a case where the drive signals that are generated are rotated among three drive signal generation sections.

(2-9) The large dots discussed above are formed by applying the drive pulse PS1 and the drive pulse PS3 included in the first drive signal and the drive pulse PS5 included in the second drive signal to the piezo elements 417. By including the drive pulses for forming large dots in two drive signals COM in this way, the heat that is generation by the two drive signal generation sections can be dispersed.

(2-10) In the first embodiment, the amount of ink that is ejected to the region of one pixel is adjusted. However, adjustment of the ink amount is not limited to this.

For example, in the second embodiment, the host-side controller adjusts the number of dots that are ejected to a region that corresponds to a plurality of pixels. By doing this, the total ink amount that is ejected to this region is adjusted.

It should be noted that it is also possible to adjust the number of dots that are ejected to a region that corresponds to a plurality of pixels in a case where the drive signals that are generated are rotated among three drive signal generation sections.

(2-11) In the second embodiment, the dot creation ratio table is corrected based on the adjustment values that are associated with the first drive signal generation section and the adjustment values that are associated with the second drive signal generation section. Thus, if the host-side controller performs halftone processing based on this dot creation ratio table and sends those print data that are created to the printer 1, the printer performs printing adjusting the number of dots that are ejected to a region that corresponds to a plurality of pixels. By doing this, it is possible to obtain a high-quality print image.

It should be noted that it is also possible to correct the dot creation ratio table in a case where the drive signals that are generated are rotated among three drive signal generation sections.

(2-12) In the printing system described above, with regard to medium dots, for example, a medium dot adjustment value that is associated with the first drive signal generation section 70A and a medium dot adjustment value that is associated with the second drive signal generation section 70B are stored in the adjustment value storage region 63*a*.

Then, when the second drive signal generation section 70B generates the second drive signal COM_B for forming a medium dot, the amount of ink that is ejected is corrected based on the medium dot adjustment value that is associated with the second drive signal generation section 70B. When the drive signals have been switched and the first drive signal generation section 70A generates the second drive signal COM_B for forming a medium dot, the amount of ink that is ejected is corrected based on the medium dot adjustment value that is associated with the first drive signal generation section 70B.

Thus, the print image that is formed by the first drive signal generation section 70A and the print image that is formed by the second drive signal generation section 70B are adjusted according to the respective properties of the drive signal generation sections, and thus a high-quality print image can be obtained.

In this way, in the first embodiment discussed above, adjustment values that correspond to each dot size are stored in the memory separately for each drive signal generation section.

(2-13) Combining all of the structural elements of the above embodiment allows all of the effects to be achieved, and this is favorable. It goes without saying that not all of the structural features of the above embodiment are essential.

(2-14) In the above printing method, a printing apparatus that has piezo elements 417 that are driven in order to eject ink, and the first drive signal generation section and the second drive signal generation section for generating the drive signals COM for driving the piezo elements 417, is prepared. Then, when printing is performed, when the first drive signal generation section 70A generates the first drive signal COM_A and the second drive signal generation section 70B generates the second drive signal COM_B, the amount of ink that is ejected when forming a small dot is corrected based on the small dot adjustment value that is associated with the first drive signal generation section 70A. Then, when the drive signals are switched, the amount of ink that is ejected when forming a small dot is corrected based on the small dot adjustment value that is associated with the second drive signal generation section 70B.

Thus, the print image that is formed by the first drive signal generation section 70A and the print image that is formed by the second drive signal generation section 70B are adjusted according to the respective properties of the drive signal generation sections, and thus a high-quality print image can be obtained.

It should be noted that the printing method is not limited to a method of switching the drive signals that are generated by two drive signal generation sections. For example, it can also be a printing method in which the drive signals that are generated are rotated among three drive signal generation section.

(2-15) In the first embodiment, the printer-side controller is controlled based on a program stored on the memory 63 of the printer 1 to realize the first embodiment.

On the other hand, in the second embodiment, the host-side controller is controlled based on the printer driver to realize the second embodiment. In both embodiments, however, the print image that is formed by the first drive signal generation section 70A and the print image that is formed by the second drive signal generation section 70B are adjusted according to the respective properties of the drive signal generation sections, and thus a high-quality print image can be obtained.

It should be noted that the program is not limited to a program for switching the drive signals that are generated by two drive signal generation sections. For example, the program can also cause the printer to rotate the drive signals that are generated among three drive signal generation sections.

(3-1) The printer (one example of the printing apparatus) described above has piezo elements 417 (one example of the elements) that are driven in order to form dots, a first drive signal generation section 70A and a second drive signal generation section 70B that generate drive signals COM for driving the piezo elements 417, and a controller that is constituted by the printer-side controller 60 and the head controller HC.

The printer-side controller 60 inputs DAC values to the first drive signal generation section 70A and the second drive signal generation section 70B to cause the first drive signal generation section 70A and the second drive signal generation section 70B to generate drive signals. For example, when dots are to be formed in a certain dot formation operation (S30, see FIG. 11), the printer-side controller 60 causes the first drive signal generation section 70A to generate the first drive signal COM_A and causes the second drive signal generation section 70B to generate the second drive signal COM_B.

Here, if a small dot is to be formed, then only the drive pulse PS2 of the first drive signal COM_A that is generated by the first drive signal generation section 70A is applied to the piezo element 417 (see FIG. 9). Thus, when forming a small dot, only the first drive signal generation section 70A, which generates the first drive signal COM_A, consumes power, and the second drive signal generation section 70B, which generates the second drive signal COM_B, does not consume power (see FIG. 13). In this way, the power consumption of the first drive signal generation section 70A and the power consumption of the second drive signal generation section 70B are different when dots of a predetermined size are formed.

This difference in power consumption equates to a difference in the amount of heat generated. Thus, when the first drive signal generation section 70A continually generates the first drive signal COM_A and the second drive signal generation section 70B continually generates the second drive signal COM_B, heat will tend to be more concentrated on the first drive signal generation section 70A than the second drive signal generation section 70B.

Accordingly, in the above printing apparatus, the printer-side controller 60 switches the drive signals COM that are generated by the first drive signal generation section 70A and the second drive signal generation section 70B so that the first drive signal generation section 70A generates the second drive signal COM_B and the second drive signal generation section 70B generates the first drive signal COM_A. Thus, if small dots are to be formed, for example, then power is consumed by only the second drive signal generation section 70B, which generates the first drive signal COM_A, and the second drive signal generation section 70B generates more heat than the first drive signal generation section 70A. When the heat that is generated before and after the drive signals are switched is taken as a whole, the first drive signal generation section 70A and the second drive signal generation section 70B generate an equal amount of heat.

When the drive signals are switched every dot formation operation, however, raster lines of different sizes are formed as shown in FIG. 37. The result is that the quality of the print image may drop.

Accordingly, as shown in FIG. 32 (and FIGS. 39 and 40), in the above printer the printer-side controller 60 switches the drive signals COM that are generated by the first drive signal generation section 70A and the second drive signal generation section 70B during the dot formation operations. Thus, the raster lines include dots that are formed when the first drive signal generation section 70A generates the first drive signal COM_A and the second drive signal generation section 70B generates the second drive signal COM_B, and dots that are formed when the first drive signal generation section 70A generates the second drive signal COM_B and the second drive signal generation section 70B generates the first drive signal COM_A. The result is that a drop in image quality rising from differences in the thickness of the raster lines can be inhibited, as shown in FIGS. 38A and 38B.

(3-2) In the embodiment discussed above, at a certain timing the first drive signal generation section 70A generates the first drive signal COM_A and the second drive signal generation section 70B generates the second drive signal COM_B, and at a separate timing the first drive signal generation section 70A generates the second drive signal COM_B and the second drive signal generation section 70B generates the first drive signal COM_A. That is, according to this embodiment, the drive signal that is generated by the first drive signal and the drive signal that is generated by the second drive signal are switched. Thus, the first drive signal generation section 70A and the second drive signal generation section 70B generate heat equally. Switching the drive signals COM during the dot formation operations also allows the image quality to be kept from dropping due to differences in the thickness of the raster lines.

It should be noted that it is also possible for the drive signal generation circuit to have more than two drive signal generation sections, and for example it can have three drive signal generation sections. In this case, at a certain timing the first drive signal generation section 70A generates the first drive signal COM_A, the second drive signal generation section 70B generates the second drive signal COM_B, and the third drive signal generation section generates a third drive signal, and at a separate timing the first drive signal generation section 70A generates the second drive signal COM_B, the second drive signal generation section 70B generates the first drive signal COM_A, and the third drive signal generation section generates the third drive signal. The drive signals that are generated by the first drive signal generation section and the second drive signal generation section are switched in this case as well, and thus the same effects as in the embodiment described above are attained.

(3-3) In the above embodiment, the drive signal that is generated by the first drive signal and the drive signal that is generated by the second drive signal are switched, but it is not absolutely necessary to switch the drive signals. For example, if a separate third drive signal generation section is provided in addition to the first drive signal generation section 70A and the second drive signal generation section 70B, then it is also possible that at a certain timing the first drive signal generation section 70A generates the first drive signal COM_A, the second drive signal generation section 70B generates the second drive signal COM_B, and the third drive signal generation section generates a third drive signal, and at a separate timing the first drive signal generation section 70A generates the second drive signal COM_B, the second drive signal generation section 70B generates the third drive signal, and the third drive signal generation section generates the first drive signal COM_A. Thus, even in a case where the drive signals that are generated are rotated among three drive signal generation sections, the drive signal generation section that generates the first drive signal is changed as in the above embodiment, and thus the image quality becomes uniform and this improves the image quality.

(3-4) In the above printer, the printer-side controller 60 switches the drive signals that are generated by the first drive signal generation section 70A and the second drive signal generation section 70B each period in which the dot of one pixel is formed, that is, each time the carriage CR moves 1/720 inch when printing at a resolution of 720 dpi (see FIG. 32). Switching the drive signals at this timing leads to the dot that is formed when the first drive signal generation section 70A generates the first drive signal COM_A and the second drive signal generation section 70B generates the second drive signal COM_B and the dot that is formed when the first drive signal generation section 70A generates the second drive signal COM_B and the second drive signal generation section 70B generates the first drive signal COM_A formed in alternation in the movement direction. Differences in raster line thickness therefore become less noticeable, and this allows deterioration in the image quality to be inhibited even further.

It should be noted that the timing at which the drive signals are switched is not limited to every period in which the dots of one pixel are formed. For example, as shown in FIG. 39, it can also be every period in which the dots of two pixels are formed, and as shown in FIG. 40, it can be any point in time during the dot formation operation.

(3-5) The above printer also includes the carriage CR (one example of a moving member that moves the elements in the movement direction in order to change the relative position between the elements and the medium) and the linear encoder 51 (one example of a sensor for detecting the position of the moving member). The printer-side controller 60 then switches the drive signals COM that are generated by the first drive signal generation section 70A and the second drive signal generation section 70B according to the latch signal LAT based on the detection signal PTS that is output from the linear encoder 51 or according to the detection signal PTS that is output from the linear encoder 51. The printer-side controller thus can obtain the timing at which the drive signals should be switched.

(3-6) As shown in FIG. 38B, the above printer-side controller 60 changes the order of the drive signals that are generated by the drive signal generation sections each dot formation operation. This accordingly inhibits the dots that are formed when the first drive signal generation section 70A generates the first drive signal COM_A and the second drive signal generation section 70B generates the second drive signal COM_B from being lined up in a continuous manner in the carrying direction, and the dots that are formed when the first drive signal generation section 70A generates the second drive signal COM_B and the second drive signal generation section 70B generates the first drive signal COM_A from being lined up in a continuous manner in the carrying direction. Thus, the image quality of the print image becomes uniform, and this improves the image quality.

(3-7) The above printer can form large dots, medium dots, and small dots. The head controller HC selectively applies the drive pulses included in the first drive signal COM_A and the second drive signal COM_B to the piezo elements 417 according to the size of the dot to be formed. For example, if the pixel data are 01, then a small dot should be formed and thus the head controller HC inputs the waveform selection signal q1 to the first switch 87A as the first switch signal SW1, and inputs the waveform selection signal q5 to the second switch 87B as the second switch control signal SW2. Thus, the head controller HC applies the drive pulse PS2 of the first drive signal COM_A to the piezo elements 417.

(3-8) If a large dot is to be formed, then the drive pulse PS1, the drive pulse PS5, and the drive pulse PS3 are applied to the piezo elements 417. However, the second drive signal generation section 70B generates the drive pulse PS4 for forming a medium dot while the first drive signal generation section 70A is generating the drive pulse PS1 for forming a large dot. In this way, by generating a drive pulse for forming a dot of one size by one drive signal generation section while generating a drive pulse for forming a dot of another size by the other drive signal generation section, the period T shown in FIG. 9 can be shortened. As a result, the print resolution is increased, and the movement speed of the carriage can be increased and thus the printing speed is increased.

(3-9) When a large dot is to be formed, the head controller HC applies the drive pulse PS1 and the drive pulse PS3, which are included in the first drive signal COM_A, to the piezo elements 417, and applies the drive pulse PS5, which is included in the second drive signal COM_B, to the piezo elements 417.

If the first drive signal COM_A has the drive pulse PS5 instead of the drive pulse PS2 so that large dots are formed by only the first drive signal COM_A, then the one drive signal generation section that generates the first drive signal COM_A will consume 4.5 W of power and the other drive signal generation section will not consume power. As a result, heat predominantly will be produced in the one drive signal generation section that generates the first drive signal COM_A.

In contrast, the above head controller HC spreads out the three drive pulses for forming large dots over the first drive signal COM_A and the second drive signal COM_B. Thus, when forming large dots, the drive signal generation section that generates the first drive signal COM_A will consume 3.0 W of power and the drive signal generation section that generates the second drive signal COM_B will generate 1.5 W of power. That is, the degree to which the amount of heat that is generated in a single dot formation operation is distributed unevenly can be reduced.

(3-10) Combining all of the structural elements of the above embodiment allows all of the effects to be attained, and this is favorable. It goes without saying that not all of the structural features of the above embodiment are essential.

(3-11) With the above printing method, first a printer that has piezo elements 417, the first drive signal generation section 70A, and the second drive signal generation section 70B is prepared. Then, when printing is performed, at a certain timing the first drive signal generation section 70A generates the first drive signal COM_A and the second drive signal generation section 70B generates the second drive signal COM_B, forming dots of a predetermined size. At a separate timing, the first drive signal generation section 70A generates the second drive signal COM_B and the second drive signal generation section 70B generates the first drive signal COM_A, forming dots of a predetermined size.

Then, as shown in FIG. 32 (and FIGS. 39 and 40), the printer-side controller 60 switches the drive signals COM that are generated by the first drive signal generation section 70A and the second drive signal generation section 70B during the dot formation operations. As a result, it is possible to inhibit a drop in the image quality due to differences in the thickness of the raster lines, as shown in FIG. 38A and FIG. 38B.

It should be noted that the printing method is not limited to a method of switching the drive signals that are generated by two drive signal generation sections. For example, it can also be a printing method in which the drive signals that are generated are rotated among three drive signal generation sections.

(3-12) The above printer has piezo elements 417, the first drive signal generation section 70A, and the second drive signal generation section 70B. The printer also is provided with the memory 63, on which a program is stored. The CPU 62 of the printer inputs DAC values to the first drive signal generation section 70A and the second drive signal generation section 70B according to this program.

Specifically, the program causes the CPU 62 of the printer to input DAC values so that at a certain timing the first drive signal generation section 70A generates the first drive signal COM_A and the second drive signal generation section 70B generates the second drive signal COM_B. The program also causes the CPU 62 of the printer to input DAC values so that at a separate timing the first drive signal generation section 70A generates the second drive signal COM_B and the second drive signal generation section 70B generates the first drive signal COM_A.

Further, the program causes the CPU 62 of the printer to switch the drive signals COM that are generated by the first drive signal generation section 70A and the second drive signal generation section 70B during the dot formation operations. The printer thus can be made to perform high-quality printing.

It should be noted that the program is not limited to a program for causing the printer to switch the drive signals that are generated by two drive signal generation sections. For example, the program can also cause the printer to rotate the drive signals that are generated among three drive signal generation sections.

(3-13) The printing system discussed above is provided with a computer and a printer. With this printing system, the drive signals COM that are generated by the first drive signal generation section 70A and the second drive signal generation section 70B can be switched during the dot formation operations when the printer executes printing based on print data from the computer, and thus high-quality printing can be performed.

It should be noted that the printing system is not limited to one in which the drive signals that are generated by two drive signal generation sections are switched. For example, it can also be a printing system in which the drive signals that are generated are rotated among three drive signal generation sections.

What is claimed is:

1. A printing method comprising the following steps of:

preparing a printing apparatus that includes an element that is driven in order to eject ink, a first drive signal generation section that generates first drive signals for driving the element, and a second drive signal generation section that generates second drive signals for driving the element, the element being selectively driven by the first and second drive signals;

when the first drive signal generation section is caused to generate a first drive signal for forming a first dot of a first predetermined size and the second drive signal generation section is caused to generate a second drive signal for forming a second dot of a second predetermined size that is different from the first predetermined size, correcting an amount of the ink that is ejected according to the first drive signal based on a first correction value that is associated with the first drive signal generation section; and when the second drive signal generation section is caused to generate the first drive signal, correcting an amount of the ink that is ejected according to the first drive signal based on a second correction value that is associated with the second drive signal generation section.

2. A printing method according to claim 1, wherein the first drive signal generation section generates the second drive signal when the second drive signal generation section is caused to generate the first drive signal.

3. A printing method according to claim 1, wherein the printing apparatus further includes a separate drive signal generation section that is different from the first drive signal generation section and the second drive signal generation section; and wherein the separate drive signal generation section generates the second drive signal when the second drive signal generation section is caused to generate the first drive signal.

4. A printing method according to claim 1, wherein the printing apparatus forms a pattern for obtaining the first correction value on a medium by causing the first drive signal generation section to generate the first drive signal, and forms a pattern for obtaining the second correction value on a medium by causing the second drive signal generation section to generate the first drive signal.

5. A printing method according to claim 1, wherein an amount of the ink that is ejected in order to form a dot of the first predetermined size is corrected based on the first correction value or the second correction value.

6. A printing method according to claim 5, wherein, when the first drive signal generation section is caused to generate the first drive signal, a voltage of the drive signal that is generated by the first drive signal generation section is corrected based on the first correction value; and wherein, when the second drive signal generation section is caused to generate the first drive signal, a voltage of the drive signal that is generated by the second drive signal generation section is corrected based on the second correction value.

7. A printing method according to claim 5, wherein each of the drive signals includes a plurality of drive waveforms; and wherein correction is performed such that an intermediate voltage of each of the drive waveforms in the drive signal generated by the first drive signal generation section or the second drive signal generation section is the same.

8. A printing method according to claim 5, wherein correction is performed such that an intermediate voltage of each of the drive signals generated by the first drive signal generation section and the second drive signal generation section is the same.

9. A printing method according to claim 5, wherein each of the drive signals includes a plurality of drive waveforms; and wherein a dot of a largest size is formed by at least one of the drive waveforms generated by the first drive signal generation section and at least one of the drive waveforms generated by the second drive signal generation section.

10. A printing method according to claim 1, wherein a number of the dots of the predetermined size that are formed within a predetermined region is corrected.

11. A printing method according to claim 10, wherein a dot creation ratio is corrected based on the first correction value or the second correction value.

12. A printing method according to claim 1, wherein a memory of the printing apparatus stores a third correction value that is associated with the first drive signal generation section and a fourth correction value that is associated with the second drive signal generation section; and wherein when the second drive signal generation section is caused to generate the second drive signal, the printing apparatus corrects an amount of the ink that is ejected according to the second drive signal that is generated by the second drive signal generation section based on the fourth correction value, and when the first drive signal generation section is caused to generate the second drive signal, the printing apparatus corrects an amount of the ink that is ejected according to the second drive signal that is generated by the first drive signal generation section based on the third correction value.

13. A printing method comprising the following steps of:

preparing a printing apparatus that includes an element that is driven in order to eject ink, a first drive signal generation section that generates first drive signals for driving the element, and a second drive signal generation section that generates second drive signals for driving the element, the element being selectively driven by the first and second drive signals;

when the first drive signal generation section is caused to generate a first drive signal for forming a first dot of a first predetermined size and the second drive signal generation section is caused to generate a second drive signal for forming a second dot of a second predetermined size that is different from the first predetermined size, correcting an amount of the ink that is ejected according to the first drive signal based on a first correction value that is associated with the first drive signal generation section; and when the first drive signal generation section is caused to generate the second drive signal and the second drive signal generation section is caused to generate the first drive signal correcting an amount of the ink that is ejected according to the first drive signal based on a second correction value that is associated with the second drive signal generation section;

wherein the printing apparatus forms a pattern for obtaining the first correction value on a medium by causing the first drive signal generation section to generate the drive signal for forming dots of the first predetermined size, and forms a pattern for obtaining the second correction value on a medium by causing the second drive signal generation section to generate the drive signal for forming dots of the first predetermined size;

wherein an amount of the ink that is ejected in order to form a dot of the first predetermined size is corrected based on the first correction value or the second correction value;

wherein, when the first drive signal generation section is caused to generate the first drive signal, a voltage of the drive signal that is generated by the first drive signal generation section is corrected based on the first correction value;

wherein, when the second drive signal generation section is caused to generate the first drive signal, a voltage of the drive signal that is generated by the second drive signal generation section is corrected based on the second correction value;

wherein each of the first and second drive signals includes a plurality of drive waveforms;

wherein correction is performed such that an intermediate voltage of each of the drive waveforms in the drive signal generated by the first drive signal generation section or the second drive signal generation section is the same; wherein correction is performed such that an intermediate voltage of each of the drive signals generated by the first drive signal generation section and the second drive signal generation section is the same;

wherein a dot of a largest size is formed by at least one of the drive waveforms generated by the first drive signal generation section and at least one of the drive waveforms generated by the second drive signal generation section;

wherein a memory of the printing apparatus stores a third correction value that is associated with the first drive signal generation section and a fourth correction value that is associated with the second drive signal generation section; and wherein when the second drive signal generation section is caused to generate the second drive signal, the printing apparatus corrects an amount of the ink that is ejected according to the second drive signal based on the fourth correction value, and when the first drive signal generation section is caused to generate the second drive signal the printing apparatus corrects an amount of the ink that is ejected according to the second drive signal based on the third correction value.

14. A printing system comprising:

a computer; and a printing apparatus, the printing apparatus including (A) an element that is driven in order to eject ink, (B) a first drive signal generation section that generates first drive signals for driving the element, (C) a second drive signal generation section that generates second drive signals for driving the element, wherein the element is selectively driven by the first and second drive signals;

(D) a memory that stores a first correction value that is associated with the first drive signal generation section and a second correction value that is associated with the second drive signal generation section, and (E) a controller that, when the first drive signal generation section is caused to generate a first drive signal for forming a first dot of a first predetermined size and the second drive signal generation section is caused to generate a second drive signal for forming a second dot of a second predetermined size that is different from the first predetermined size, corrects an amount of the ink that is ejected according to the first drive signal based on the first correction value, and when the second drive signal generation section is caused to generate the first drive signal, corrects an amount of the ink that is ejected according to the first drive signal based on the second correction value.

15. A storage medium having a program stored thereon, the program comprising the following codes:

a code that causes a printing system that includes an element that is driven in order to eject ink, a first drive signal generation section that generates first drive signals for driving the element, and a second drive signal generation section that generates second drive signals for driving the element, wherein the element is selectively driven by the first and second drive signals to correct, when the first drive signal generation section is caused to generate a first drive signal for forming a first dot of a first predetermined size and the second drive signal generation section is caused to generate a second drive signal for forming a second dot of a second predetermined size that is different from the first predetermined size, an amount of the ink that is ejected according to the first drive signal, based on a first correction value that is associated with the first drive signal generation section; and a code that causes the printing system to correct, when the second drive signal generation section is caused to generate the first drive signal, an amount of the ink that is ejected according to the first drive signal based on a second correction value that is associated with the second drive signal generation section.

* * * * *